US012492053B2

(12) United States Patent
Barnholtz et al.

(10) Patent No.: US 12,492,053 B2
(45) Date of Patent: Dec. 9, 2025

(54) SHIPPING UNIT LOAD WITH INCREASED STABILITY AND/OR SHIPPING EFFICIENCY

(71) Applicant: The Procter & Gamble Company, Cincinnati, OH (US)

(72) Inventors: Steven Lee Barnholtz, West Chester, OH (US); Peter Michael Searles, Mason, OH (US); Andrew Dontae Biddle, Cincinnati, OH (US); Carlos Omar Nilo Poyanco, Cincinnat, OH (US); Wesley Bernard Brokopp, Liberty Township, OH (US); Deborah Sue Slovut, Madeira, OH (US); David Mark Rasch, Cincinnati, OH (US); Leo E. Taske, II, Okeana, OH (US); Kimberly Marie Gerlach, Cincinnati, OH (US); Michael Bernard Beckum, Cincinnati, OH (US); Nneka D. Robinson, Cincinnati, OH (US); Gustav André Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 18/787,175

(22) Filed: Jul. 29, 2024

(65) Prior Publication Data

US 2024/0383659 A1 Nov. 21, 2024

Related U.S. Application Data

(63) Continuation of application No. 18/155,198, filed on Jan. 17, 2023, now Pat. No. 12,071,289.

(60) Provisional application No. 63/300,807, filed on Jan. 19, 2022, provisional application No. 63/300,410, filed on Jan. 18, 2022.

(51) Int. Cl.
*B65D 71/00* (2006.01)
*B65D 75/00* (2006.01)

(52) U.S. Cl.
CPC ..... *B65D 71/0096* (2013.01); *B65D 75/006* (2013.01); *B65D 2571/00018* (2013.01)

(58) Field of Classification Search
CPC ..... B65D 71/0096; B65D 75/006; B65D 2571/00018
USPC ..... 206/597, 386
See application file for complete search history.

(56) References Cited

U.S. PATENT DOCUMENTS

| | | | |
|---|---|---|---|
| 3,788,462 | A | 1/1974 | Meincer |
| 4,036,364 | A | 7/1977 | Ambrose |
| 4,136,501 | A | 1/1979 | Connolly |
| 4,204,377 | A | 5/1980 | Lancaster et al. |

(Continued)

OTHER PUBLICATIONS

All Office Actions, U.S. Appl. No. 16/811,444, filed Mar. 6, 2020.

(Continued)

*Primary Examiner* — Jacob K Ackun
(74) *Attorney, Agent, or Firm* — Richard L. Alexander

(57) ABSTRACT

Cargo assemblages including a pallet, a load of packages arranged in one or more layers, and a support layer, in which the support layer is sized and positioned within the cargo assemblage to support and/or stabilize the cargo, thereby providing improved pallet efficiency, improved shipping efficiency, and/or improved stability.

21 Claims, 38 Drawing Sheets

(56) References Cited

U.S. PATENT DOCUMENTS

| | | | | |
|---|---|---|---|---|
| 4,206,846 | A | 6/1980 | Connolly | |
| 4,235,062 | A | 11/1980 | Lancaster, III et al. | |
| 4,332,326 | A | 6/1982 | Kelly et al. | |
| 4,409,776 | A | 10/1983 | Usui | |
| 4,712,686 | A | 12/1987 | Lancaster et al. | |
| 4,741,442 | A | 5/1988 | Slocumb | |
| 4,747,252 | A | 5/1988 | Kapke | |
| 5,353,936 | A * | 10/1994 | Dockstader | B65D 19/44 206/386 |
| 6,269,951 | B1 | 8/2001 | Hartwig | |
| 6,471,061 | B1 | 10/2002 | Teague et al. | |
| 9,550,589 | B2 | 1/2017 | Jäppi et al. | |
| 10,494,162 | B1 | 12/2019 | Jernigan | |
| 11,279,539 | B2 | 3/2022 | Green et al. | |
| 2003/0208994 | A1 | 11/2003 | Gooding et al. | |
| 2008/0209862 | A1 | 9/2008 | Jappi et al. | |
| 2012/0042615 | A1* | 2/2012 | Roche | B65B 11/025 53/461 |
| 2012/0205272 | A1 | 8/2012 | Heilman et al. | |
| 2015/0000570 | A1* | 1/2015 | Day | B65D 19/44 108/55.1 |
| 2016/0272390 | A1 | 9/2016 | Dapper et al. | |
| 2019/0300254 | A1 | 10/2019 | Tattam | |
| 2020/0283208 | A1 | 9/2020 | Green et al. | |
| 2021/0221584 | A1 | 7/2021 | Smith | |
| 2022/0161981 | A1 | 5/2022 | Green et al. | |
| 2023/0182982 | A1 | 6/2023 | Mcgrath | |
| 2023/0227229 | A1 | 7/2023 | Barnholtz et al. | |
| 2023/0241777 | A1 | 8/2023 | Morris-downing | |
| 2023/0245036 | A1 | 8/2023 | Kuck | |
| 2024/0083650 | A1 | 3/2024 | Sanchez | |

OTHER PUBLICATIONS

All Office Actions; U.S. Appl. No. 17/669,414, filed Feb. 11, 2022.
All Office Actions; U.S. Appl. No. 18/155,198, filed Jan. 17, 2023.
All Office Actions; U.S. Appl. No. 18/305,404, filed Apr. 24, 2023.

* cited by examiner

SHIPPING UNIT LOAD WITH INCREASED STABILITY AND/OR SHIPPING EFFICIENCY

CROSS REFERENCE TO RELATED APPLICATIONS

This application is a continuation of, and claims priority under 35 U.S.C. § 120 to, U.S. patent application Ser. No. 18/155,198, filed on Jan. 17, 2023, which claims the benefit, under 35 USC § 119 (e), of U.S. Provisional Application No. 63/300,807, filed Jan. 19, 2022 and U.S. Provisional Application No. 63/300,410, filed Jan. 18, 2022, the substances of which is incorporated herein by reference.

FIELD

The present disclosure relates generally to cargo assemblages, including products and/or containers of products stacked on pallets, and more specifically to such cargo assemblages comprising a support layer adapted to support and/or to protect the products and/or containers thereof.

BACKGROUND

Manufacturers desire to maximize the pallet stability and/or shipping efficiency of product, including rolled good products, for both cost and environmental sustainability reasons while maintaining the desired product quality to the final user. It is also desirable for manufacturers to use pallets to support product to aid in transportation and warehousing of the product. It is additionally desirable to use standard size pallets readily available within the supply chain from the product manufacturer to their customers to reduce cost and complexity. It is additionally desirable for manufacturers of rolled goods products to be able to efficiently ship quality product in a very broad range of roll diameters and package sizes to meet the needs of customers and consumers. With any given size pallet, there are product package sizes which utilize high amounts of the available pallet area and those that utilize low amounts of the available pallet area. Additionally, with any given size pallet, there are package sizes that can result in higher amounts of product that fit into a truck and those that result in lower amounts of product in a truck. Therefore, to increase pallet stability and/or shipping efficiencies with any given pallet size the manufacturer is limited in the choices of product and package sizes it can offer to their customers.

Certain manufacturers, including consumer good manufacturers (including roll good manufacturers) have determined that product packages can be slightly larger than, or overhang, the pallet and maintain stability and product quality. Related to rolled goods (including paper towels and toilet paper), once the product overhangs more than approximately 1.5" to 2" in any dimension from the pallet, however, the product is insufficiently supported and product damage and pallet instability result. Like challenges exist for other consumer goods and/or their containers (e.g., empty detergent bottles, disposable floor cleaning refills, aerosol cans, etc.).

There are also challenges associated with stacking a second cargo assemblage on a first cargo assemblage when the first cargo assemblage is compromised (e.g., underhung and/or when the first cargo assemblage does not comprise the elements that give it the first cargo assemblage adequate stability).

A need, therefore, exists for an improvement in the ability to efficiently ship a broad range of product and package sizes while using any desired pallet size. As will be explained below, packages of products stacked on a pallet may be made more stable by, for instance, one or a combination of a support layer, including size, rigidity, composition, coefficient of friction of and/or disposition of a support layer, particular integration materials and/or configurations of integration material.

The discussion of shortcomings and needs existing in the field prior to the present invention is in no way an admission that such shortcomings and needs were recognized by those skilled in the art prior to the present disclosure.

BRIEF DESCRIPTION OF THE DRAWINGS

Many aspects of this disclosure can be better understood with reference to the following figures.

DETAILED DESCRIPTION

Introduction and Definitions

Figure 1A:
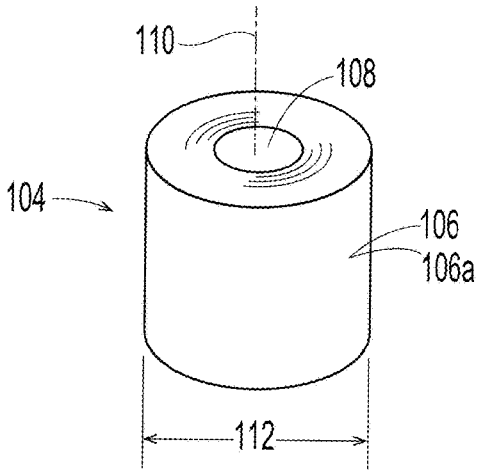
FIG. 1A is an example according to various embodiments, illustrating a simplified perspective view of an absorbent paper product.

This disclosure is written to describe the invention to a person having ordinary skill in the art, who will understand that this disclosure is not limited to the specific examples or embodiments described. The examples and embodiments are single instances of the invention which will make a much larger scope apparent to the person having ordinary skill in the art. Unless defined otherwise, all technical and scientific terms used herein have the same meaning as commonly understood by the person having ordinary skill in the art. It is also to be understood that the terminology used herein is for the purpose of describing examples and embodiments only, and is not intended to be limiting, since the scope of the present disclosure will be limited only by the appended claims.

All the features disclosed in this specification (including any accompanying claims, abstract, and drawings) may be replaced by alternative features serving the same, equivalent, or similar purpose, unless expressly stated otherwise. Thus, unless expressly stated otherwise, each feature disclosed is one example only of a generic series of equivalent or similar features. The examples and embodiments described herein are for illustrative purposes only and that various modifications or changes in light thereof will be suggested to the person having ordinary skill in the art and are to be included within the spirit and purview of this application. Many variations and modifications may be made to the embodiments of the disclosure without departing substantially from the spirit and principles of the disclosure. All such modifications and variations are intended to be included herein within the scope of this disclosure. For example, unless otherwise indicated, the present disclosure is not limited to particular materials, reagents, reaction materials, manufacturing processes, or the like, as such can vary. It is also to be understood that the terminology used herein is for purposes of describing particular embodiments only and is not intended to be limiting. It is also possible in the present disclosure that steps can be executed in different sequence where this is logically possible.

All numeric values are herein assumed to be modified by the term "about," whether or not explicitly indicated. The term "about" generally refers to a range of numbers that one of skill in the art would consider equivalent to the recited value (for example, having the same function or result). In many instances, the term "about" may include numbers that are rounded to the nearest significant figure.

In everyday usage, indefinite articles (like "a" or "an") precede countable nouns and noncountable nouns almost never take indefinite articles. It should be noted, therefore, that, as used in this specification and in the claims that follow, the singular forms "a," "an," and "the" include plural referents unless the context clearly dictates otherwise. Thus, for example, reference to "a support" includes a plurality of supports. Particularly when a single countable noun is listed as an element in a claim, this specification will generally use a phrase such as "a single." For example, "a single support."

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Absorbent Paper Products Generally

It is to be appreciated that while various embodiments are described with respect to absorbent paper products, containers, packages, and layers thereof, the present disclosure is not limited to absorbent paper products and that the teachings set forth herein may be applied to any type of product or cargo.

FIG. 1A is an example according to various embodiments, illustrating a simplified perspective view of an absorbent paper product 104. The absorbent paper product 104 may be configured as rolled paper product 106, rolled product, rolls of product, and/or rolls. In other words, a rolled paper product 106 may include one or more individual rolls 106*a*. "Rolled products" or "rolled paper products" or "rolls of product" or "rolls" within the present disclosure may include products made from cellulose fibers, nonwoven fibers, other suitable fibers, and combinations thereof. In some configurations, rolled products may be made of, or partially made of recycled fibers. Disposable rolled products or disposable rolled absorbent products or disposable rolled paper products may comprise paper towels, facial tissues, toilet tissues, shop towels, wipes, and the like, which may be made from one or more webs of fibers, such as cellulose fibers or nonwoven fibers, for example. Rolled paper products may comprises an absorbent towel substrate, a sanitary tissue substrate, a sanitary tissue product, or a cellulosic fiber containing substrate.

"Sanitary tissue product" as used herein means a wiping implement for post-urinary and/or post-bowel movement cleaning (referred to as "toilet paper," "toilet tissue," or "toilet tissue product"), for otorhinolaryngological discharges (referred to as "facial tissue" or "facial tissue product") and/or multi-functional absorbent and cleaning uses (referred to as "paper towels," "paper towel products," "absorbent towels," "absorbent towel products," such as paper towel or "wipe products," and including "napkins").

Still referring to FIG. 1A, each roll 106*a* of the rolled paper product 106 may be wound about a paper, cardboard, paperboard, or corrugate tube to form a core 108 through each roll 106*a*. Each core 108 may define a longitudinal axis 110 extending therethrough. In some configurations, the rolls 106*a* of rolled paper product 106 may not include the paper, cardboard, paperboard, or corrugate tube, but instead, the rolls of product may be wound about itself to form a roll while still forming a core defined through each roll. The void area in the center of each roll where the product winds about itself can be considered a "core" for purposes of this disclosure, although such rolls may be referred to as "coreless" rolls.

Roll Diameter

Still referring to FIG. 1A, it is to be appreciated that rolled paper products 106 may be provided in various sizes and may comprise various roll diameters 112, which may be measured according to the Roll Diameter Test Method described herein. For example, in some configurations, the roll diameter 112 of the rolled paper product 106 (e.g., a sanitary tissue product) may be from about 4 inches to about 8 inches, or from about 5 inches to about 8 inches, or from about 6 inches to about 8 inches, specifically reciting all 0.5-inch increments within the above-recited ranges and all ranges formed therein or thereby. In some configurations, the roll diameter 112 of the rolled paper product 106 may be from about 6 inches to about 14 inches, or from about 7 inches to about 14 inches, or from about 8 inches to about 14 inches, specifically reciting all 0.5-inch increments within the above-recited ranges and all ranges formed therein or thereby. Further, in some configurations, the roll diameter 112 of the rolled paper product 106 may be from about 8 inches to about 25 inches, or from about 9 inches to about 25 inches, or from about 10 inches to about 25 inches, specifically reciting all 0.5-inch increments within the above-recited ranges and all ranges formed therein or thereby. Further, in some configurations, the roll diameter 112 of the rolled paper product 106 (e.g., sanitary tissue product) may be about 7 inches or greater. In some configurations, the roll diameter 112 of the rolled paper product 106 may be about 7.5 inches or greater. In some configurations, the roll diameter 112 of the rolled paper product 106 may be about 8.0 inches or greater.

"Roll Diameter" Test Method

For this test, the actual rolled paper product roll is the test sample. Remove all the test rolled paper product rolls from any packaging and allow them to condition at about 23° C.±2 C.° and about 50%±2% relative humidity for 24 hours prior to testing. Rolls with cores that are crushed, bent or damaged should not be tested.

The diameter of the test rolled paper product roll is measured directly using a Pi® tape of appropriate length or equivalent precision diameter tape (e.g., an Executive Diameter tape available from Apex Tool Group, LLC, Apex, NC, Model No. W606PD) which converts the circumferential distance into a diameter measurement, so the roll diameter is directly read from the scale. The diameter tape is graduated to 0.01-inch increments. The tape is 0.25 inches wide and is made of flexible metal that conforms to the curvature of the test sanitary tissue product roll but is not elongated under the loading used for this test.

Loosely loop the diameter tape around the circumference of the test rolled paper product roll, placing the tape edges directly adjacent to each other with the surface of the tape lying flat against the test rolled paper product roll. Pull the tape snug against the circumference of the test rolled paper product roll, applying approximately 100 g of force. Wait 3 seconds. At the intersection of the diameter tape, read the diameter aligned with the zero mark of the diameter tape and record as the Roll Diameter to the nearest 0.01 inches. The outer radius of the rolled paper product roll is also calculated from this test method.

In like fashion analyze a total of ten (10) replicate sample rolled paper product rolls. Calculate the arithmetic mean of the 10 values and report the Roll Diameter to the nearest 0.01 inches.

Roll Density

Referring again to FIG. 1A, it is also to be appreciated that rolled paper products 106 may comprise various roll densities, which may be measured according to the Roll Density Test Method described herein. As will be discussed in greater detail hereinafter, determining the roll density may be import when determining the weight, pressure, or force that may be applied to one or more rolls to avoid crush or otherwise damaging the rolls. In some configurations, the rolled paper product 106 may comprise a roll density greater than or equal to about 0.03 g/cm$^3$ and less than or equal to about 0.32 g/cm$^3$, specifically reciting all 0.01 g/cm$^3$ increments within the above-recited ranges and all ranges formed therein or thereby. In some configurations, the rolled paper product 106 may comprise a roll density greater than or equal to about 0.05 g/cm$^3$ and less than or equal to about 0.20 g/cm$^3$, specifically reciting all 0.01 g/cm$^3$ increments within the above-recited ranges and all ranges formed therein or thereby.

Roll Density Test Method

For this test, the rolled paper product roll is the test sample. Remove all of the test rolled paper product rolls from any packaging and allow them to condition at about 23° C.±2 C.° and about 50%±2% relative humidity for 24 hours prior to testing. Rolls with cores that are crushed, bent or damaged should not be tested.

The Roll Density is calculated by dividing the mass of the roll by its volume using the following equation:

$$\text{Roll Density}\left(\frac{\text{g}}{\text{cm}^3}\right) = \frac{\text{Mass (g)}}{\text{Roll Width (cm)}\cdot\pi\left[\text{Outer Radius (cm)}^2 - \text{Inner Radius (cm)}^2\right]}$$

Figure 1B:
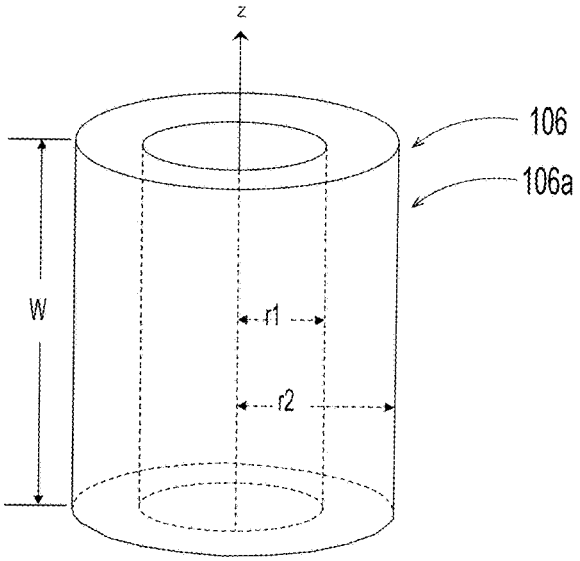
FIG. 1B is an example according to various embodiments, illustrating a schematic representation of a rolled paper product roll for use in measuring a rolled paper product roll's roll density as measured according to the Roll Density Test Method described herein.

FIG. 1B is an example according to various embodiments, illustrating a schematic representation of a rolled paper product roll for use in measuring a rolled paper product roll's Roll Density as measured according to the Roll Density Test Method described herein. FIG. 1B visually describes the measurement of a rolled paper product roll 106 where Z is the center axis of the roll, where the outer radius $r_2$ in units of cm is measured using the Roll Diameter Test Method described herein, the inner radius $r_1$ in units of cm is measured using a caliper tool inside the core, the roll width W is measured using a ruler or tape measure in units of cm and the mass in units of g is the weight of the entire roll including core.

In like fashion analyze a total of ten (10) replicate sample rolls. Calculate the arithmetic mean of the 10 values and report the Roll Density to the nearest 0.001 g/cm$^3$.

Various Package Configurations

Figure 1C:
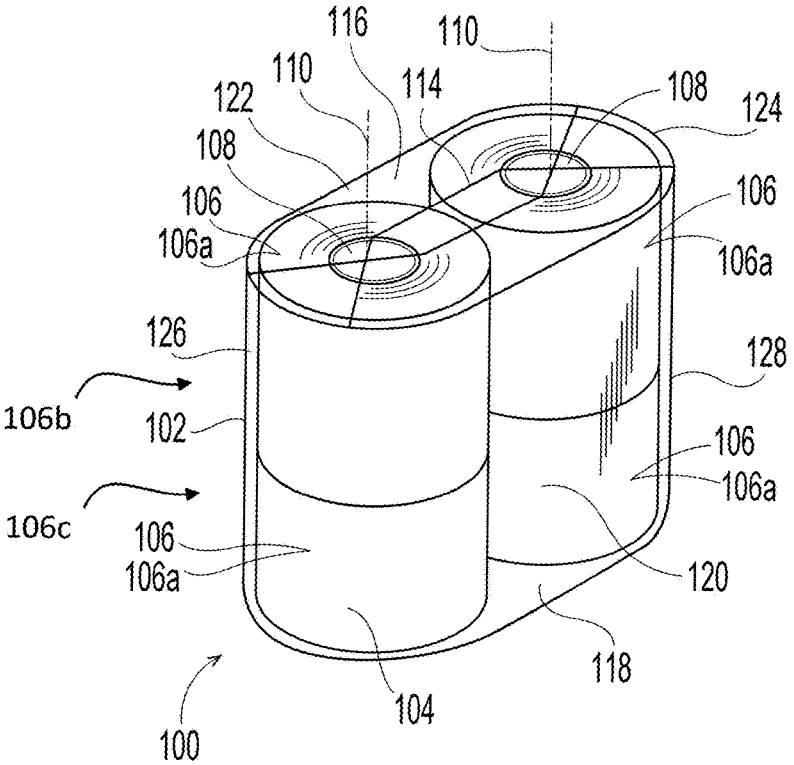
FIG. 1C is an example according to various embodiments, illustrating a simplified perspective view of a package including a container of absorbent paper product.

Rolled paper products, like most products or cargos, may be packaged together in various configurations, having different sizes and shapes. FIG. 1C is an example according to various embodiments, illustrating a simplified perspective view of a package 100 including a container 102 of absorbent paper product 104. The containers 102 that house the absorbent paper product 104 may be formed from various types of material and may be configured in various shapes and sizes. In some configurations, the containers 102 may be formed from a poly film material that may comprise polymeric films, polypropylene films, and/or polyethylene films. In some configurations, the containers 102 may be formed from cellulose, such as for example, in the form of paper and/or cardboard. The containers 102 may be flexible or rigid. The containers 102 may also be Knocked Down (KD) or Knocked Down Flat (KDF) type containers, which terms, as used herein, refer to containers that may be partially or completely disassembled for packing and shipping. The container 102 may have a preformed shape into which absorbent paper products 104 are inserted and/or may be formed by wrapping a material around one or more absorbent paper products 104 to define a shape that conforms with the shapes of individual products and/or arrangements of products. The container 102 may also include a seal 114, such as an envelope seal, for example, formed thereon. As shown in FIG. 1A, the container 102 may include a top side 116 and a bottom side 118. The container may also include a front panel 120 and a rear panel 122, wherein the front and rear panels 120, 122 are connected with and separated by opposing first and second sides 124, 126. The front panel 120, the rear panel 122, the first side 124, and/or the second side 126 may be substantially planar, curved, or convex as shown in FIG. 1C and may also define an outer surface 128 of the container 102.

It is to be appreciated that the packages 100 may include various quantities of absorbent paper products 104 that may be arranged in various orientations within the containers 102. Additionally, it is to be appreciated that a load 136 may include packages 100 having various sizes and that packages 100 of various sizes may be placed on the same pallet 138 or within the same cargo assemblage 132. For example, as shown in FIG. 1C, an individually wrapped package 100 may include four rolls of rolled paper product 106 inside a container 102, wherein two rolls 106*a* are stacked on or packaged adjacent to another two rolls 106*a*. The longitudinal axis 110 of each of the cores 108 of each stack of at least two rolls 106*a* may be generally parallel and aligned with each other and adjacent stack(s) of at least two rolls 106*a* can lie in generally the same plane as the other stack(s) of at least two rolled paper products 106. In other words, a group of rolled paper products, such as the individually wrapped package 100 may comprise a plurality of sanitary tissue product layers, including, for example, a first sanitary tissue product layer 106*b* and a second sanitary tissue product layer 106*c*. Each of sanitary tissue product layers 106*b*, 106*c* may include a plurality of rolled paper products 106 in the same general plane. The first sanitary tissue product layer 106*b* may be stacked on top of the second sanitary tissue product layer 106*c*.

Figure 1D:
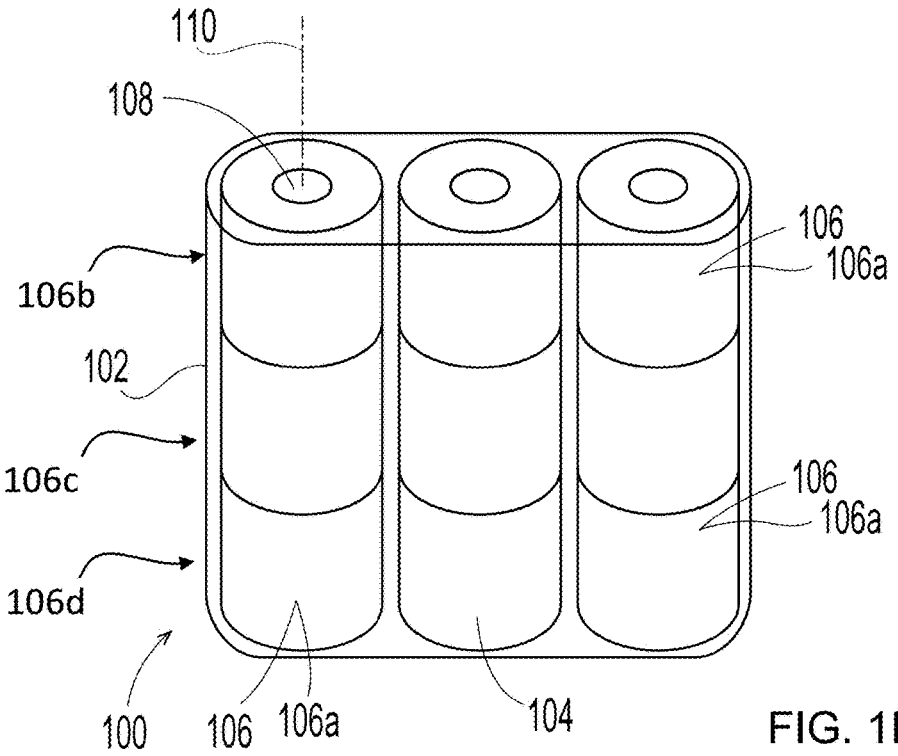
FIG. 1D is an example according to various embodiments, illustrating a simplified perspective view of a second package including a container of absorbent paper product.

FIG. 1D is an example according to various embodiments, illustrating a simplified perspective view of a second package 100 including a container 102 of absorbent paper product 104. As shown in FIG. 1D, an individually wrapped package 100 may include nine rolls 106*a* of rolled paper product 106 arranged in stacks inside the container 102. It is to be appreciated that multiple rolls 106*a* of rolled paper product 106 can be enclosed in a container 102 constructed from a polymer film or other suitable material that may be sealed to form individually wrapped packages 100. Again, a group of rolled paper products, such as the individually wrapped package 100 may comprise a plurality of sanitary tissue product layers, including, for example, a first sanitary tissue product layer 106*b*, a second sanitary tissue product layer 106*c*, and a third sanitary tissue product layer 106*d*. Each of sanitary tissue product layers 106*b*, 106*c*, 106*d* may include a plurality of rolled paper products 106. The first sanitary tissue product layer 106*b* may be stacked on top of the second sanitary tissue product layer 106*c*, and the second sanitary tissue product may be stacked on top of the third sanitary tissue product layer 106*d*.

Figure 1E:
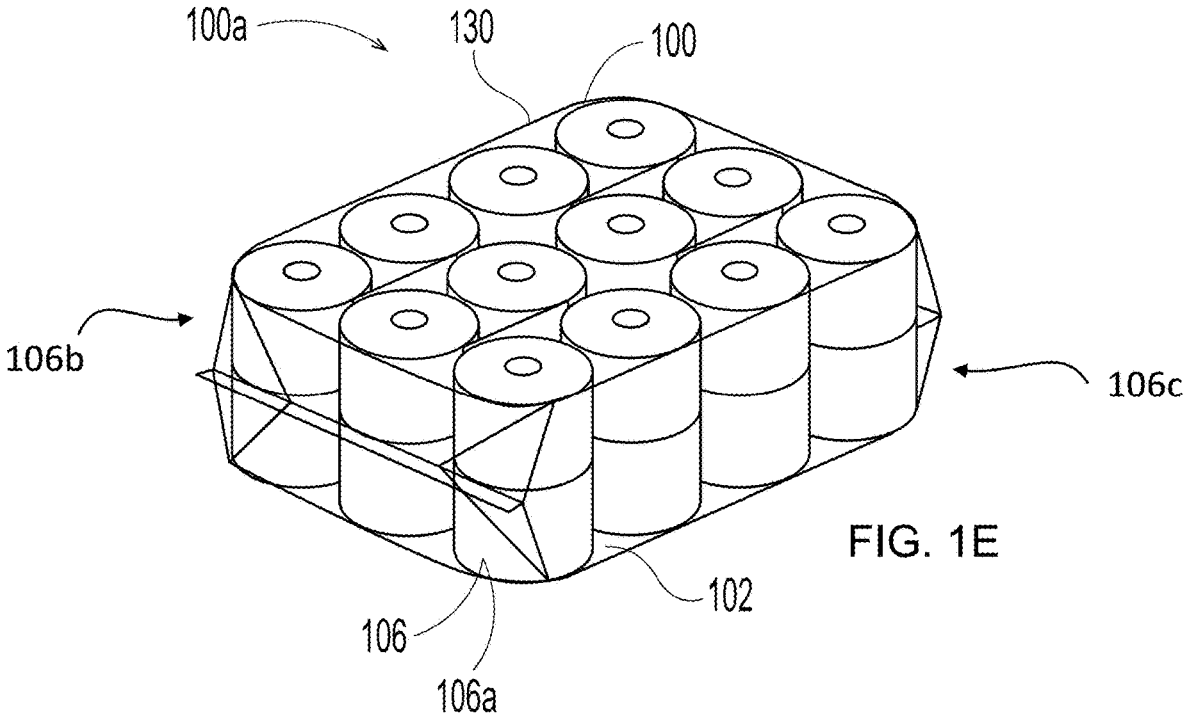
FIG. 1E is an example according to various embodiments, illustrating a simplified perspective view of a large count package including individually wrapped packages of absorbent paper product.

FIG. 1E is an example according to various embodiments, illustrating a simplified perspective view of a large count package 100*a* including individually wrapped packages 100 of absorbent paper product 104. As shown in FIG. 1E, individually wrapped packages 100 of the two or more rolls 106*a*, or stacks of rolls 106*a*, may be bundled and/or bound together within an overwrap 130 forming a container 102 to define a large count package 100*a*. In some configurations, large count packages 100*a* may contain a plurality of "naked," (i.e., unwrapped) rolls 106*a* of rolled paper product 106. In some configurations, the individually wrapped packages or naked rolls may be stacked or positioned together into a generally cuboid-shaped container 102, such as disclosed in U.S. Patent Publication No. 2012/0205272 A1, which is incorporated by reference herein. It is to be appreciated that packages 100 can each comprise one or more rolls 106*a* of rolled paper product 106, such as for example, two, three, four, six, eight, nine, ten, twelve, or fifteen rolls of rolled paper product.

Inefficient Tessellation of Packages on Pallets

As used herein, the term "tessellate" has its usual meaning, i.e. to cover (a surface) with a pattern of repeated shapes that fit together closely without gaps or overlapping. An inefficient tessellation, therefore, refers to a set of repeated shapes that are sized in a way that prevents or hinders their arrangement to cover a surface without gaps or overlapping. In the context of various embodiments, the repeated shapes may be the footprint or cross-section of a package of absorbent paper products and the surface to be covered may be the top surface of any object on which the packages are to be arranged, such as the top surface of a pallet.

As already discussed, a wide variety of container shapes and sizes are possible. Similarly, pallets of various types and/or sizes may be used. Some pallets may be designed to be moved by forklifts and may be rectangular-shaped. Some pallets may be configured as standard pallets of a type specified by the Grocery Manufacturers Association (GMA) and/or provided by CHEP Equipment Pooling Systems, Orlando, Fla. In some configurations, pallets may be configured with rectangularly shaped decks having a length of 48 inches and a width of 40 inches. It has been discovered that variations of container shapes and/or pallet sizes as well as a general mismatch between container and pallet geometries often leads to inefficient tessellation of containers on pallets, wasting valuable space, reducing efficiencies, and increasing shipping costs. Similarly, inefficient tessellation of cargo assemblages within a truck may waste valuable space, reduce, efficiencies, and increase shipping costs.

The boards of the pallet that form the pallet deck may be extended past the base of the pallet, in the X and/or Y direction(s); for instance, at least one, two, three, or four sides of a pallet deck may expand about 2, about 3, about 4, about 5, about 6, about 7, about 8, about 9, or about 10 inches past the deck. This may allow for certain efficiencies that enable pallets comprising a greater amount of product, but may be inefficient in that it may result in a custom pallet.

Instead of extending the boards that form the deck of the pallet, the pallet may remain a standard size or may have a simplified deck (e.g., thinner, weaker, or fewer deck boards than is standard for the goods being shipped) or the pallet may be made without a deck, such that the pallet merely supports one or more support layers that support a load instead of deck boards. In such an embodiment, the support layers may be non-destructively separable from the pallet base.

Figure 2A:
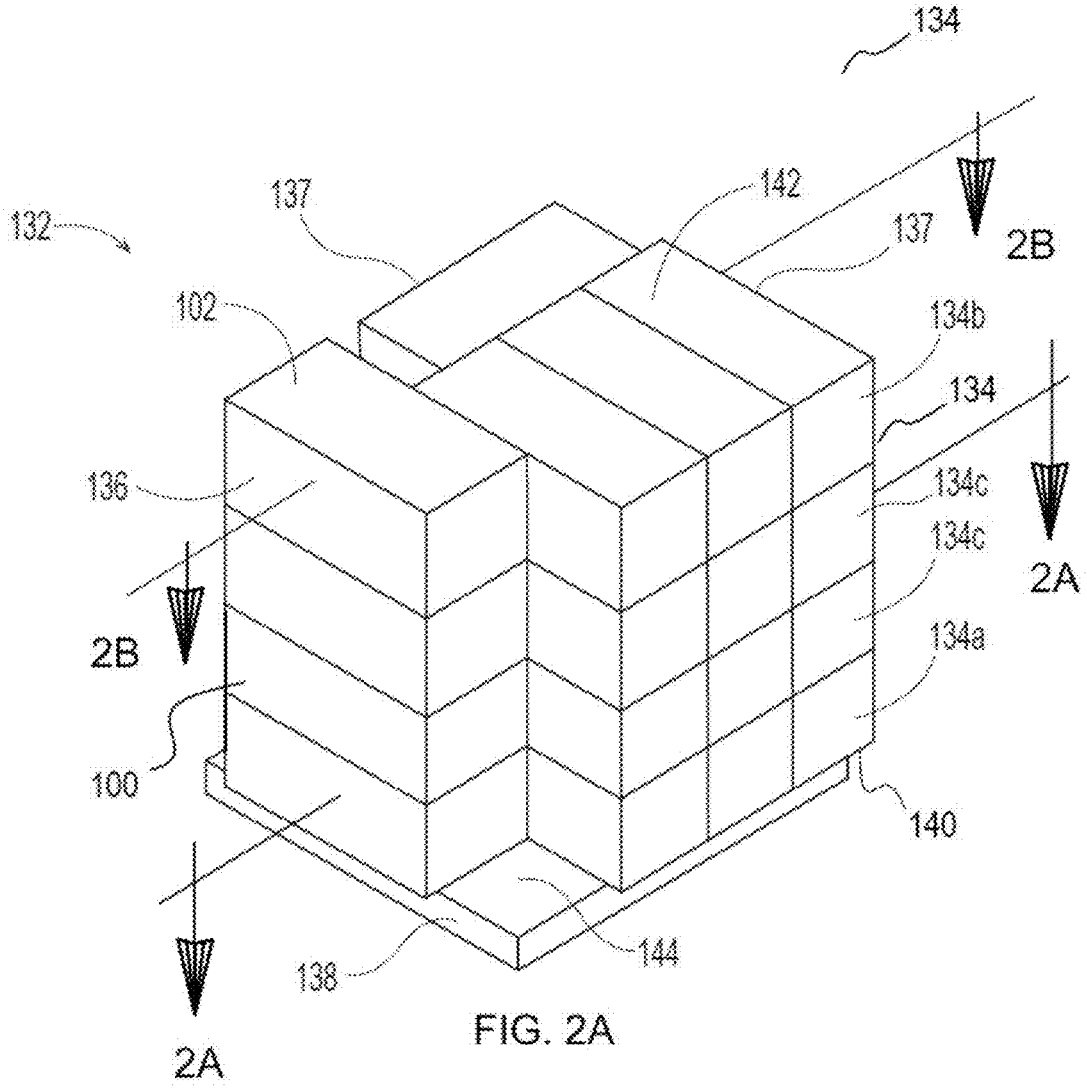
FIG. 2A is an example according to various embodiments, illustrating a perspective view of a cargo assemblage comprising a load arranged on a pallet, wherein the load is defined by stacked layers of packages sized to inefficiently tessellate to a support deck of the pallet.

FIG. 2A is an example according to various embodiments, illustrating a perspective view of a cargo assemblage 132 comprising a load 136 arranged on a pallet 138. The load 136 is defined by stacked layers 134 of packages 100. The packages 100 may include any type of product or cargo, but for purposes of this example may comprise containers 102 of rolled paper products 106. In some configurations, a layer 134 includes rolled sanitary tissue products having an average diameter of about 7 inches or greater. In some configurations, a layer 134 includes rolled sanitary tissue products having an average diameter of about 7.5 inches or greater. In some configurations, a layer 134 includes rolled sanitary tissue products having an average diameter of about 8.0 inches or greater.

In some configurations, the layer 134 includes rolled sanitary tissue products having less than about 48 cores. In some configurations, the layer 134 includes rolled sanitary tissue products having less than about 42 cores. In some configurations, the layer 134 includes rolled sanitary tissue products having less than about 40 cores. In some configurations, the layer 134 includes rolled sanitary tissue products having less than about 35 cores. In some configurations, the layer 134 includes rolled sanitary tissue products having less than about 30 cores.

The packages 100 inefficiently tessellate to a support deck 144 of the pallet 138. As used herein, the support deck 144 refers simply to the materials, such as one or more boards, that form the top surface of a pallet 138. Each layer 134 of the load 136 may include various numbers of packages 100 comprising containers 102 of absorbent paper product 104 arranged in various configurations. Although the packages 100 of absorbent paper product 104 are sometimes illustrated herein as having containers 102 with a generically cuboid shape, it is to be appreciated that the packages 100 illustrated in the accompanying figures may have various sizes and shapes as described herein. It is also to be appreciated that the load 136 may also include various numbers of layers 134 of packages 100 comprising containers 102 of absorbent paper product 104. In some configurations, the load 136 may include a bottom layer 134*a* of packages 100 and a top layer 134*b* of packages 100. In some configurations, the load 136 may include one or more intermediate layers 134*c* of packages 100 positioned between the top layer 134*b* of packages 100 and the bottom layer 134*a* of packages 100. The load 136 may include a top surface 142 defined by the top layer 134*b* of packages 100. As such, the load 136 may define one or more sides 137 that extend upward from the bottom surface 140 to the top surface 142. Furthermore, the load 136 may include a bottom surface 140 defined by the bottom layer 134*a* of packages 100. In addition, a footprint of the load 136 may be square, non-square, or non-rectangular.

Figure 2B:
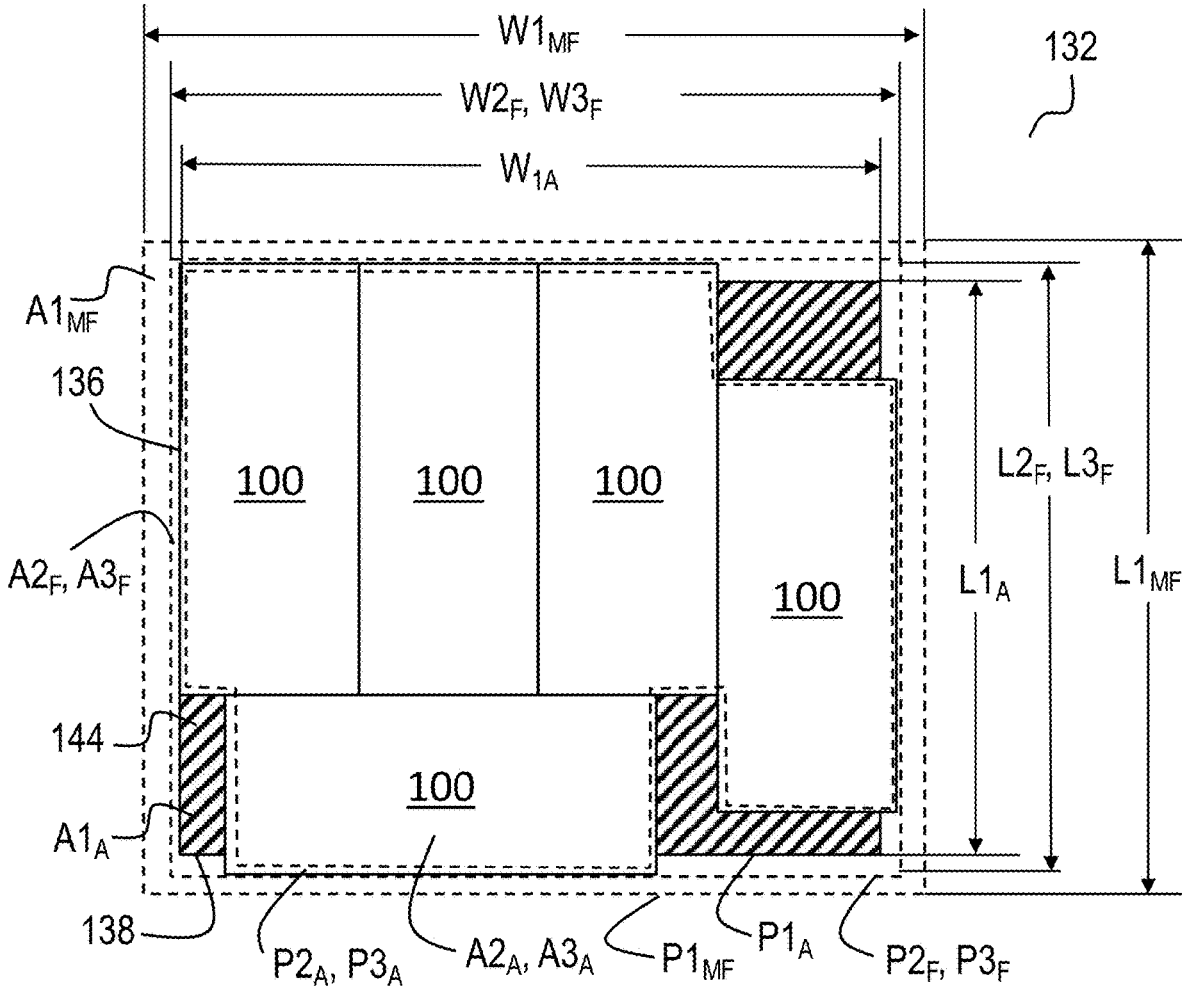
FIG. 2B is an example according to various embodiments, illustrating a sectional view of the load and the pallet from FIG. 2A taken along either line 2A-2A or along line 2B-2B.

FIG. 2B is an example according to various embodiments, illustrating a sectional view of any layer of the load 136 and the pallet 138 from FIG. 2A, for example a sectional view along line 2A-2A or along line 2B-2B. The section view along either line 2A-2A or along line 2B-2B is the same because the packages 100 are stacked uniformly and a duplicate figure is omitted as unnecessary. It is to be appreciated, of course, that the packages 100 need not be stacked uniformly and that the section views and perimeters illustrated here are only exemplary. It is also to be appreciated that similar section views may be taken through any layer of the load 136. Furthermore, the load 136 may be arranged such that the bottom surface 140 of the load 136 is positioned on the pallet 138 in an overhung arrangement, as illustrated. It is to be appreciated, however, that the bottom surface 140 of the load 136 may also be positioned on the pallet 138 in a partially overhung, an underhung, or a partially underhung arrangement. It is to be appreciated that the support deck 144 may be configured in various ways, such as for example, a contiguous surface or a discontinuous surface defined by an arrangement of spaced apart slats.

Types of Perimeters

As used herein, the term "actual perimeter" refers to a boundary tracing the outer edge of a layer or a surface or an object, such as a pallet. An actual perimeter need not be rectangular and may have an asymmetrical shape. When any perimeter is a square or a rectangle, it may be referred to as a "symmetrical perimeter" or as "symmetrical." When any perimeter is other than a square or a rectangle, it may be referred to as an "asymmetrical perimeter" or as "asymmetrical." In general, asymmetrical perimeters may be caused by a pallet that consists of rolled paper products having a large diameter, such as a pallet consisting only of toilet paper rolls having a roll diameter of 5.9 inches or greater (e.g., 6, 7, 8, 9, 10, 11, or 12 inches), or consisting only of paper towel rolls having roll diameters of 6.7 inches or greater (e.g., 7, 8, 9, 10, 11, 12, 13, 14, 15, or 16 inches). Asymmetrical perimeters may also be caused by a pallet that comprises two different roll diameters or may be caused by a pallet that comprises three different roll diameters, or may be caused by a pallet that comprises four different roll diameters. Asymmetrical perimeters may also be caused by a pallet that comprises two different rolled paper products, such as a pallet that comprises toilet paper rolls and paper towel rolls on the same pallet.

A "layer perimeter" is an example of an "actual perimeter" and refers to a boundary tracing an outer edge of a layer, such as a layer comprising one or more packages. The layer may be part of a load, which may be part of a cargo assembly. A "pallet perimeter" is an example of an "actual perimeter" and refers to a boundary tracing an outer edge of a pallet or a top surface or a support deck of a pallet. The pallet may be part of a cargo assembly.

As used herein, the term "functional perimeter" refers to a rectangular boundary defined by or circumscribing an actual perimeter of a layer, such as a layer comprising one or more packages. The layer may be part of a load, which may be part of a cargo assembly. A "maximum functional perimeter" refers to the largest functional perimeter that a layer may occupy within a cargo assembly without becoming unstable or causing damage to the package(s) of the layer or the contents thereof. The maximum functional perimeter of a layer may be greater than, less than, or equal to an actual perimeter of an object or layer that the layer is stacked upon. For example, when a layer overhangs a pallet, support layer, or underlying layer by a maximum extent, beyond which damage or instability would occur, the layer is circumscribed by a rectangular boundary constituting its maximum functional perimeter. Similarly, the maximum functional perimeter of a layer may be greater than, less than, or equal to the actual perimeter of an object or layer that is stacked upon the layer. For example, when a top layer such as a supporting layer or a pallet or another layer of packages is positioned on top of a layer to enable the layer to have an actual perimeter, which, if exceeded would result in damage or instability, then the layer is circumscribed by a rectangular boundary constituting its maximum functional perimeter. It is to be appreciated, therefore, that the maximum functional perimeter of a layer may depend upon interaction with other layers or objects within a cargo assemblage. Interactions between those layers or objects and the layer or structures within the layer, such as cores of rolled products, may form vertical structures to support and to protect the layer and the contents thereof.

As shown in FIG. 2B, the pallet 138 may have a first actual perimeter $P1_A$. The pallet 138 may have a first actual width $W1_A$ and a first actual length $L1_A$, which may have the same or different magnitudes. The pallet 138 or the support deck 144 of the pallet 138 may have a first actual area $A1_A$. The first actual area $A1_A$ may be circumscribed by the first actual perimeter $P1_A$ and may have a magnitude equal to or approximated by the product of the magnitudes of the first actual width $W1_A$ and the first actual length $L1_A$. Any layer of a load stacked on the pallet 138 may have a first maximum functional perimeter $P1_{MF}$ when supported on the pallet 138. The first maximum functional perimeter $P1_{MF}$ of a layer stacked on the pallet 138 may have a first maximum width $W1_{MF}$ and a first maximum length $L1_{MF}$, which may have the same or different magnitudes. The first maximum functional perimeter $P1_{MF}$ may circumscribe a first maximum functional area $A1_{MF}$, which may have a magnitude equal to or approximated by the product of the magnitudes of the first maximum width $W1_{MF}$ and the first maximum length $L1_{MF}$. The size of the first maximum functional perimeter $P1_{MF}$, its first maximum width $W1_{MF}$, its first maximum length $L1_{MF}$, and the first maximum functional area $A1_{MF}$ circumscribed by the first maximum functional perimeter $P1_{Mf}$ may vary depending on the contents of the layer.

When FIG. 2B represents a section view taken along line 2A-2A of FIG. 2A, the bottom surface 140 of the bottom layer 134*a* of the load 136 may have a second actual perimeter $P2_A$, the general shape, but not the precise size, of which is represented by a dotted line. The bottom surface 140 may have a second actual area $A2_A$, representing the area that is occupied by the bottom surface 140 and that is circumscribed by the second actual perimeter $P2_A$. The bottom surface 140 may also have a second functional perimeter $P2_F$. The second functional perimeter $P2_F$ may, but need not, be a maximum functional perimeter, meaning that the packages need not always be positioned at the largest functional perimeter that the layer may occupy within the cargo assembly without becoming unstable or causing damage to the package(s) of the layer or the contents thereof. The second functional perimeter $P2_F$ may have a second functional width $W2_F$ and a second functional length $L2_F$, which may have the same or different magnitudes. The second functional perimeter $P2_F$ may circumscribe a second functional area $A2_F$, the magnitude of which may be the product of the second functional width $W2_F$ and the second functional length $L2_F$. As can be seen, although the bottom layer 134*a* includes a maximum number of packages 100 that may be supported on the pallet 138, the second actual area $A2_A$ is less than both the first maximum functional area $A1_{MF}$ and the second functional area $A2_F$, indicating that an inefficient tessellation of packages has been achieved, wasting valuable space.

It is to be understood that the section view taken along line 2A-2A of FIG. 2A is only one example and that similar areas, perimeters, lengths, and widths may be identified for any layer of the load. For example, when FIG. 2B represents a section view taken along line 2B-2B of FIG. 2A, the top surface 142 of the top layer 134*b* of the load 136 may have a third actual perimeter $P3_A$, the general shape, but not the precise size, of which is represented by a dotted line. The top surface 142 may have a third actual area $A3_A$, representing the area that is occupied by the top surface 142 and that is circumscribed by the third actual perimeter $P2_3$. The top surface 142 may also have a third functional perimeter $P3_F$. The third functional perimeter $P3_F$ may, but need not, be a maximum functional perimeter, meaning that the packages need not always be positioned at the largest functional perimeter that the layer may occupy within the cargo assembly without becoming unstable or causing damage to the package(s) of the layer or the contents thereof. The third functional perimeter $P3_F$ may have a third functional width $W3_F$ and a third functional length $L3_F$, which may have the same or different magnitudes. The third functional perimeter $P3_F$ may circumscribe a third functional area $A3_F$, the magnitude of which may be the product of the third functional width $W3_F$ and the third functional length $L3_F$. As can be seen, although the top layer 134*b* includes a maximum number of packages that may be supported, the third actual area $A3_A$ is less than both the first maximum functional area $A1_{MF}$ and the third functional area $A3_F$, indicating that an inefficient tessellation of packages has been achieved, wasting valuable space.

Increasing Functional Perimeters with a Support Layer

Figure 3:
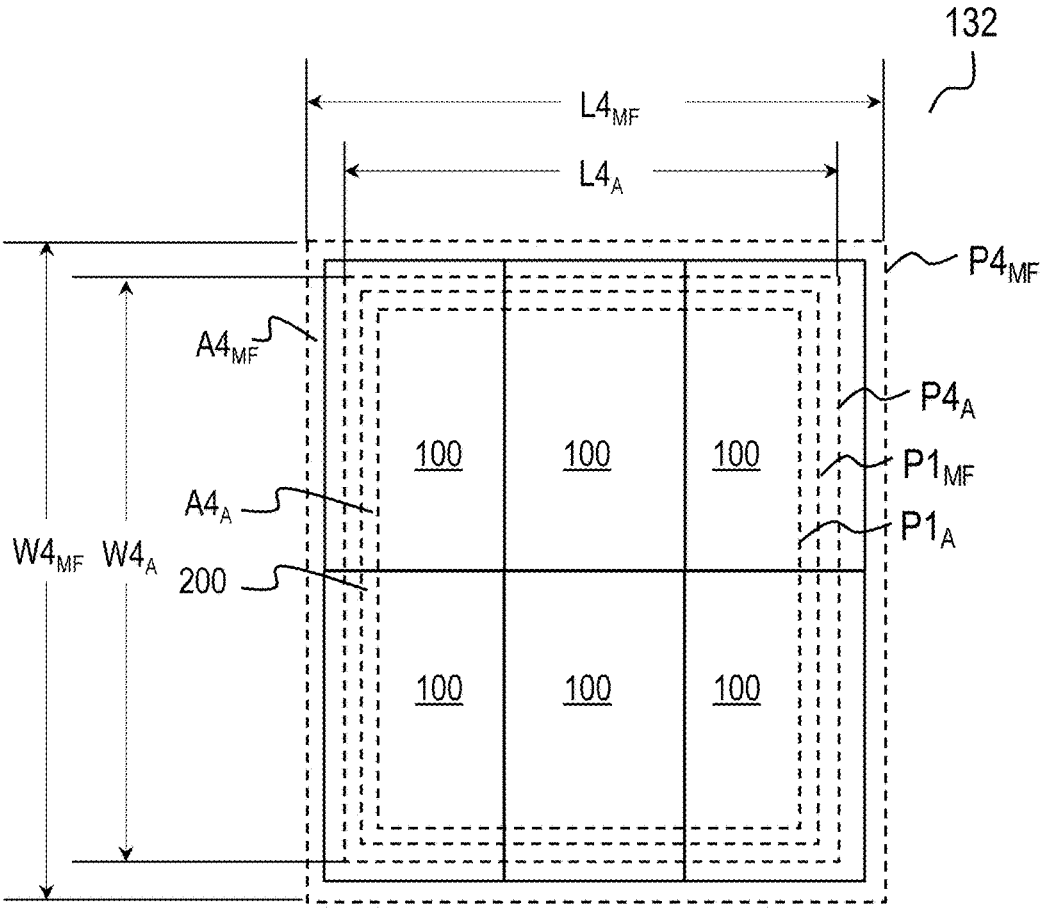
FIG. 3 is an example according to various embodiments, illustrating a schematic top view of a cargo assemblage including a support layer and a plurality of efficiently tessellated packages.

FIG. 3 is an example according to various embodiments, illustrating a schematic top view of a cargo assemblage 132 including a support layer 200. The packages 100 in the cargo assemblage may have the same size and shape as the packages 100 in the cargo assemblage shown in FIGS. 2A and 2B, however, the support layer 200 allows for a more efficient tessellation of the packages 100, resulting in an extra package per layer. The support layer 200 may be included at any position in the cargo assemblage 132. For example, the support layer 200 may be positioned between the pallet 138 and the bottom layer 134*a* of packages 100. Similarly, the support layer 200 may be positioned between any of the layers 134 or on top of the top layer 134*b*. In some embodiments, support layers 200 may be positioned between each of the layers 134. Further, in some embodiments, multiple support layers 200 may be positioned between one or more layers 134. When multiple support layers 200 are used with a load, the support layers may each be different sizes.

The support layer 200 may define a fourth actual perimeter $P4_A$, having a fourth actual width $W4_A$, a fourth actual length $L4_A$, which may have the same or different magnitudes. The fourth actual perimeter $P4_A$ may circumscribe a fourth actual area $A4_A$, having a magnitude equal to the product of the magnitudes of the fourth actual width $W4_A$ and the fourth actual length $L4_A$. Any layer of a load stacked on or beneath the support layer 200 may have a fourth maximum functional perimeter $P4_{MF}$ due to the support provided by the support layer 200. The fourth maximum functional perimeter $P4_{MF}$ may have a fourth maximum width $W4_{MF}$ and a fourth maximum length $L4_{MF}$, which may have the same or different magnitudes. The fourth maximum functional perimeter $P4_{MF}$ may circumscribe a fourth maximum functional area $A4_{MF}$, having a magnitude equal to the product of the magnitudes of the fourth maximum width $W4_{MF}$ and the fourth maximum length $L4_{MF}$.

The support layer 200 may be sized to allow for a more efficient tessellation of the packages 100 on its surface compared to the tessellation that would be possible on the support deck 144 of the pallet 138 or on any layer 134 of the cargo assemblage. In some cases, a more efficient tessellation requires one or more of the fourth actual width $W4_A$, the fourth actual length $L4_A$, and/or the fourth actual area $A4_A$ to be greater than the width, length, or area of another component in the cargo assemblage 132. For example, a more efficient tessellation may require the fourth actual width $W4_A$, the fourth actual length $L4_A$, and/or the fourth actual area $A4_A$ to be greater than the first actual width $W_{PA}$, the first actual length $L_{PA}$, and/or the first actual area $A1_A$. In which case, the support layer 200 would overhang the support deck 144 of the pallet 138. As will be discussed in greater detail hereinafter, an overhanging support layer 200 may have a rigidity sufficient to support the layers 134 stacked upon it. In other cases, a more efficient tessellation may be achieved even though the fourth actual width $W4_A$, the fourth actual length $L4_A$, and/or the fourth actual area $A4_A$ are less than or equal to the width, length, or area of another component in the cargo assemblage 132. For example, when a support layer 200 is placed on top of the top layer 134*b* or between any of the layers 134, a more efficient tessellation may be achieved even when the fourth actual width $W4_A$, the fourth actual length $L4_A$, and/or the fourth actual area $A4_A$ are less than the first actual width $W_{PA}$, the first actual length $L_{PA}$, and/or the first actual area $A1_A$, particularly when an integration material is employed to wrap the cargo assemblage.

It is to be understood that the perimeter of the product may be more or less than the perimeter of the support layer. The boundary of the layer of packages may stop at or extend beyond an outer edge of the support layer or can be recessed from the outer edge of the support layer. Additionally, the product layer can both extend beyond the outer edge of the support layer in some areas while be recessed from the outer edge of the support layer in other areas.

The support layer may be characterized by a variety of parameters. Some exemplary parameters are shown in Table 1. One parameter of the support layer may be strength, in particular, a 3 point bending strength as determined by the Support Layer 3 Point Bend Test Method described hereinafter.

Regarding Table 1, each of Samples 1-10 are fluted, corrugated cardboard. The support layer samples (1-10) of Table 1 were tested according to the Support Layer 3 Point Bend Test Method described herein. In Table 1, "long" means that the flutes run in the longer length direction of the 5"×15" sample, and "short" means that the flutes run in the shorter length direction of the 5"×15" sample. "LSL" means the first and third layers of the support layer are "long" and the second (middle) layer is "short." "SLS" means the first and third layers of the support layer are "short" and the second (middle) layer is "long." "LSLS" means the first and third (middle) layers of the support layer are "long" and the second (middle) and fourth layers of the support layer are "short." "SLSL" means the first and third (middle) layers of the support layer are "short" and the second (middle) and fourth layers of the support layer are "long." "LSLSL" means the first, third (middle), and fifth layers of the support layer are "long" and the second (middle) and fourth (middle) layers of the support layer are "short." "SLSLS" means the first, third (middle), and fifth layers of the support layer are "short" and the second (middle) and fourth (middle) layers of the support layer are "long."

Support layers of the present disclosure may have the properties disclosed by the samples of Table 1. Further, support layers of the present disclosure may have a Support Layer 3 Point Bend Peak Force value of from about 5(N) to about 400(N), from about 10(N) to about 350(N), from about 20(N) to about 325(N), from about 30(N) to about 300(N), from about 50(N) to about 250(N), from about 75(N) to about 200(N), from about 100(N) to about 175(N), or from about 125(N) to about 150(N), specifically reciting all 1(N) increments within the above-recited ranges and all ranges formed therein or thereby. Further, support layers of the present disclosure may have a Support Layer 3 Point Bend Peak Force values greater than about 400(N).

Support layers of the present disclosure may have a Support Layer 3 Point Bend Force at Yield value of from about 4(N) to about 400(N), from about 10(N) to about 350(N), from about 20(N) to about 325(N), from about 30(N) to about 300(N), from about 50(N) to about 250(N), from about 75(N) to about 200(N), from about 100(N) to about 175(N), or from about 125(N) to about 150(N), specifically reciting all 1(N) increments within the above-recited ranges and all ranges formed therein or thereby. Further, support layers of the present disclosure may have a Support Layer 3 Point Bend Force at Yield values greater than about 400(N).

Those having skill in the art will appreciate that multi-layer, laminate, corrugated cardboard may be achieved by stacking single and/or double wall boards together or they may be manufactured with liners therebetween. When stacking single and/or double wall boards, the boards may be bonded together (e.g., via adhesive). In a non-limiting example, it may be desirable to use the support layers of Table 1, such as Samples 1-4, as support layer 200*c* in FIG. 6D or other configurations where the support layer contacts a top surface of a load, making that load more stable for stacking a second cargo assemblage. Further, in another non-limiting example, it may be desirable to use support layers of Table 1, such as Samples 5-10, as support layer 200*a* and or 200*b* in FIG. 6D or other configurations where the support layer is used to support one or more layers of a load.

TABLE 1

| Support Layer Sample No. | Board Description | Board Thickness (in) | Board Mass (grams) | Peak Load (N) | Yield Load (N) |
|---|---|---|---|---|---|
| 1 | Single Wall C-flute, Long | 0.16 | 19.7 | 14.3 | 8.5 |
| 2 | Single Wall C-flute, Short | 0.16 | 19.6 | 5.5 | 4.5 |
| 3 | Double Wall, Long C/B | 0.27 | 36.4 | 44.4 | 36.6 |
| 4 | Double Wall, Short C/B | 0.27 | 36.5 | 22.2 | 19.4 |
| 5 | 3 Laminated Dbl Wall, LSL | 0.75 | 95.4 | 169.3 | 164.7 |
| 6 | 3 Laminated Dbl Wall, SLS | 0.75 | 95.6 | 124.0 | 122.5 |
| 7 | 4 Laminated Dbl Wall, LSLS | 1 | 129.6 | 275.2 | 271.6 |
| 8 | 4 Laminated Dbl Wall, SLSL | 1 | 129.8 | 213.2 | 208.6 |
| 9 | 5 Laminated Dbl Wall, LSLSL | 1.25 | 158.3 | 345.4 | 343.1 |
| 10 | 5 Laminated Dbl Wall, SLSLS | 1.25 | 158.9 | 296.2 | 288.1 |

Support Layer 3 Point Bend Test Method

Figure 21A:
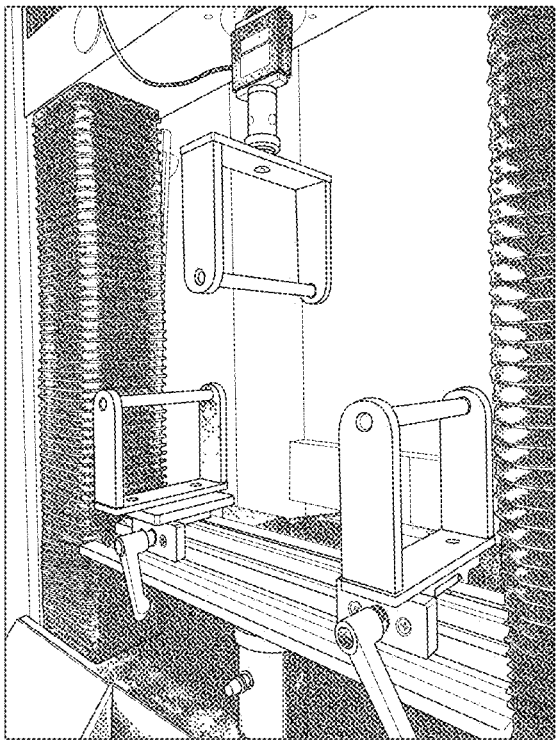
FIG. 21A is an example according to various embodiments, illustrating a photograph of a constant rate of extension tensile tester for performing the Support Layer 3 Point Bend Test Method described herein.
Figure 21B:
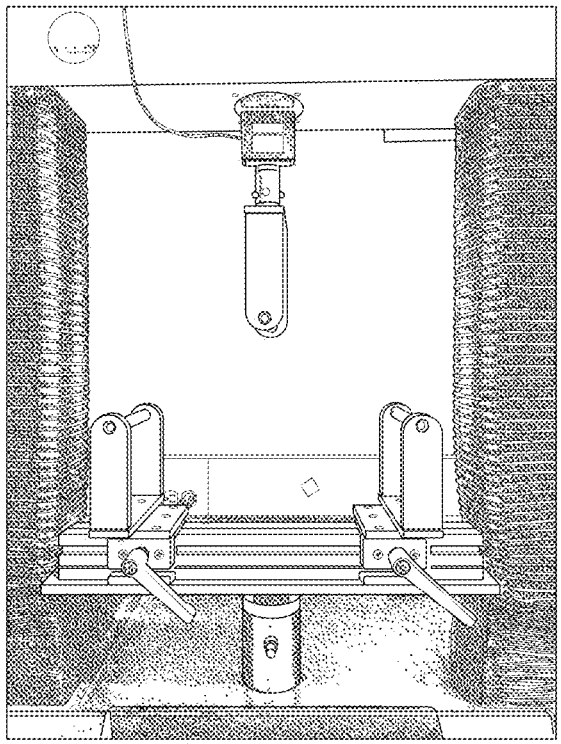
FIG. 21B is an example according to various embodiments, illustrating a photograph of the constant rate of extension tensile tester shown in FIG. 21A.
Figure 21C:
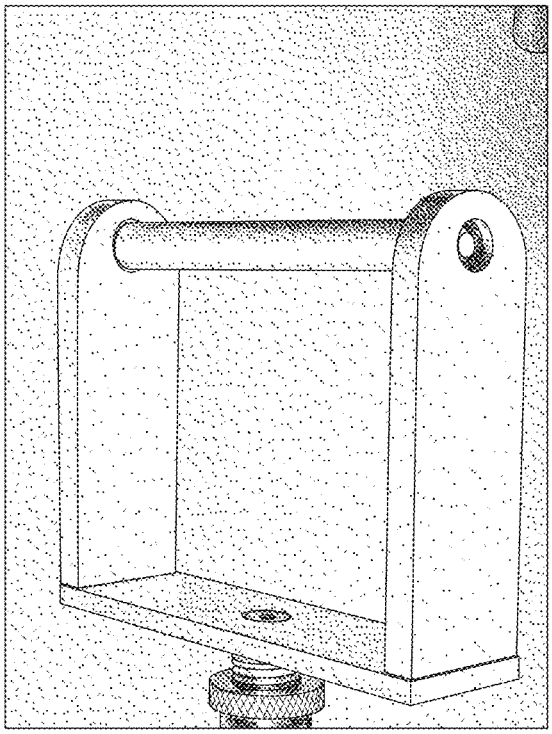
FIG. 21C is an example according to various embodiments, illustrating a component of the constant rate of extension tensile tester shown in FIG. 21A, specifically a movable (upper) crosshead that is rigidly fitted with a single 0.50" diameter×5" long cylinder.
Figure 21D:
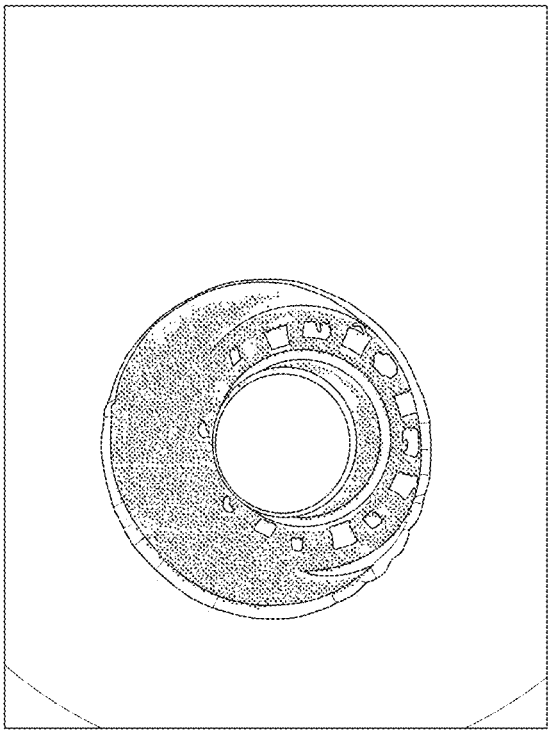
FIG. 21D is an example according to various embodiments, illustrating a photograph of a component of the movable (upper) crosshead shown in FIG. 21C, specifically bearings upon which the cylinder of the moveable crosshead and two stationary cylinders are mounted. It should be understood that the various embodiments are not limited to the examples illustrated in the figures.

The Support Layer 3 Point Bend Test is executed on a constant rate of extension tensile tester (a suitable instrument is the MTS Alliance or Criterion using Testworks 4.0 or Testsuite TWe Software, as available from MTS Systems Corp., Eden Prairie, MN), as illustrated in FIG. 21A and FIG. 21B, using a load cell for which the forces measured are within 10% to 90% of the limit of the cell. The movable (upper) crosshead is rigidly fitted with a single 0.50" diameter×5" long cylinder, as illustrated in FIG. 21C, mounted on bearings, as illustrated in FIG. 21D, to reduce friction and to allow the material to move as it accommodates the forces of the test. The stationary (lower) mount of the constant rate of extension tensile tester is fitted with a 2-point testing rig that also incorporates (2) 0.50" diameter×5" long cylinders also mounted on bearings, 12 inches apart and centered on the upper cylinder. All testing is performed in a room controlled at 23° C.±3 C.° and 50%±2% relative humidity.

Samples of a test material to be tested are conditioned at 23° C.±2 C.° and 50° C.±2% C.° relative humidity for at least two hours before testing, or until moisture content of the material has reached equilibrium. A sample is prepared for testing by cutting a 5"×15" rectangular test sample from the material in the correct orientation to be tested, using a cutting die, razor knife or other appropriate means. If the material bending properties are isotropic throughout the material, the 5"×15" rectangular sample can be cut from any part of the material to be tested. If the material is anisotropic, however, cut the material in an orientation that generates greatest 3 Point Bend force in the test. A total of three test samples of the material are prepared for testing.

Program the tensile tester for a compression test collecting force (N) and extension (mm) data at 50 Hz with the crosshead moving at speed of 3.0 mm/s during testing until the sample is buckled and the graph shows that the sample has yielded. Yield here, is defined as the zero slope point of the curve where the force from the test has reached a maximum and thereafter, decays. Lay the sample on the two lower test rollers, centered beneath the upper test roller. The upper test roller should be placed just above the sample and a slack preload should be set to 0.445N. The force and crosshead data channels should be zeroed prior to the test. Data should not include any data prior to a force of 0.445N being achieved. The test should be programmed to end when the sample is completely buckled, ensuring the zero-slope yield point (as defined above) has occurred. Repeat in like fashion for all three test samples.

Construct a force (N) versus extension (mm) curve from the data. Record the Peak Force (N) for the test and the Force at Yield (N) to the nearest 0.1 N for each sample. Calculate and report the arithmetic mean of the three Peak Force (N) values to the nearest 0.1 N and calculate and report the three Force at Yield (N) values to the nearest 0.1 N.

Relative Sizes

All of the above-described perimeters may be independently sized and/or shaped. For example, each perimeter, whether actual or functional, may be independently sized, such that any of $P1_A$, $P1_{MF}$, $P2_A$, $P2_F$, $P3_A$, $P3_F$, $P4_F$, or $P4_{MF}$ may be the same or different. When a support layer is not included in the cargo assemblage, the first maximum functional perimeter PIME may be at most about 105% of the first actual perimeter $P1_A$. When a support layer is included in the cargo assemblage, the fourth maximum functional perimeter $P4_{MF}$ may be greater than or equal to about 105%, greater than or equal to about 107%, greater than or equal to about 110%, or greater than about 125%, but less than or equal to about 150% of the first actual perimeter $P1_A$, specifically reciting all 1% increments within the above-recited ranges and all ranges formed therein or thereby. It is to be appreciated, therefore, that the functional perimeter of any layer, such as the second functional perimeter $P2_F$ or the third functional perimeter $P3_F$, may be greater than or equal to about 105%, greater than or equal to about 107%, greater than or equal to about 110%, or greater than about 125%, but less than or equal to about 150% of the first actual perimeter $P1_A$, specifically reciting all 1% increments within the above-recited ranges and all ranges formed therein or thereby.

In some configurations, the third functional perimeter is less than about 1.5% less than the first actual perimeter. In some configurations, the third functional perimeter is less than about 2.0% less than the first actual perimeter. In some configurations, the third functional perimeter is less than about 2.5% less than the first actual perimeter.

All of the above-described areas may be independently sized and/or shaped. For example, each area, whether actual or functional, may be independently sized, such that any of $A1_A$, $A1_{MF}$, $A2_A$, $A2_F$, $A3_A$, or $A3_F$ may be the same or different. The second actual area $A2_A$ and/or the third actual area $A3_A$ may be the same as, less than, or greater than any of $A1_A$, $A1_{MF}$, $A2_A$, $A2_F$, $A3_A$, or $A3_F$. Similarly, all of the above-described lengths, and widths may be independently sized and/or shaped. For example, each length and width, whether actual or functional, may be independently sized, such that any of $L1_A$, $W1_A$, $L1_{MF}$, $W1_{MF}$, $L2_F$, $W2_F$, $L3_F$, or $W3_F$ may be the same or different. When a product support layer is not included in the cargo assembly, the first maximum area $A1_{MF}$ may be about 95%, about 90%, about 85%, about 80%, or about 75% of of the first actual area $A1_A$, specifically reciting all 1% increments within the above-recited ranges and all ranges formed therein or thereby. When a product support layer is included in the cargo assembly, the fourth maximum area $A4_{MF}$ may be about 120%, about 115%, about 110%, about 105%, about 100%, about 95%, about 90%, about 85%, about 80%, or about 75% of any of the first actual area $A1_A$, specifically reciting all 1% increments within the above-recited ranges and all ranges formed therein or thereby. It is to be appreciated, therefore, that the functional area of any layer, such as the second functional area $A_{2F}$ or the third functional area $A_{3F}$, may be about 120%, about 115%, about 110%, about 105%, about 100%, about 95%, about 90%, about 85%, about 80%, or about 75% of any of the first actual area $A1_A$, specifically reciting all 1% increments within the above-recited ranges and all ranges formed therein or thereby.

Support Layer Geometric Variations

Referring to FIGS. 4A-4J, the support layer 200 may comprise one or more panel components 200*a*, 200*b*, 200*c*, 200*d*. Each panel component may be generally flat, and while only a few specific shapes for panel components are illustrated, it is to be appreciated that the panel component(s) may have any shape. Although support layers are generally flat, they may be planar or non-planar. Non-planar examples include portions of the support layer bent or moved out of plane to improve product support, rigidity; integration of the product, support layer, and pallet. Support layers may be continuous or have portions removed from the support layer to reduce material utilization, weight, cost or other reason. Edges of the support layer may be linear, rectilinear, or non-linear.

According to various embodiments, the fourth functional perimeter $P4_F$ may be defined by outer edges of one or more panel components. The distance between the functional perimeter and the outer edges of the one or more panel components may vary based on the density, weight, size, or shape of the packages stacked upon the support layer; the characteristics of the specific packages may allow for a greater or lesser overhang. Additionally, according to various embodiments, any of the panel components may optionally include reinforced segments 203 that provide additional thickness, and/or rigidity and which may, therefore, extend the fourth functional perimeter $P4_F$ further away from the outer edges of the panel component.

Figure 4A:
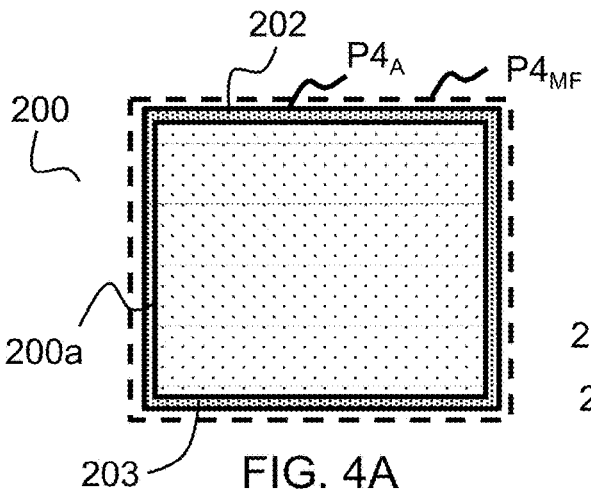
FIG. 4A is an example according to various embodiments, illustrating a rectangular support layer having an optional reinforcing section.

FIG. 4A is an example according to various embodiments, illustrating a rectangular support layer 200 comprising only a first panel component 200*a*. It is to be appreciated that the support layer 200 may include multiple panel components of the same or different shape in a stacked arrangement. The outer edge 202 of the support layer 200 defines a fourth actual perimeter $P4_A$, which is in turn circumscribed by a fourth maximum functional perimeter $P4_{MF}$ allowing a more efficient tessellation of the packages 100 compared to the tessellation that would be possible on the support deck 144 of the pallet 138 or on any layer 134 of the cargo assemblage. The rectangular support layer 200 includes an optional reinforced segment 203. Optional reinforced segments 203 may be provided on any panel component described herein and may have any shape or size that is desirable or useful to provide additional rigidity and to extend the functional perimeter defined by the support layer 200.

Figure 4B:
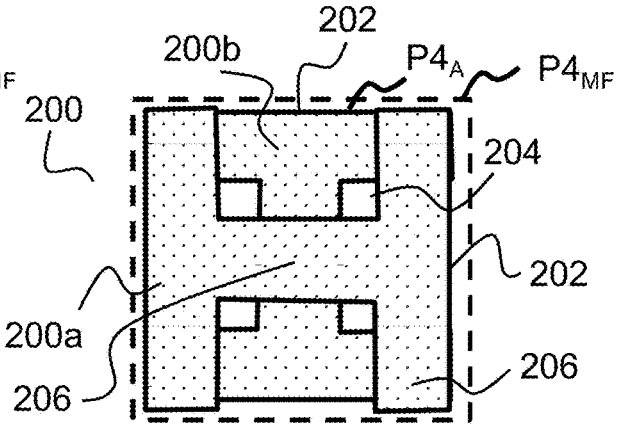
FIG. 4B is an example according to various embodiments, illustrating a support layer comprising multiple H-shaped panel components.

FIG. 4B is an example according to various embodiments, illustrating a support layer 200 comprising a first panel component 200*a* and an optional second panel component 200*b*, each having an H-shape. The second panel component

200*b* is oriented at a 90-degree angle relative to the first panel component 200*a* such that the outer edges 202 define a fourth actual perimeter $P4_A$, which is in turn circumscribed by a fourth maximum functional perimeter $P4_{MF}$ allowing a more efficient tessellation of the packages 100. The support layer 200 may include a plurality of gaps 204, defined and bounded by various portions of the first panel component 200*a* and the second panel component 200*b*. The first panel component 200*a* and the second panel component 200*b* also overlap at a plurality of overlapping segments 206. The overlapping segments 206 may be arranged to provide additional support and rigidity at critical areas, such as along the edges of, at the center of, or at the corners of the support layer 200. Furthermore, as illustrated here, since the panel components need not be a continuous rectangular sheet, material savings can be achieved, and the additional support and rigidity may be achieved without adding excessive weight, bulk, or material cost.

Figure 4C:
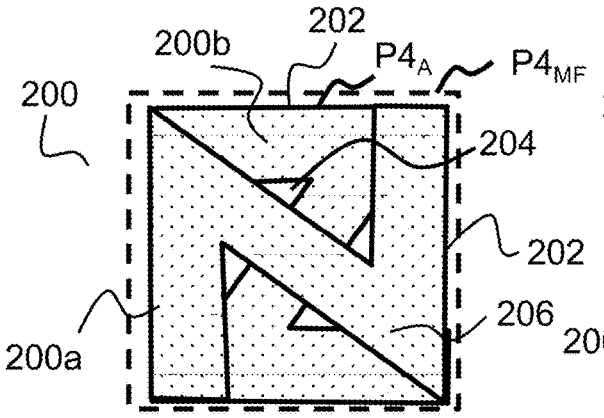
FIG. 4C is an example according to various embodiments, illustrating a support layer comprising multiple Z-shaped panel components.

FIG. 4C is an example according to various embodiments, illustrating a support layer 200 comprising a first panel component 200*a* and an optional second panel component 200*b* each having a Z-shape. The second panel component 200*b* is oriented at a 90-degree angle relative to the first panel component 200*a* such that the outer edges 202 define a fourth actual perimeter $P4_A$, which is in turn circumscribed by a fourth maximum functional perimeter $P4_{MF}$ allowing a more efficient tessellation of the packages 100. Like the embodiment shown in FIG. 4B, the support layer 200 may include a plurality of gaps 204 and a plurality of overlapping segments 206.

Figure 4D:
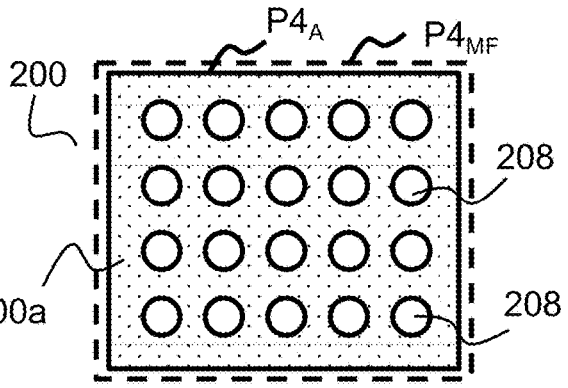
FIG. 4D is an example according to various embodiments, illustrating a rectangular support layer comprising a plurality of holes.

FIG. 4D is an example according to various embodiments, illustrating a support layer 200 comprising a first panel component 200*a* having a generally rectangular shape as well as a plurality of holes 208 cut or otherwise formed into the surface of the first panel component 200*a*. The plurality of holes 208 may reduce material cost and weight without causing an excessive reduction in rigidity at critical regions, such as at the edges, center, and corners of the support layer 200. The other edge of the first panel component 200*a* defines a fourth actual perimeter $P4_A$, which is in turn circumscribed by a fourth maximum functional perimeter $P4_{MF}$ allowing a more efficient tessellation of the packages 100. Any panel component described herein may include such holes 208.

Figure 4E:
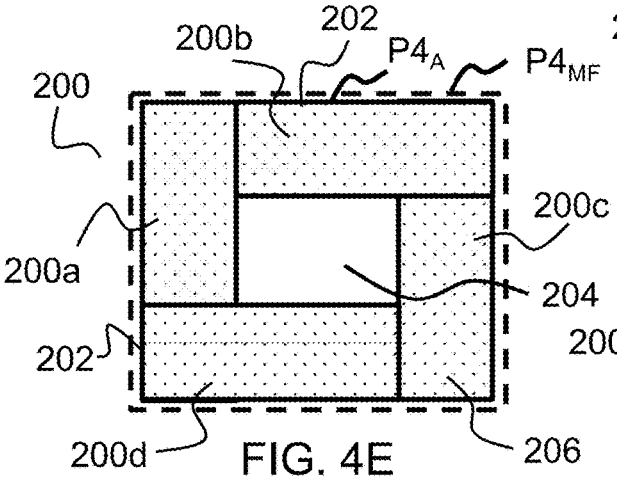
FIG. 4E is an example according to various embodiments, illustrating a support layer comprising multiple I-shaped panel components.

FIG. 4E is an example according to various embodiments, illustrating a support layer 200 comprising a first panel component 200*a*, an optional second panel component 200*b*, an optional third panel component 200*c*, and an optional fourth panel component 200*d* each having a I-shape. It is to be appreciated that a very similar arrangement may be employed using two or more L-shaped panel components. The panel components are oriented such that they overlap at overlapping segments 206 and so that the outer edges 202 of the panel components define a fourth actual perimeter $P4_A$, which is in turn circumscribed by a fourth maximum functional perimeter $P4_{MF}$ allowing a more efficient tessellation of the packages 100. Like other embodiments, the panel components 200*a*, 200*b*, 200*c*, 200*d* also define a central gap 204, thereby reducing material usage and weight, while still providing rigidity and support at critical regions, such as at the edges, center, and corners of the support layer 200.

Figure 4F:
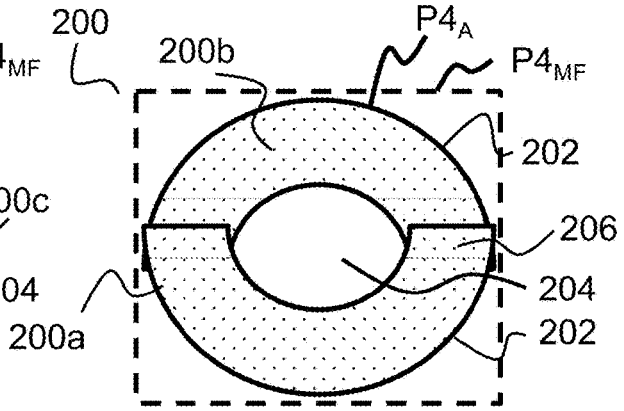
FIG. 4F is an example according to various embodiments, illustrating a support layer comprising multiple C-shaped panel components.

FIG. 4F is an example according to various embodiments, illustrating a support layer 200 comprising a first panel component 200*a* and an optional second panel component 200*b* each having a C-shape. The panel components 200*a*, 200*b* are arranged to include overlapping segments 206, to define a central gap 204, and to define a fourth actual perimeter $P4_A$, which is in turn circumscribed by a fourth maximum functional perimeter $P4_{MF}$ allowing a more efficient tessellation of the packages 100.

Figure 4G:
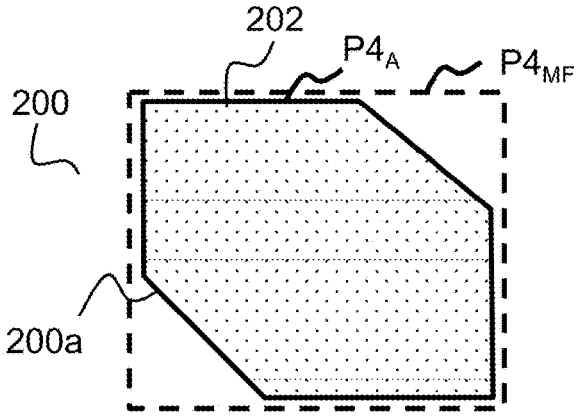
FIG. 4G is an example according to various embodiments, illustrating a hexagonal support layer.

FIG. 4G is an example according to various embodiments, illustrating a hexagonal support layer 200 comprising only a first panel component 200*a*. It is to be appreciated that the support layer 200 may include multiple panel components of the same or different shape in a stacked arrangement. The outer edge 202 of the support layer 200 defines a fourth actual perimeter $P4_A$, which is in turn circumscribed by a fourth maximum functional perimeter $P4_{MF}$ allowing a more efficient tessellation of the packages 100 compared to the tessellation that would be possible on the support deck 144 of the pallet 138 or on any layer 134 of the cargo assemblage.

Figure 4H:
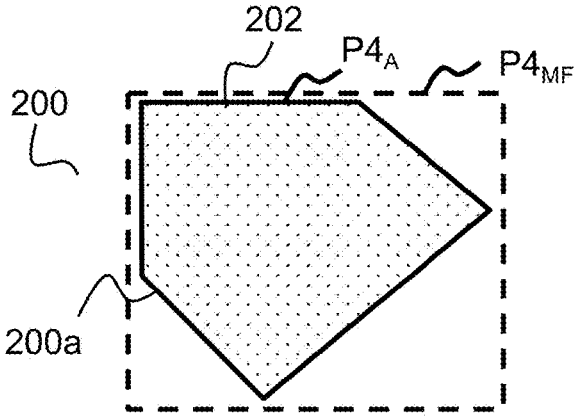
FIG. 4H is an example according to various embodiments, illustrating a pentagonal support layer.

FIG. 4H is an example according to various embodiments, illustrating a pentagonal support layer 200 comprising only a first panel component 200*a*. It is to be appreciated that the support layer 200 may include multiple panel components of the same or different shape in a stacked arrangement. The outer edge 202 of the support layer 200 defines a fourth actual perimeter $P4_A$, which is in turn circumscribed by a fourth maximum functional perimeter $P4_{MF}$ allowing a more efficient tessellation of the packages 100 compared to the tessellation that would be possible on the support deck 144 of the pallet 138 or on any layer 134 of the cargo assemblage.

Figure 4I:
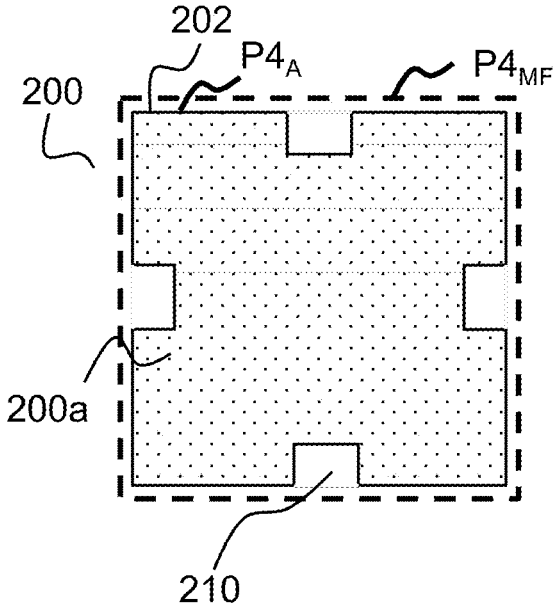
FIG. 4I is an example according to various embodiments, illustrating a square support layer having rectilinear notches.

FIG. 4I is an example according to various embodiments, illustrating a square support layer 200 comprising only a first panel component 200*a* having rectilinear notches 210. The rectilinear notches 210 may be disposed on one or any combination of one or more sides of the support layer 200. The rectilinear notches 210 may better hold one or more bands of the integration material. This results in a more stable cargo assemblage (e.g., the load 136 does not move as much relative to the support layer 200 and/or the pallet 138 comparted to a support layer 200 without the rectilinear notches 210). It is to be appreciated that the support layer 200 may include multiple panel components of the same or different shape in a stacked arrangement. The outer edge 202 of the support layer 200 defines a fourth actual perimeter $P4_A$, which is in turn circumscribed by a fourth maximum functional perimeter $P4_{MF}$ allowing a more efficient tessellation of the packages 100 compared to the tessellation that would be possible on the support deck 144 of the pallet 138 or on any layer 134 of the cargo assemblage.

Figure 4J:
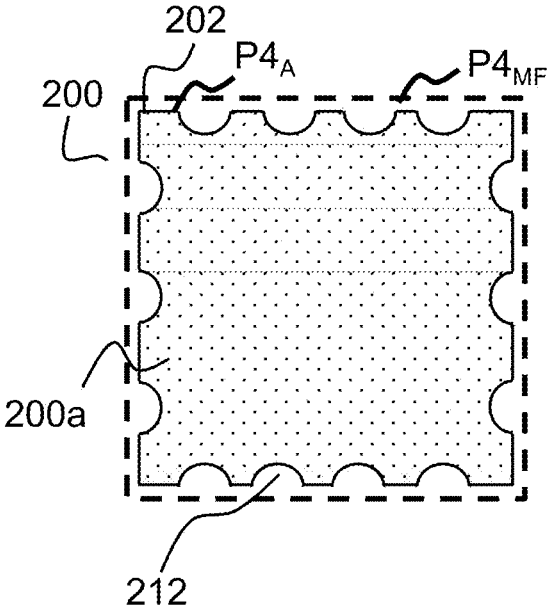
FIG. 4J is an example according to various embodiments, illustrating a square support layer having arcuate notches.

FIG. 4J is an example according to various embodiments, illustrating a square support layer 200 comprising only a first panel component 200*a* having arcuate notches 212. The arcuate notches 212 may be disposed on one or any combination of one or more sides of the support layer 200. The arcuate notches 212 may better hold one or more bands of the integration material. This results in a more stable cargo assemblage (e.g., the load 136 does not move as much relative to the support layer 200 and/or the pallet 138 comparted to a support layer 200 without the arcuate notches 212). It is to be appreciated that the support layer 200 may include multiple panel components of the same or different shape in a stacked arrangement. The outer edge 202 of the support layer 200 defines a fourth actual perimeter $P4_A$, which is in turn circumscribed by a fourth maximum functional perimeter $P4_{MF}$ allowing a more efficient tessellation of the packages 100 compared to the tessellation that would be possible on the support deck 144 of the pallet 138 or on any layer 134 of the cargo assemblage.

Again, it is to be appreciated that although some specific geometries, configurations, and arrangements have been illustrated in FIGS. 4A-4J, combinations and variations are contemplated. The support layer 200 and the panel component(s) may be customized, configured, and arranged to accommodate the sizes, shapes, and weights of a variety of packages.

According to various embodiments, the support layer may be planar such that portions extending beyond the load are not folded. As used herein, "not folded" means no purposeful fold line; folding does not include wrinkled or deformed due to wrap or damaged corners. Additionally, according to various embodiments, the support layer may be compositionally uniform, such that it is not reinforced. For example, according to non-reinforced embodiments, there may be no rod or bands within the structure of support layer.

Improving Pallet Efficiency and Shipping Efficiency with Support Layers

As used herein, "pallet efficiency" refers to the amount of product effectively shipped on a pallet of a given dimension. "Shipping efficiency" refers to the amount of product that be effectively shipped per truck of a given dimension. Increasing pallet efficiency can have benefits of handling fewer pallets, reducing warehouse space requirements, reducing frequency of pallets becoming empty at the customer, etc. Increasing shipping efficiency can have benefits to sustainability and cost, as generally the cost for a truck is based on distance and route vs. amount of product in the truck. Additionally, roll good products run out of volume within a truck before the truck reaches a maximum weight limit that prevents additional product from being able to be added to the truck.

Various embodiments are able to increase pallet and shipping efficiencies across a broader range of product and package sizes within any given pallet size by utilizing a support layer along with the pallet and product. A support layer may support and protect product over areas larger than that of the pallet. Additionally, the support layer may vary in size depending on the product and package size to maximize the efficiency of the pallet and the shipping of the product. The support layers according to various embodiments, therefore, provides a lot of flexibility for the different footprints of product that a manufacturer may desire to ship. For example, the footprint may be square or it may be non-square. Without a support layer, often less than 100% of the pallet's surface area is utilized. With the support layer, however, significantly more than the entire pallet surface area may be utilized.

Various embodiments described herein relate to cargo assemblages that employ a support layer. Such cargo assemblages may provide an improved pallet efficiency compared to cargo assemblages that do not employ a support layer. The improvement in pallet efficiency may be greater than or equal to about 5%, about 10%, about 15%, about 20%, about 25%, about 30%, about 35%, about 40%, or about 100%, specifically reciting all 1% increments within the above-recited ranges and all ranges formed therein or thereby.

Various embodiments described herein relate to cargo assemblages that may be placed, packed, or stacked within truck or a shipping container. Cargo assemblages that include support layers may provide an increased shipping efficiency compared to cargo assemblages that do not include support layers. The improvement in shipping efficiency may be greater than or equal to about 5%, about 10%, about 15%, about 20%, about 25%, about 30%, about 35%, or about 40%, specifically reciting all 1% increments within the above-recited ranges and all ranges formed therein or thereby.

Support Layer Materials

The support layers, according to various embodiments, may comprise one or a combination of materials. The materials may include, but are not limited to corrugated cardboard, plywood, metal, medium density Fiberboard (MDF), plastic, or other material that provides the bending resistance and rigidity required, for example to support overhung loads. The support layers may be recyclable, biodegradable, compostable, or reusable. They can be made from recycled materials. They can come pre-attached to the pallet or added to the cargo assembly during packaging. For example, a pallet could come delivered with a support layer pre-attached to the pallet to enable more desirable perimeters of product layers to be supported.

Physical Properties of Support Layers

Support layers, according to various embodiments, may have a bending resistance or rigidity adequate to support and/or stabilize a load.

A surface of a support layer may have a coefficient of friction adequate to stabilize a load.

Figure 5A:
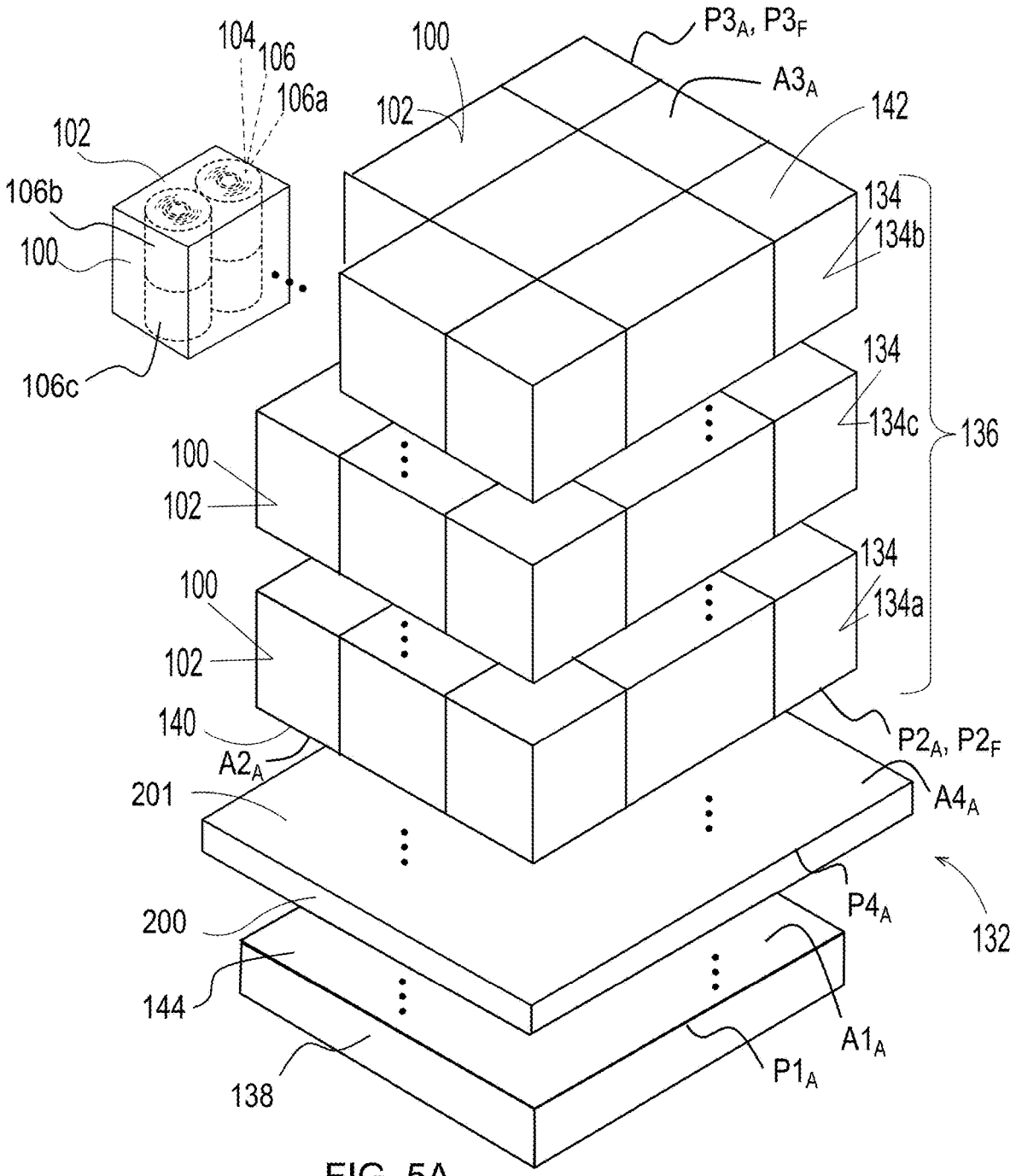
FIG. 5A is an example according to various embodiments, illustrating an exploded perspective view of a cargo assemblage comprising an efficiently tessellated load arranged on a support layer and a pallet.

Cargo Assemblages Comprising at Least One Support Layer and Efficiently Tessellated Loads FIG. 5A is an example according to various embodiments, illustrating an exploded perspective view of a cargo assemblage 132 comprising an efficiently tessellated load 136 arranged on a support layer 200 and a pallet 138, wherein the load 136 is defined by layers 134 of packages 100 including containers 102 of absorbent paper product 104. The support deck 144 of the pallet 138 defines a first actual perimeter $P1_A$, circumscribing a first area $A1_A$. Similarly, a top surface 201 of the support layer 200, which may be formed by one or more panel components, defines a fourth actual perimeter $P4_A$ as well as a fourth actual area $A4_A$.

Each of the layers 134 of packages 100 may also define multiple perimeters and areas. The bottom surface 140 of the bottom layer 134*a* defines a second actual perimeter $P2_A$, which due to the symmetrical shape of the bottom layer 134*a* corresponds to the second functional perimeter $P_2F$. The bottom surface also defines a second actual area $A2_A$. The top surface 142 of the top layer 134*b* defines a third actual perimeter $P3_A$, which due to the symmetrical shape of the top layer 134*b* corresponds to a third functional perimeter $P3_F$. The top surface 142 also defines a third actual area $A3_A$.

The fourth functional perimeter $P4_F$ and the fourth actual area $A4_A$ of the support layer 200 are larger than the first actual perimeter $P1_A$ and the first actual area $A1_A$ of the pallet 138. The support layer 200 is sized to allow the layers 134 of packages 100 to be efficiently tessellated on the top surface 201. The efficient tessellation may be achieved when the packages 100 are in an underhung or overhung configuration or when the packages 100 are neither underhung nor overhung relative to the support layer 200.

In various embodiments, the load 136 overhangs at least a portion of at least one of the support layer and pallet. The load 136 may overhang multiple sides of the support layer, may overhang multiple sides of the pallet, may overhang each of the sides of the support layer, may overhang each of the sides of the pallet, may overhang at least one side of the support layer, and may overhang at least one side of the pallet. The load 136 may overhang the pallet by at least two inches on at least one side of the pallet. The load 136 may overhang the pallet greater than about 2 inches, may overhang the pallet greater than about 3 inches, may overhang at least two sides of the pallet by more than 2 inches and may overhang at least two sides of the pallet layer by more than 3 inches The load 136 may overhang at least two sides of the pallet by more than 3 inches and may overhang at least two sides of the pallet layer by more than 4 inches.

Figure 5B:
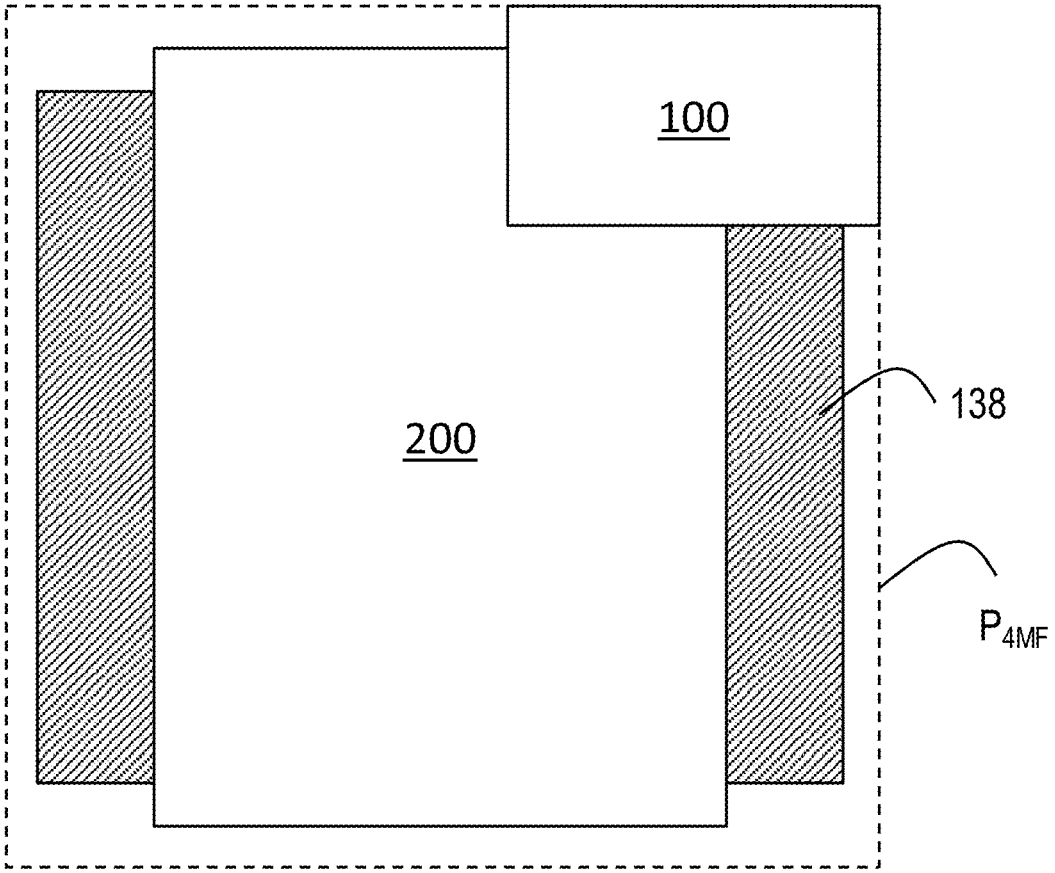
FIG. 5B is an example according to various embodiments illustrating a top view of a cargo assemblage comprising a support layer disposed on a pallet.

FIG. 5B demonstrates that the support layer 200 need not cover all of the pallet 138 or all of an underlying layer of packages. More specifically, FIG. 5B is an example according to various embodiments illustrating a top view of a cargo assemblage comprising a support layer 200 disposed on a pallet 138 and having a fourth maximum functional perimeter $P_{4MF}$. To allow all the various components to be seen only a single package 100 is shown disposed on the support layer 200 and on the pallet 138. The packages may be support by a combination of the support layer 200 and the pallet 138 or by a combination of the support layer 200 and underlying packages.

Figure 6A:
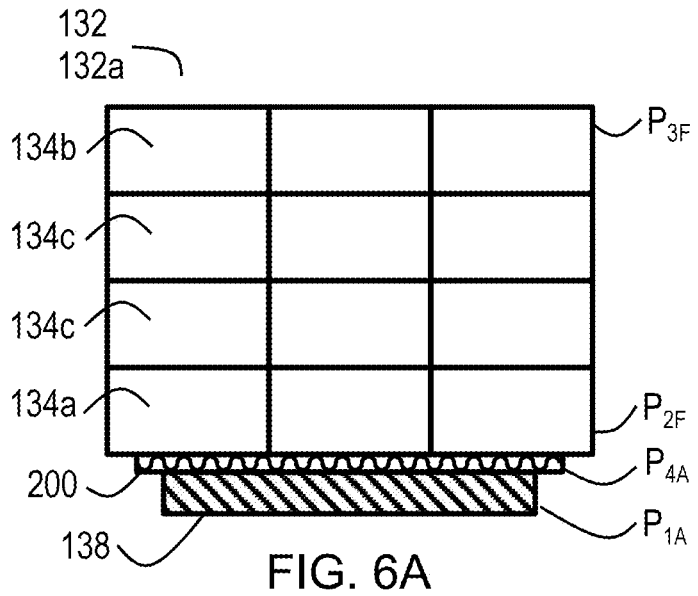
FIG. 6A is an example according to various embodiments, illustrating a side view of a cargo assemblage comprising a plurality of layers and a support layer, positioned below the bottom layer.

FIG. 6A is an example according to various embodiments, illustrating a side view of a cargo assemblage 132 comprising a plurality of layers, including a bottom layer 134*a*, a top layer 134*b*, and one or more intermediate layers 134*c* positioned between the bottom layer 134*a* and the top layer 134*b*. The bottom layer 134*a* is positioned on a support layer 200, which is, in turn, positioned on a pallet 138. As shown in FIG. 6A, the bottom layer 134*a* may define a second functional perimeter $P_{2F}$ and the top layer 134*b* may define a third functional perimeter $P_{3F}$. The support layer may define a fourth actual perimeter $P_{4A}$ and the pallet may define a first actual perimeter $P_{1A}$. Although all variations are possible, as shown in FIG. 6A, the second functional perimeter $P_{2F}$ and the third functional perimeter $P_{3F}$ are approximately equally and are both greater than the fourth actual perimeter $P_{4A}$, which is greater than the first actual perimeter $P1_A$($P_{3F}$=$P_{2F}$, $P_{2F}$>$P_{4A}$>$P_{1A}$).

Figure 6B:
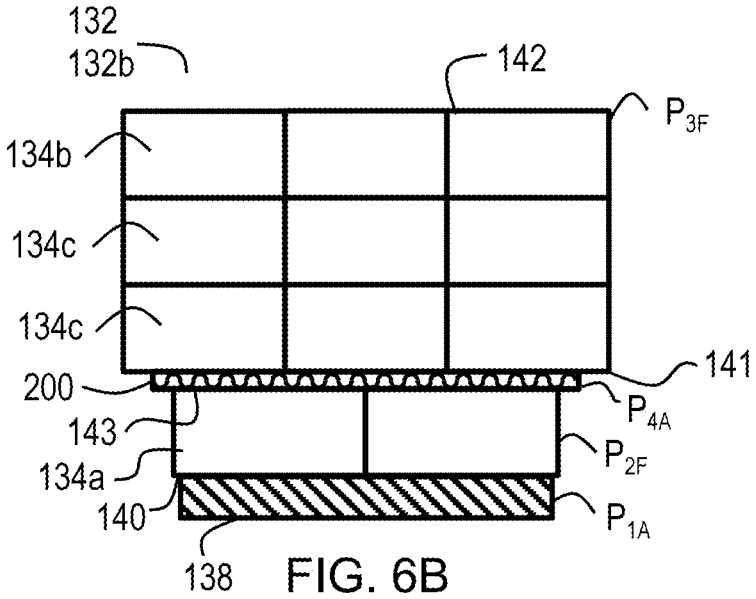
FIG. 6B is an example according to various embodiments, illustrating a side view of a cargo assemblage comprising a plurality of layers and a support layer, positioned between layers.

FIG. 6B is an example according to various embodiments, illustrating a side view of a cargo assemblage 132, in which the support layer 200 is positioned between a bottom surface 141 of an intermediate layer 134*c* and a top surface 143 of the bottom layer 134*a*. As illustrated, the bottom surface 140 of the bottom layer 134*a* is positioned directly on the pallet 138. It is to be appreciated, however, that any cargo assemblage described herein may comprise more than one support layer 200, and the bottom surface 140 of the bottom layer 134*a* could alternatively be placed on a second support layer 200. As shown in FIG. 6B, the bottom layer 134*a* may define a second functional perimeter $P_{2F}$ and the top layer 134*b* may define a third functional perimeter $P_{3F}$. The support layer may define a fourth actual perimeter $P_{4A}$ and the pallet may define a first actual perimeter $P1_A$. Although all variations are possible, as shown in FIG. 6B, the third functional perimeter $P_{3F}$ is greater than the fourth actual perimeter $P_{4A}$ which is greater than the second functional perimeter $P_{2F}$ which is greater than the first actual perimeter $P_{1A}$ ($P_{3F}$>$P_{4A}$>$P_{2F}$>$P_{1A}$).

Figure 6C:
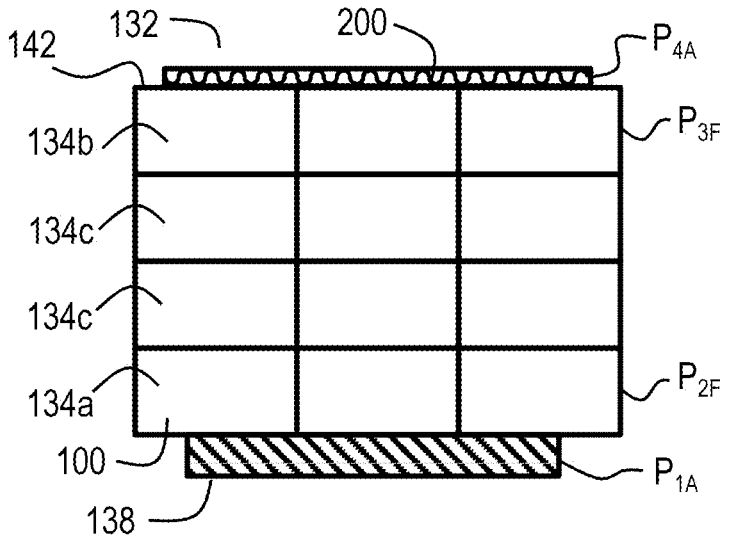
FIG. 6C is an example according to various embodiments, illustrating a side view of a cargo assemblage comprising a plurality of layers and a support layer, positioned on a top surface of a top layer.

FIG. 6C is an example according to various embodiments, illustrating a side view of a cargo assemblage 132, in which the support layer 200 is positioned on a top surface 142 of a top layer 134*b*. According to various embodiments, the weight of the support layer may be sufficient to hold the layers in place, even when they are arranged in an overhung configuration. The weight of the support layer may be selected based at least in part on a roll density to ensure that it does not crush any of the packages 100, which may include containers of absorbent paper product. The support layer 200 may also exhibit a coefficient of friction that reduces slippage across the top surface 142 of the top layer 134*b*. This may be achieved by applying appropriate materials (such as adhesives) to the support layer. These materials may be applied to the support layer and/or the pallet via spraying, slot coating, rod coater, as a tape layer, etc. As shown in FIG. 6C, the bottom layer 134*a* may define a second functional perimeter $P_{2F}$ and the top layer 134*b* may define a third functional perimeter $P_{3F}$. The support layer may define a fourth actual perimeter $P_{4A}$ and the pallet may define a first actual perimeter $P1_A$. Although all variations are possible, as shown in FIG. 6C, the third functional perimeter $P_{3F}$ may be equal to or approximately equal to the second functional perimeter $P_{2F}$, which may be greater than the fourth actual perimeter $P_{4A}$, which may be greater than the first actual perimeter $P_{1A}$($P_{3F}$=$P_{2F}$, $P_{2F}$>$P_{4A}$>$P_{1A}$).

Figure 6D:
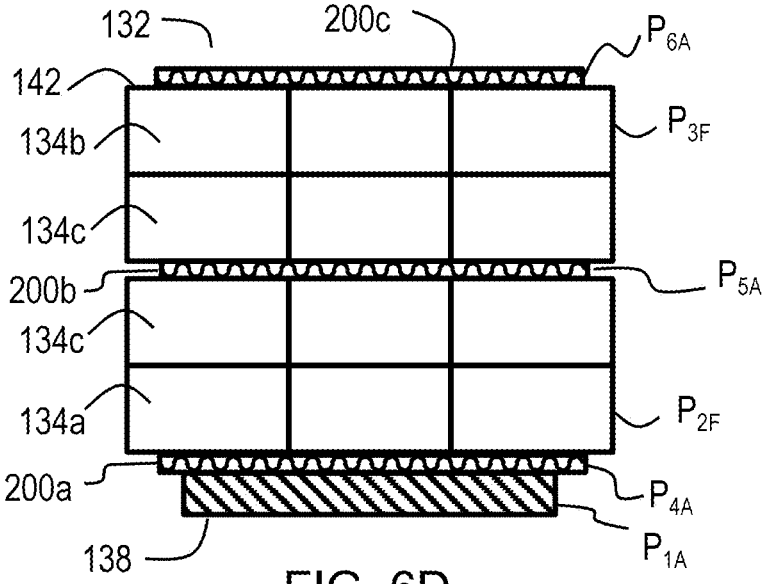
FIG. 6D is an example according to various embodiments illustrating a side view of a cargo assemblage comprising a plurality of support layers.

FIG. 6D is an example according to various embodiments illustrating a side view of a cargo assemblage 132 comprising a plurality of support layers 200*a*, 200*b*, 200*c*, positioned throughout the layers of packages, including on top of the top layer 134*b*, between two intermediate layers 134*c*, and below the bottom layer 134*a*. Any number of support layers may be employed according to various embodiments. As shown in FIG. 6D, the bottom layer 134*a* may define a second functional perimeter $P_{2F}$ and the top layer 134*b* may define a third functional perimeter $P_{3F}$. The first support layer 200*a* may define a fourth actual perimeter $P_{4A}$. The second support layer 200*b* may define a fifth actual perimeter $P_{5A}$. The third support layer 200*b* may define a sixth actual perimeter $P_{6A}$. The pallet may define a first actual perimeter $P_{1A}$. Although all variations are possible, as shown in FIG. 6C, the third functional perimeter $P_{3F}$ is equal to or approximately equal to the second functional perimeter $P_{2F}$. The fourth actual perimeter $P_{4A}$ is equal to or approximately equal to the fifth actual perimeter PSA and the sixth actual perimeter $P_{6A}$. The third functional perimeter $P_{3F}$ is greater than the sixth actual perimeter $P_{6A}$, which is greater than the first actual perimeter $P_{1A}$($P_{3F}$=$P_{2F}$, $P_{4A}$=$P_{5A}$=$P_{6A}$, $P_{3F}$>$P_{6A}$>$P_{1A}$).

Figure 6E:
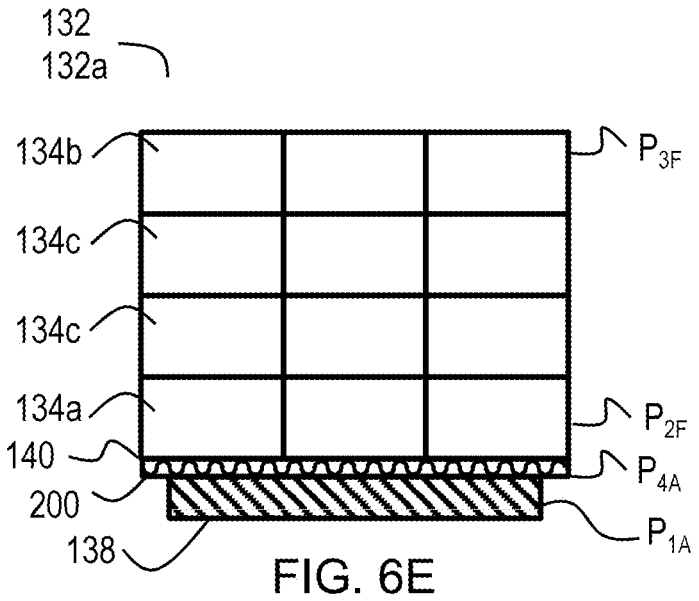
FIG. 6E is an example according to various embodiments, illustrating a side view of a cargo assemblage comprising a plurality of layers and a support layer, positioned below the bottom layer.

FIG. 6E is an example according to various embodiments, illustrating a side view of a cargo assemblage 132 comprising a plurality of layers, including a bottom layer 134*a*, a top layer 134*b*, and one or more intermediate layers 134*c* positioned between the bottom layer 134*a* and the top layer 134*b*. The bottom layer 134*a* is positioned on a support layer 200, which is, in turn, positioned on a pallet 138. As shown in FIG. 6E, the bottom layer 134*a* may define a second functional perimeter $P_{2F}$ and the top layer 134*b* may define a third functional perimeter $P_{3F}$. The support layer may define a fourth actual perimeter $P_{4A}$ and the pallet may define a first actual perimeter $P_{1A}$. Although all variations are possible, as shown in FIG. 6E, the second functional perimeter $P_{2F}$ and the third functional perimeter $P_{3F}$ are approximately equally and are both approximately equal to the fourth actual perimeter $P_{4A}$, which is greater than the first actual perimeter $P_{1A}$($P_{3F}$=$P_{2F}$=$P_{4A}$>$P_{1A}$).

Figure 6F:
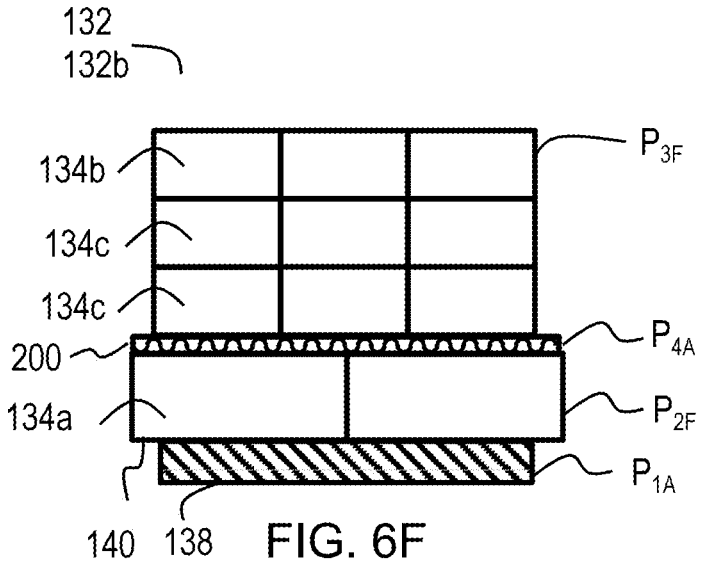
FIG. 6F is an example according to various embodiments, illustrating a side view of a cargo assemblage comprising a plurality of layers and a support layer, positioned between layers.

FIG. 6F is an example according to various embodiments, illustrating a side view of a cargo assemblage 132, in which the support layer 200 is positioned between a bottom surface 141 of an intermediate layer 134*c* and a top surface 143 of the bottom layer 134*a*. As illustrated, the bottom surface 140 of the bottom layer 134*a* is positioned directly on the pallet 138. It is to be appreciated, however, that any cargo assemblage described herein may comprise more than one support layer 200, and the bottom surface 140 of the bottom layer 134*a* could alternatively be placed on a second support layer 200. As shown in FIG. 6F, the bottom layer 134*a* may define a second functional perimeter $P_{2F}$ and the top layer 134*b* may define a third functional perimeter $P_{3F}$. The support layer may define a fourth actual perimeter $P_{4A}$ and the pallet may define a first actual perimeter $P_{1A}$. Although all variations are possible, as shown in FIG. 6F, the third functional perimeter $P_{3F}$ is less than the fourth actual perimeter $P_{4A}$ which is approximately equal to the second functional perimeter $P_{2F}$ which is greater than the first actual perimeter $P_{1A}$($P_{4A}$=$P_{2F}$>$P_{3F}$>$P_{1A}$).

Figure 6G:
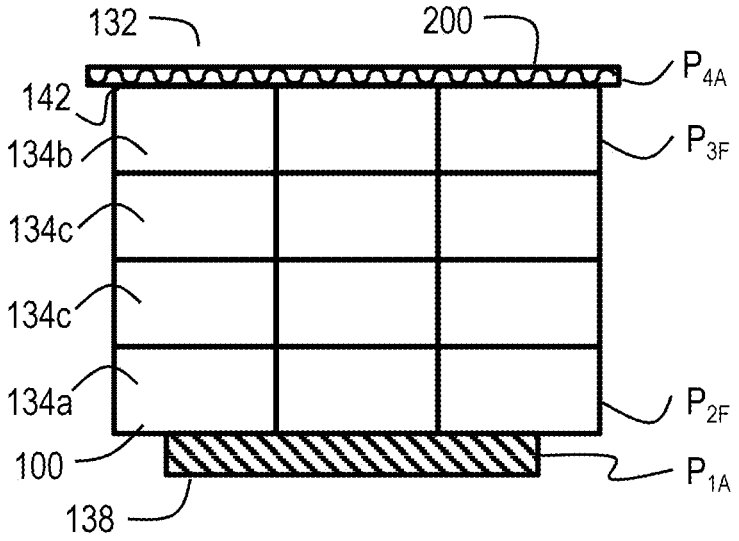
FIG. 6G is an example according to various embodiments, illustrating a side view of a cargo assemblage comprising a plurality of layers and a support layer, positioned on a top surface of a top layer.

FIG. 6G is an example according to various embodiments, illustrating a side view of a cargo assemblage 132, in which the support layer 200 is positioned on a top surface 142 of a top layer 134*b*. According to various embodiments, the weight of the support layer may be sufficient to hold the layers in place, even when they are arranged in an overhung configuration. The weight of the support layer may be selected based at least in part on a roll density to ensure that it does not crush any of the packages 100, which may include containers of absorbent paper product. The support layer 200 may also exhibit a coefficient of friction that reduces slippage across the top surface 142 of the top layer 134*b*. As shown in FIG. 6G, the bottom layer 134*a* may define a second functional perimeter $P_{2F}$ and the top layer 134*b* may define a third functional perimeter $P_{3F}$. The support layer may define a fourth actual perimeter $P_{4A}$ and the pallet may define a first actual perimeter $P1_A$. Although all variations are possible, as shown in FIG. 6G, the third functional perimeter $P_{3F}$ may be equal to or approximately equal to the second functional perimeter $P_{2F}$, which may be less than the fourth actual perimeter $P_{4A}$, which may be greater than the first actual perimeter $P_{1A}$($P_{3F}$=$P_{2F}$, $P_{4A}$>$P_{2F}$>$P_{1A}$).

Figure 6H:
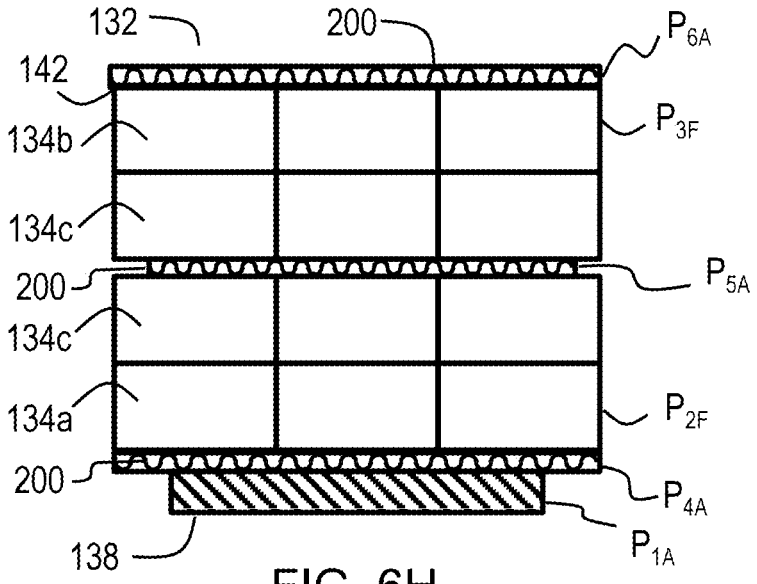
FIG. 6H is an example according to various embodiments illustrating a side view of a cargo assemblage comprising a plurality of support layers.

FIG. 6H is an example according to various embodiments illustrating a side view of a cargo assemblage 132 comprising a plurality of support layers 200*a*, 200*b*, 200*c*, positioned throughout the layers of packages, including on top of the top layer 134*b*, between two intermediate layers 134*c*, and below the bottom layer 134*a*. Any number of support layers may be employed according to various embodiments. As shown in FIG. 6H, the bottom layer 134*a* may define a second functional perimeter $P_{2F}$ and the top layer 134*b* may define a third functional perimeter $P_{3F}$. The first support layer 200*a* may define a fourth actual perimeter $P_{4A}$. The second support layer 200*b* may define a fifth actual perimeter $P_{5A}$. The third support layer 200*b* may define a sixth actual perimeter $P_{6A}$. The pallet may define a first actual perimeter $P_{1A}$. Although all variations are possible, as shown in FIG. 6H, the sixth actual perimeter $P_{6A}$ is approximately equal to the third functional perimeter $P_{3F}$, which is approximately equal to the second functional perimeter $P_{2F}$, which is approximately equal to the fourth actual perimeter $P_{4A}$, which is greater than the fifth actual perimeter $P_{5A}$, which is greater than the first actual perimeter $P_{1A}$ ($P_{6A}$=$P_{3F}$=$P_{2F}$=$P_{4A}$>$P_{5A}$>$P_{1A}$).

Supporting and Securing a Support Layer in a Cargo Assemblage

Figure 7A:
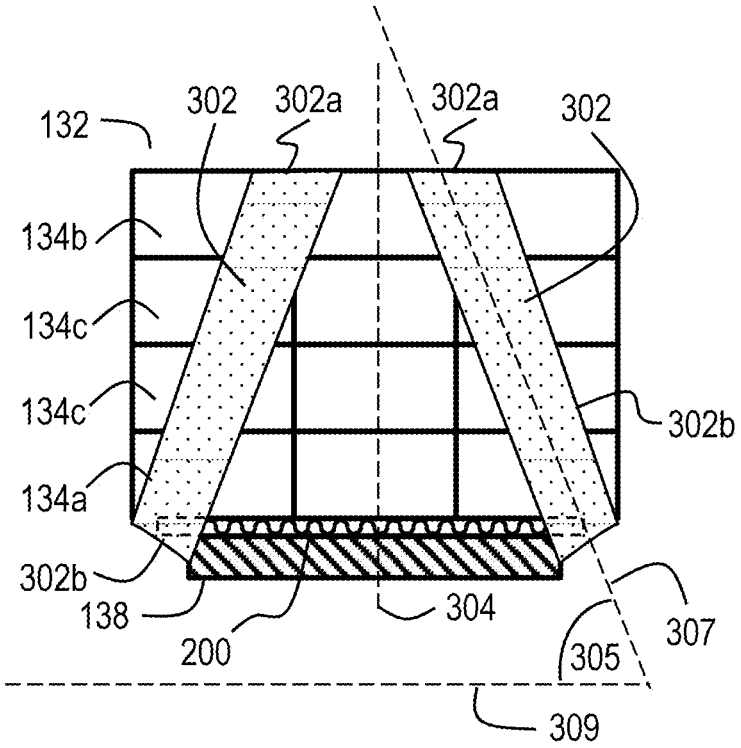
FIG. 7A is an example according to various embodiments, illustrating a side view of the cargo assemblage of FIG. 6A, comprising a plurality of layers and a support layer, positioned below the bottom layer and having integration material extending from the bottom layer over the top layer to apply a compressive and stabilizing force to the cargo assemblage.
Figure 7B:
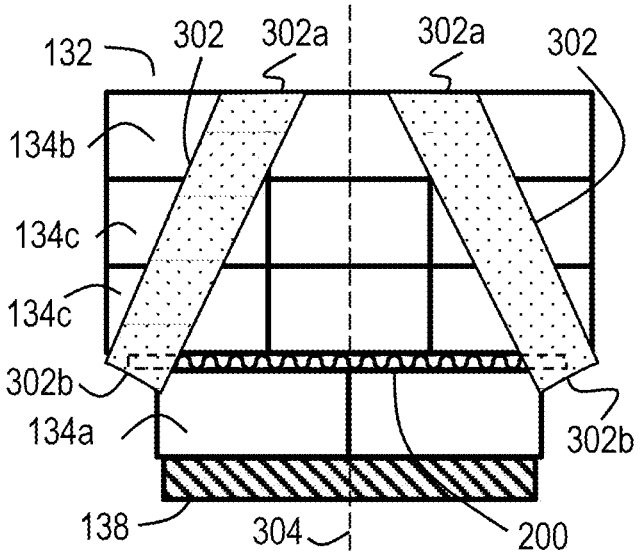
FIG. 7B is an example according to various embodiments, illustrating a side view of the cargo assemblage of FIG. 6B, comprising a plurality of layers and a support layer, positioned between intermediate layers and having integration material extending from the bottom layer over the top layer to apply a compressive and stabilizing force to the cargo assemblage.
Figure 7C:
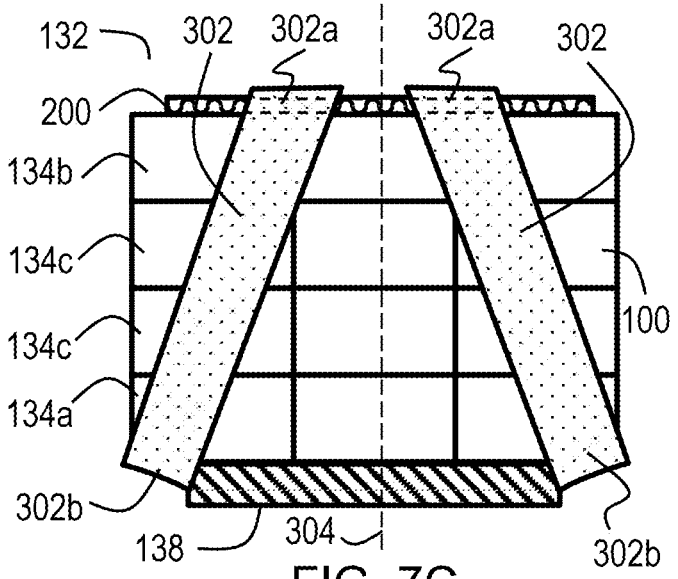
FIG. 7C is an example according to various embodiments, illustrating the cargo assemblage of FIG. 6C, comprising a plurality of layers and a support layer, positioned on a top surface of a top layer and having integration material extending from the bottom layer over the support layer to apply a compressive and stabilizing force to the cargo assemblage.

FIGS. 7A, 7B, and 7C are examples according to various embodiments, illustrating side views of cargo assemblages 132 like those shown in FIGS. 6A, 6B, and 6C respectively, wherein the cargo assemblages 132 are wrapped with vertically extending integration material 302, such as stretch wrap, in a substantially vertical direction along a vertical axis 304 that is perpendicular to the support deck of the pallet 138, to apply a compressive and stabilizing force to the cargo assemblage 132. Examples of suitable integration material can be found in U.S. Patent Publication No. US2022/0204199A1, which is incorporated by reference herein in its entirety. For example, the integration material 302 may include plastic and/or stretch paper.

The compressive and stabilizing force may be sufficient to hold the layers in place, even when they are arranged in an overhung configuration, and even when the weight of the support layer 200 is inadequate to do so on its own. The compressive and stabilizing force may be selected based at least in part on a roll density to ensure that it does not crush any of the packages 100, which may include containers of absorbent paper product.

As shown in FIGS. 7A, and 7B, a bottom portion 302*b* of the integration material 302 may press against a bottom surface of the support layer 200. The integration material 302 may extend across the intermediate layers 134*c* and over the top layer 134*b*, where a top portion 302*a* of the integration material 302 may press against the top layer 134*b*. As shown in FIG. 7C, a bottom portion 302*b* of the integration material 302 may press against a bottom surface of the bottom layer 134*a*. The integration material 302 may extend across the intermediate layers 134*c* and over the support layer 200, where a top portion 302*a* of the integration material 302 may press against the support layer 200. Although only one layer of the integration material, like stretch wrap, is shown on each side of the cargo assemblage 132, it is to be appreciated that multiple layers may be employed.

In some configurations, the integration material 302 may be in communication/contact with at least two of the pallet, the bottom surface of the cargo assemblage 132 (load), the top surface of the cargo assemblage 132 (load), and the support layer 200. In some configurations, the integration material 302 may be in communication/contact with at least three of the pallet, the bottom surface of the cargo assemblage 132 (load), the top surface of the cargo assemblage 132 (load), and the support layer 200. In some configurations, the integration material 302 may be in communication/contact with each of the pallet, the bottom surface of the cargo assemblage 132 (load), the top surface of the cargo assemblage 132 (load), and the support layer 200.

As shown in FIG. 7A, the integration material 302 may extend "generally vertically." As used herein, the term "generally vertically" may be defined with reference to an angle 305 between an integration material axis 307 extending along or parallel to a longitudinal extent of the integration material 302 and a pallet axis 309 extending along or parallel to a horizontal extent of the pallet 138. The angle 305 may be in a range of about 30 degrees to about 150 degrees, specifically reciting all 0.5% increments within the above-recited range and all ranges formed therein or thereby. An integration material 302 may also be disposed "generally horizontally" direction, when the angle 305 is less than about 30 degrees or greater than about 150 degrees.

Figure 7D:
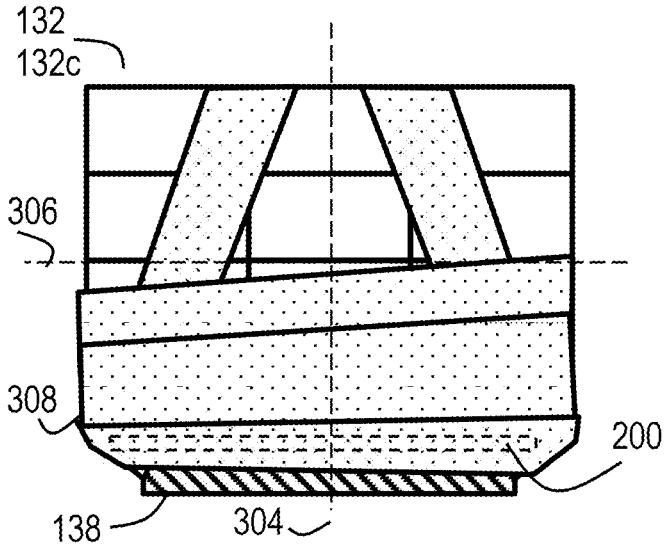
FIG. 7D is an example according to various embodiments, illustrating a side view of the cargo assemblage of FIG. 7A wrapped with horizontally extending integration material.
Figure 7E:
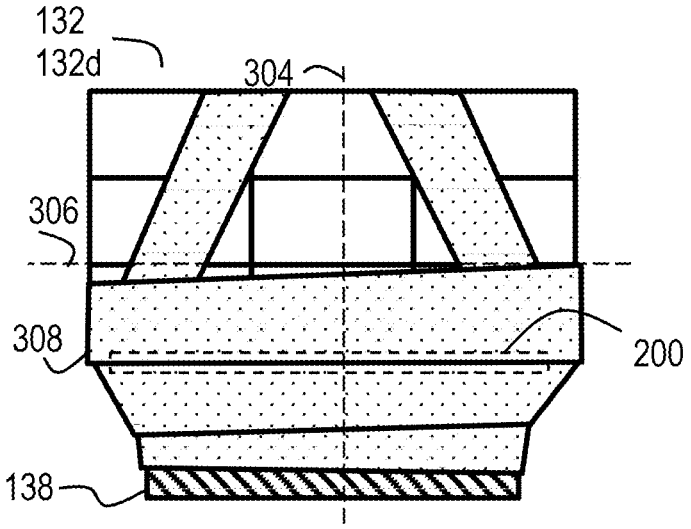
FIG. 7E is an example according to various embodiments, illustrating a side view of the cargo assemblage of FIG. 7B wrapped with horizontally extending integration material.

FIGS. 7D and 7E are examples according to various embodiments, illustrating side views of cargo assemblages 132 like those shown in FIGS. 7A, and 7B respectively, wherein the cargo assemblages 132 are wrapped with horizontally extending integration material 308, such as stretch wrap, in a substantially horizontal direction along a horizontal axis 306 that is parallel to the support deck of the pallet 138, to apply a compressive and stabilizing force to the cargo assemblage 132. The compressive and stabilizing force may be selected based at least in part on a roll density to ensure that it does not crush any of the packages 100, which may include containers of absorbent paper product.

Figure 7F:
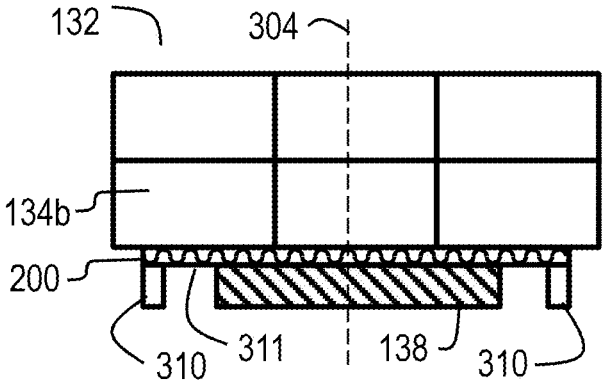
FIG. 7F is an example according to various embodiments, illustrating a side view of a cargo assemblage comprising a support layer, having a plurality of feet extending from the support layer in a downward direction.

FIG. 7F is an example according to various embodiments, illustrating a side view of a cargo assemblage 132 comprising a support layer 200, having a plurality of feet 310 extending from the support layer 200 in a downward direction, approximately parallel to a vertical axis 304. The feet 310 may be attached to a bottom surface 311 of the support layer 200. The feet 310 may be sized to match the height of the pallet 138 so that the feet 310 support the edges, corners, or sides of the support layer 200 by pressing against the ground or against another cargo assemblage upon which the cargo assemblage 132 is stacked.

Figure 7G:
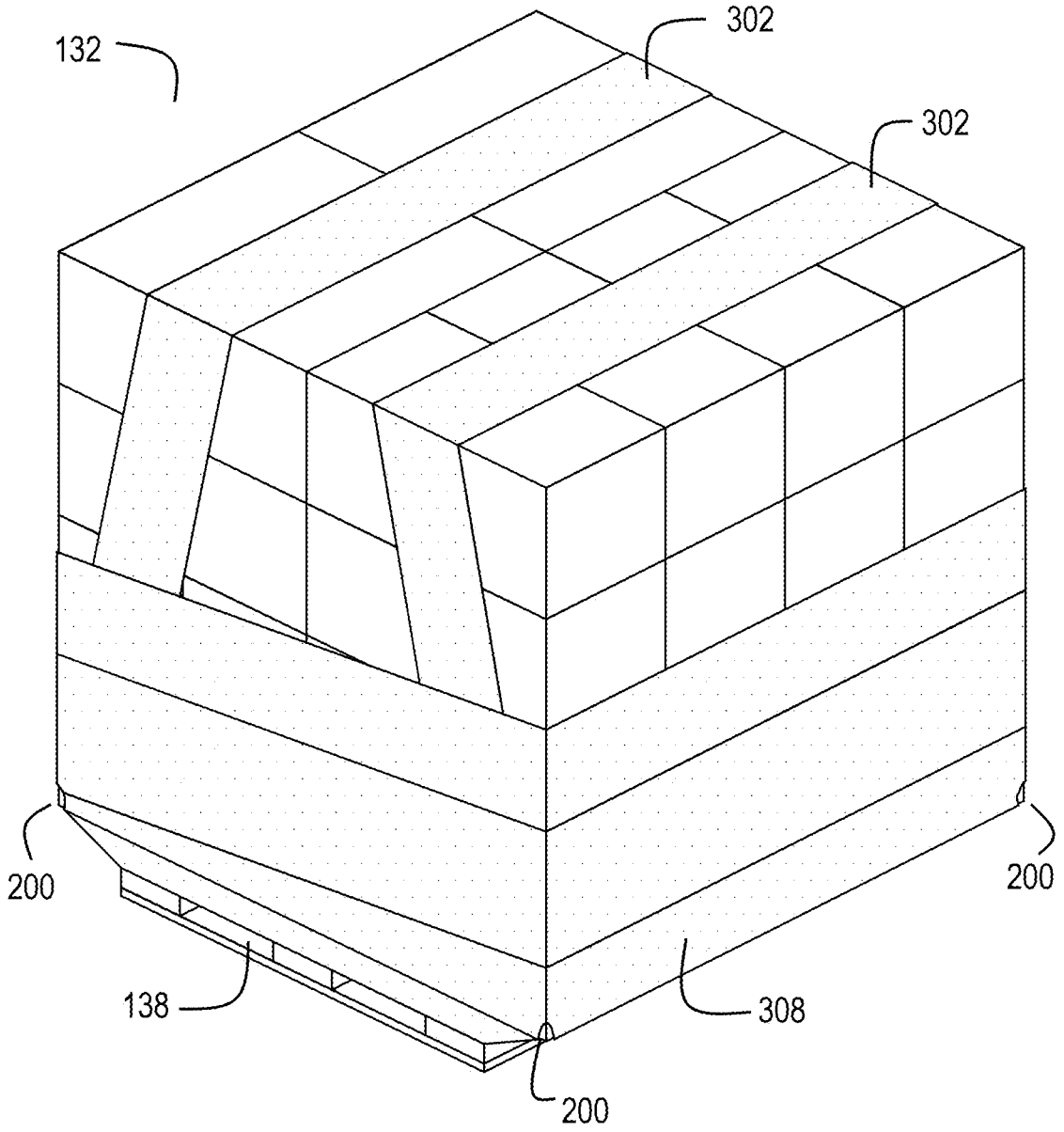
FIG. 7G is an example according to various embodiments, illustrating an isometric side view of a cargo assemblage comprising a support layer protruding through a layer of integration material.

FIG. 7G is an example according to various embodiments, illustrating an isometric side view of a cargo assemblage 132 comprising a support layer 200 protruding through vertically extending integration material 302 and horizontally extending integration material 308. The penetration of the support layer 200 through one or more layers integration material 302, 308 may add additional stability to the cargo assemblage 132.

Figure 7H:
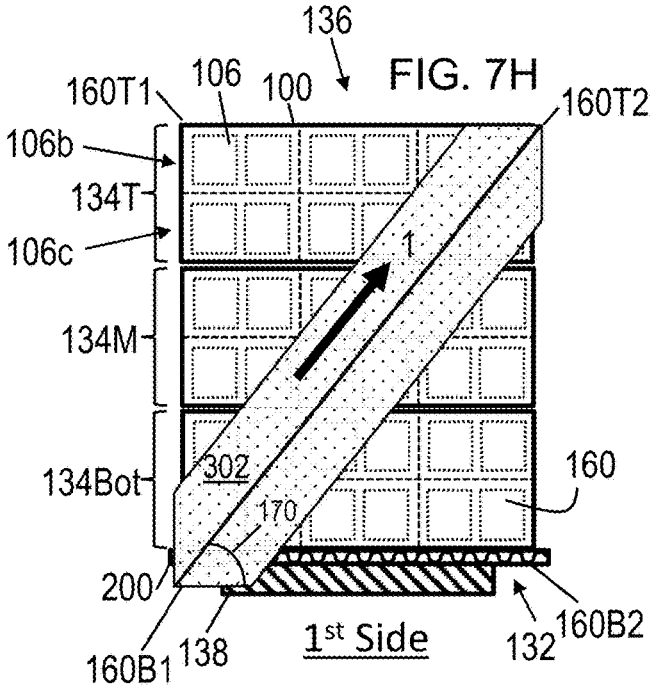
FIG. 7H is an example according to various embodiments, illustrating an isometric side view of a cargo assemblage during a first step of a wrapping operation.
Figure 7I:
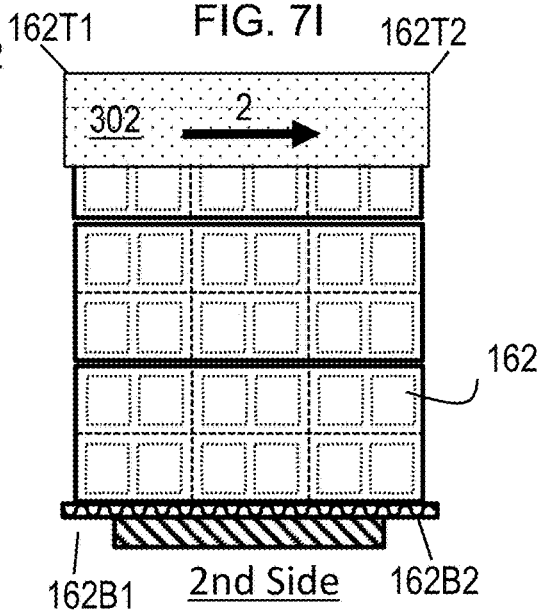
FIG. 7I is an example according to various embodiments, illustrating an isometric side view of a cargo assemblage during a second step of a wrapping operation.
Figure 7J:
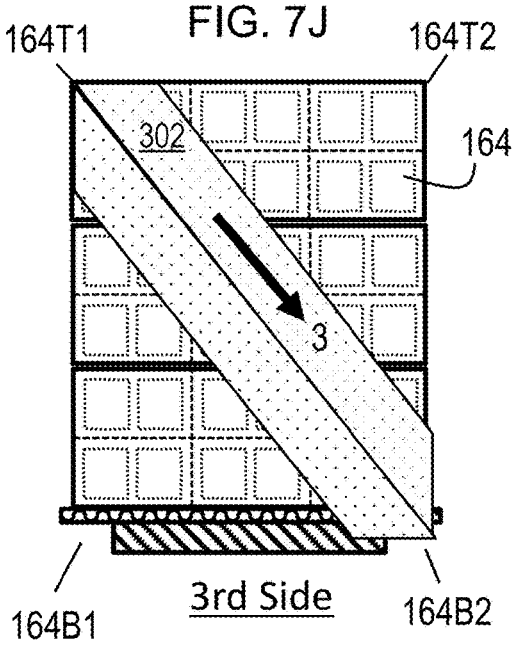
FIG. 7J is an example according to various embodiments, illustrating an isometric side view of a cargo assemblage during a third step of a wrapping operation.
Figure 7K:
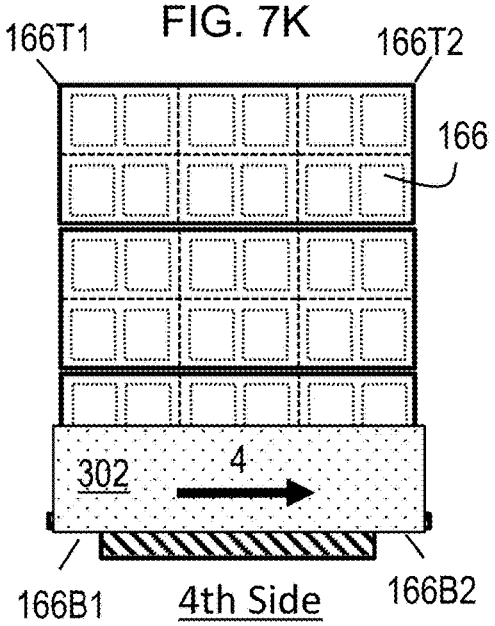
FIG. 7K is an example according to various embodiments, illustrating an isometric side view of a cargo assemblage during a fourth step of a wrapping operation.
Figure 7L:
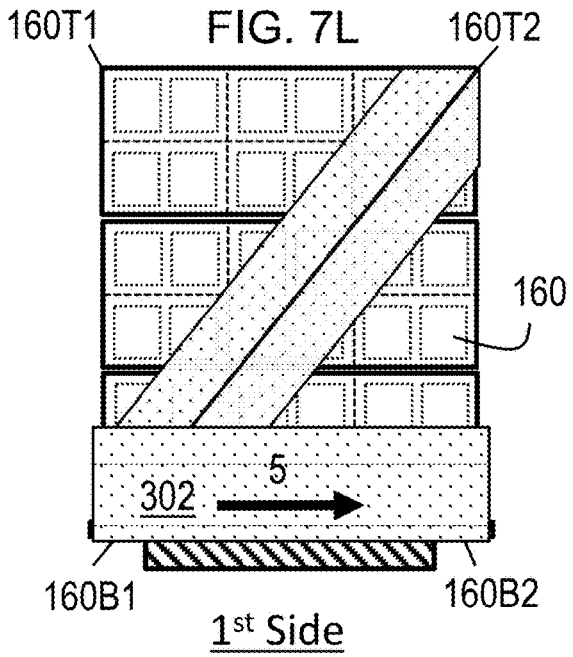
FIG. 7L is an example according to various embodiments, illustrating an isometric side view of a cargo assemblage during a fifth step of a wrapping operation.
Figure 7M:
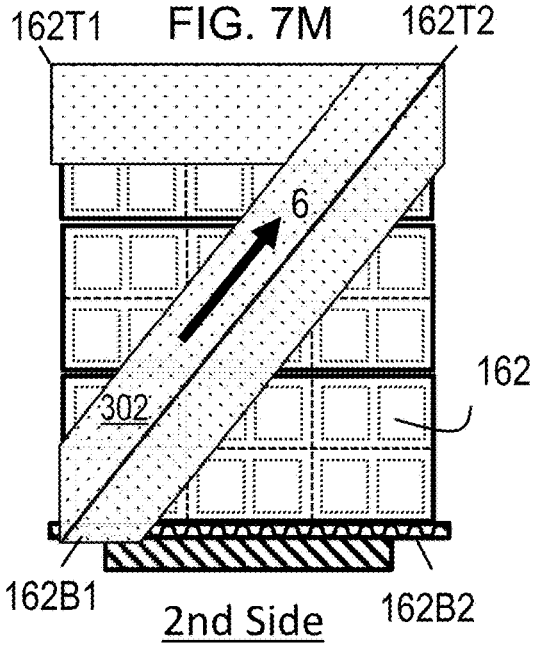
FIG. 7M is an example according to various embodiments, illustrating an isometric side view of a cargo assemblage during a sixth step of a wrapping operation.
Figure 7N:
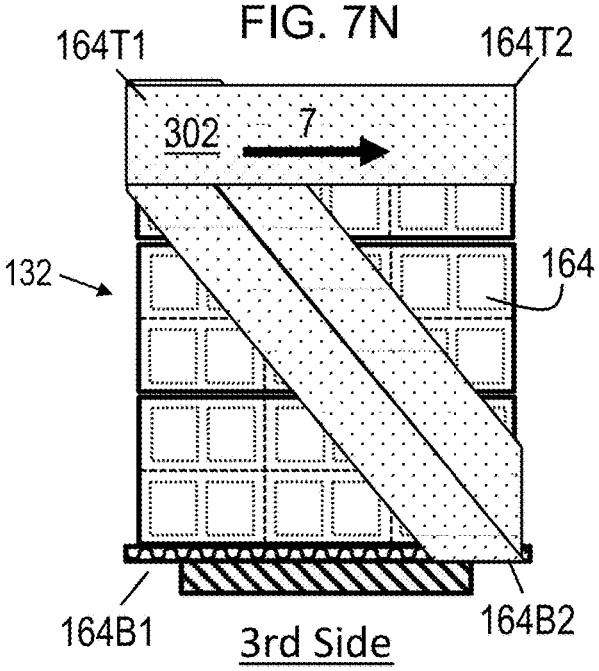
FIG. 7N is an example according to various embodiments, illustrating an isometric side view of a cargo assemblage during a seventh step of a wrapping operation.
Figure 7O:
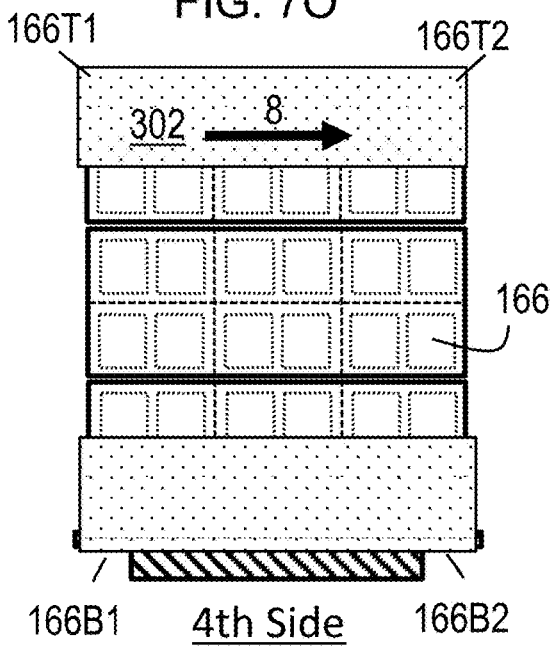
FIG. 7O is an example according to various embodiments, illustrating an isometric side view of a cargo assemblage during a eighth step of a wrapping operation.
Figure 7P:
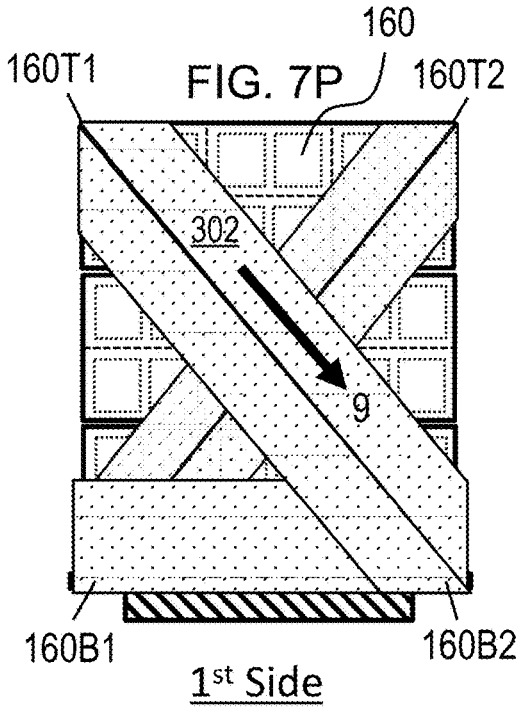
FIG. 7P is an example according to various embodiments, illustrating an isometric side view of a cargo assemblage during a ninth step of a wrapping operation.
Figure 7Q:
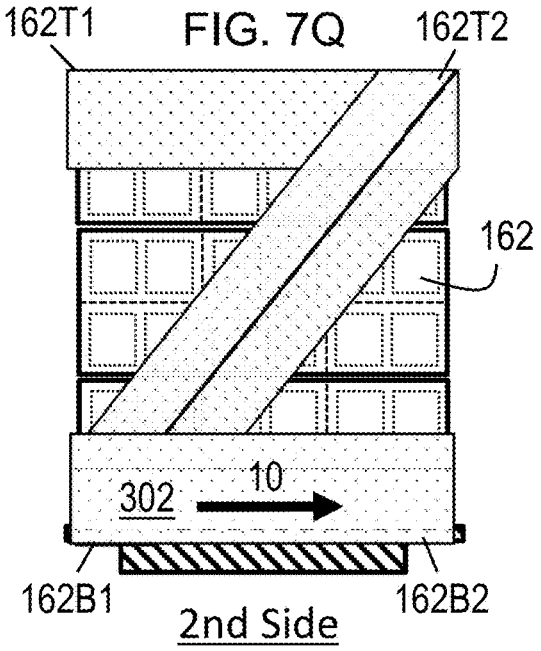
FIG. 7Q is an example according to various embodiments, illustrating an isometric side view of a cargo assemblage during a tenth step of a wrapping operation.
Figure 7R:
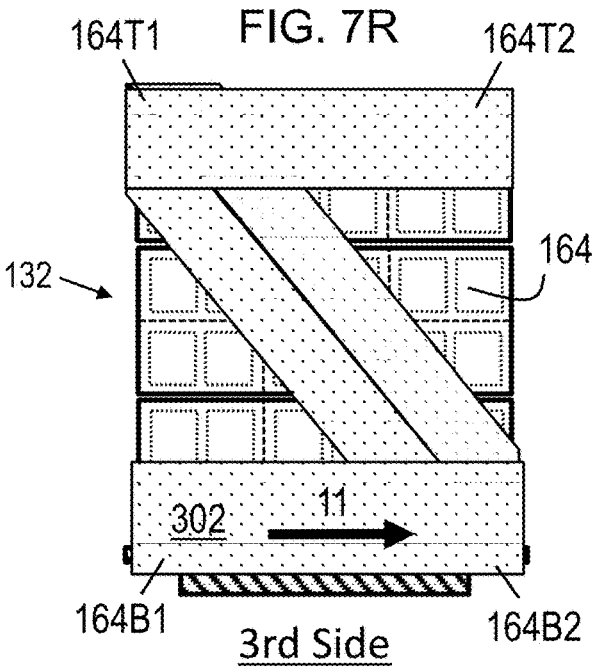
FIG. 7R is an example according to various embodiments, illustrating an isometric side view of a cargo assemblage during a eleventh step of a wrapping operation.
Figure 7S:
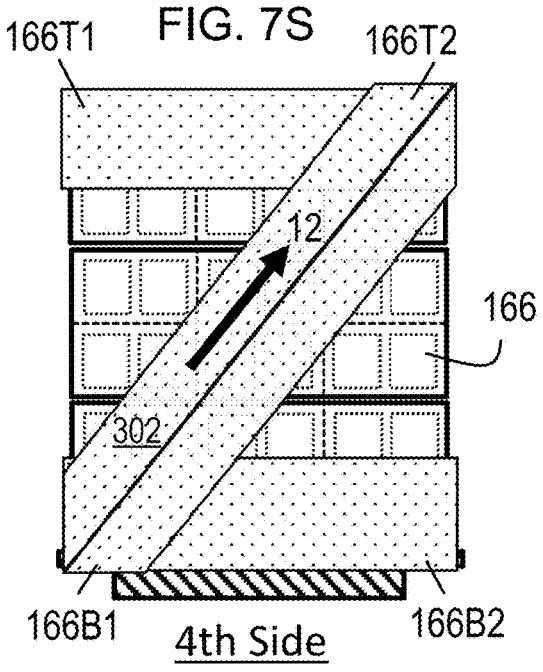
FIG. 7S is an example according to various embodiments, illustrating an isometric side view of a cargo assemblage during a twelfth step of a wrapping operation.
Figure 7T:
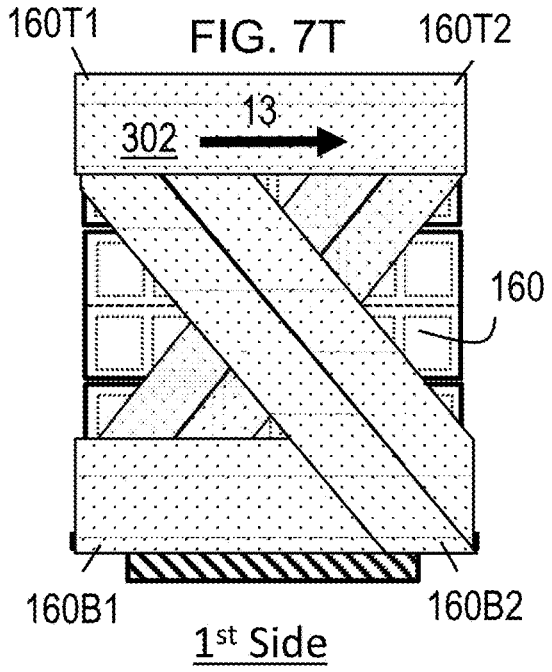
FIG. 7T is an example according to various embodiments, illustrating an isometric side view of a cargo assemblage during a thirteenth step of a wrapping operation.
Figure 7U:
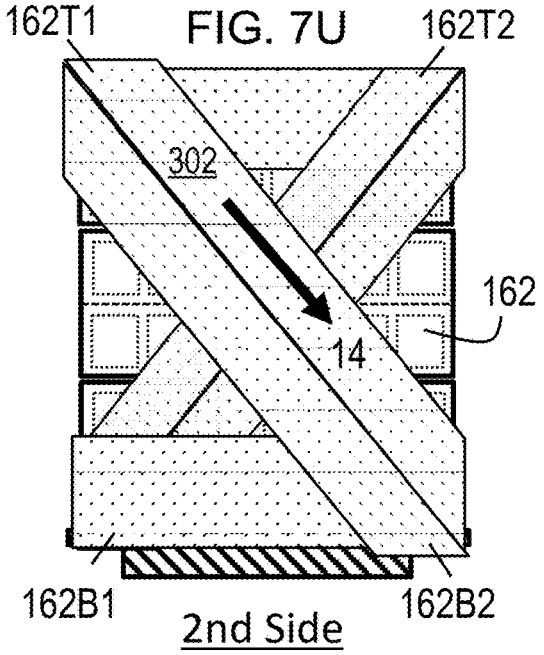
FIG. 7U is an example according to various embodiments, illustrating an isometric side view of a cargo assemblage during a fourteenth step of a wrapping operation.
Figure 7V:
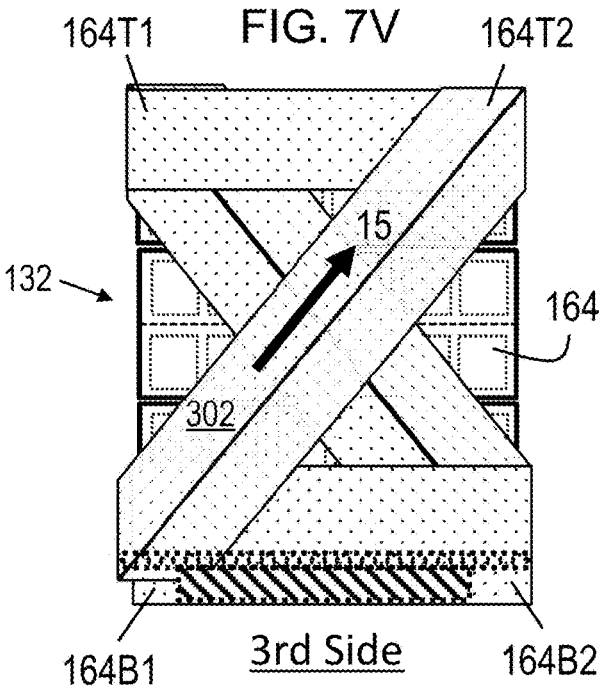
FIG. 7V is an example according to various embodiments, illustrating an isometric side view of a cargo assemblage during a fifteenth step of a wrapping operation.
Figure 7W:
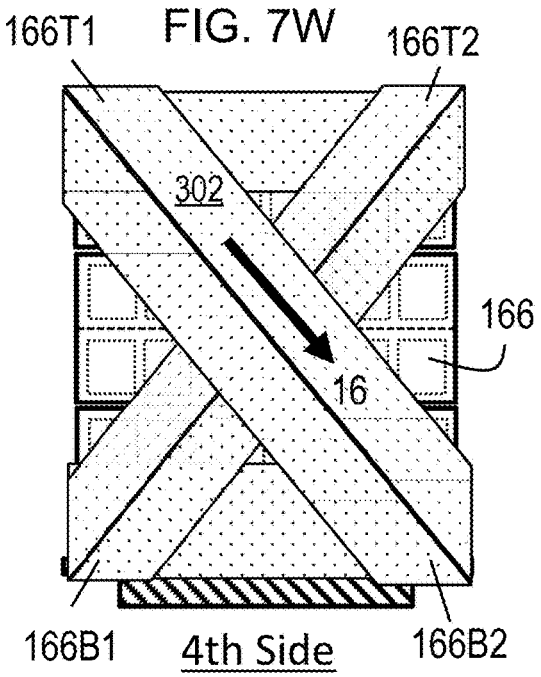
FIG. 7W is an example according to various embodiments, illustrating an isometric side view of a cargo assemblage during a sixteenth step of a wrapping operation.

FIGS. 7H, to 7W are examples according to various embodiments, illustrating side views of cargo assemblages 132, wherein the cargo assemblages 132 are being wrapped with vertically extending integration material 302, such as stretch wrap, in an angled direction relative to the support deck of the pallet 138, to apply a compressive and stabilizing force to the cargo assemblage 132. The compressive and stabilizing force may be sufficient to hold the layers in place, even when they are arranged in an overhung configuration, and even when the strength of the support layer 200 is inadequate to do so on its own. The compressive and stabilizing force may be selected based at least in part on a roll density to ensure that it does not crush any of the packages 100, which may include containers of absorbent paper product.

FIGS. 7H, to 7W are examples according to various embodiments of a process of making the cargo assemblage 132.

The various embodiments shown in FIGS. 7H to 7W illustrate a non-limiting operation in which the cargo assemblage 132 is wrapped with integration material 302. The operation shown in these figures utilizes a pattern that provides horizontal wrap at the top and at the bottom, and an upward and a downward angular wrap (e.g., cross bracing) of each side face of the cargo assemblage 132 in a minimum sixteen steps. However, various other patterns can be used to achieve various goals. For example, as shown in FIGS. 14A to 14D, a different pattern can be used to maximize lateral stability etc.

In this configuration, the cargo assemblage 132 rotates in a clockwise direction (as viewed from above) relative to a holder of a supply spool of the integration material 302. This equates to a counterclockwise application of the integration material 302 around the cargo assemblage 132 when viewed from above. In a configuration, the holder of the supply spool rotates around the cargo assemblage 302 while the cargo assemblage 302 remains stationary. In another configuration, the cargo assemblage 302 rotates while the holder of the supply spool remains stationary. In yet another configuration, the holder of the supply spool rotates around the cargo assemblage 302 and the cargo assemblage 302 rotates in an opposite direction.

FIG. 7H shows a cargo assemblage 132 including a plurality of packages 100 of rolled paper product 106 arranged in a plurality of layers 134Bot, 134M, 134T (a.k.a. sections). The angled integration material 302 may be disposed across one, two, or all three of the layers 134Bot, 134M, 134T. The cargo assemblage 132 further includes a first side face 160, a second side face 162, a third side face 164, and a fourth side face 166; a support layer 200, and optionally a pallet 138. The side faces 160 162 164 166 may be planar or non-planar.

As viewed in FIGS. 17H to 17K, each face includes a respective first top corner 160T1 162T1 164T1 166T1, a respective second top corner 160T2 162T2 164T2 166T2, a respective first bottom corner 160B1 162B1 164B1 166B1, and a respective second bottom corner 160B2 162B2 164B2 166B2.

As shown in FIG. 7H, in step 1 of the wrapping operation, the integration material 302 extends from the first bottom corner 160B1 of the first side face 160 to the second top corner 160T2 of the first side face 160. An angle 170 for each side face may be in a range of about 30 degrees to about 150 degrees, specifically reciting all 0.5% increments within the above-recited range and all ranges formed therein or thereby. The angle 170 for each side face may be in a range of about 30 degrees to about 60 degrees, specifically reciting all 0.5% increments within the above-recited range and all ranges formed therein or thereby.

The integration material 302 may also be disposed "generally horizontally", when the angle 305 is less than about 30 degrees and greater than about zero degrees, specifically reciting all 0.5% increments within the above-recited range and all ranges formed therein or thereby. The integration material 302 may also be disposed "generally horizontally", when the angle 305 is at least about 15 degrees and greater than about zero degrees, specifically reciting all 0.5% increments within the above-recited range and all ranges formed therein or thereby. The integration material 302 may also be disposed "generally horizontally", when the angle 305 is at least about 10 degrees and greater than about zero degrees, specifically reciting all 0.5% increments within the above-recited range and all ranges formed therein or thereby. In some configurations, the integration material is oriented at a 15 degree angle 170 or greater. In some configurations, the integration material is oriented at an angle 170 of about 15 degrees to about 60 degrees.

In addition, the integration material 302 may be in contact with a top surface of the load 136 as can be seen in FIG. 7H et al.

As shown in FIG. 7I, in step 2 of the wrapping operation, the integration material 302 extends from the second top corner 160T2 of the first side face 160, which is also the first top corner 162T1 of the second side face 162, to the second top corner 162T2 of the second side face 162.

As shown in FIG. 7J, in step 3 of the wrapping operation, the integration material 302 extends from the second top corner 162T2 of the second side face 162, which is also the first top corner 164T1 of the third side face 164, to the second bottom corner 164B2 of the third side face 164.

As shown in FIG. 7K, in step 4 of the wrapping operation, the integration material 302 extends from the second bottom corner 164B2 of the third side face 164, which is also the first bottom corner 166B1 of the fourth side face 166, to the second bottom corner 166B2 of the fourth side face 166.

As shown in FIG. 7L, in step 5 of the wrapping operation, the integration material 302 extends from the second bottom corner 166B2 of the fourth side face 166, which is also the first bottom corner 160B1 of the first side face 160, to the second bottom corner 160B2 of the first side face 160.

As shown in FIG. 7M, in step 6 of the wrapping operation, the integration material 302 extends from the second bottom corner 160B2 of the first side face 160, which is also the first bottom corner 162B1 of the second side face 162, to the second top corner 162T2 of the second side face 162.

As shown in FIG. 7N, in step 7 of the wrapping operation, the integration material 302 extends from the second top corner 162T2 of the second side face 162, which is also the first top corner 164T1 of the third side face 164, to the second top corner 164T2 of the third side face 164.

As shown in FIG. 7O, in step 8 of the wrapping operation, the integration material 302 extends from the second top corner 164T2 of the third side face 164, which is the first top corner 166T1 of the fourth side face 166, to the second top corner 166T2 of the fourth side face 166.

As shown in FIG. 7P, in step 9 of the wrapping operation, the integration material 302 extends from the second top corner 166T2 of the fourth side face 166, which is also the first top corner 160T1 of the first side face 160, to the second bottom corner 160B2 of the first side face 160.

As shown in FIG. 7Q, in step 10 of the wrapping operation, the integration material 302 extends from the second bottom corner 160B2 of the first side face 160, which is also the first bottom corner 162B1 of the second side face 162, to the second bottom corner 162B2 of the second side face 162.

As shown in FIG. 7R, in step 11 of the wrapping operation, the integration material 302 extends from the second bottom corner 162B2 of the second side face 162, which is also the first bottom corner 164B1 of the third side face 164, to the second bottom corner 164B2 of the third side face 164.

As shown in FIG. 7S, in step 12 of the wrapping operation, the integration material 302 extends from the second bottom corner 164B2 of the third side face 164, which is also the first bottom corner 166B1 of the fourth side face 166, to the second top corner 166T2 of the fourth side face 166.

As shown in FIG. 7T, in step 13 of the wrapping operation, the integration material 302 extends from the second top corner 166T2 of the fourth side face 166, which is also the first top corner 160T1 of the first side face 160, to the second top corner 160T2 of the first side face 160.

As shown in FIG. 7U, in step 14 of the wrapping operation, the integration material 302 extends from the second top corner 160T2 of the first side face 160, which is also the first top corner 162T1 of the second side face 162, to the second bottom corner 162B2 of the second side face 162.

As shown in FIG. 7V, in step 15 of the wrapping operation, the integration material 302 extends from the second bottom corner 162B2 of the second side face 162, which is also the first bottom corner 164B1 of the third side face 164, to the second top corner 164T2 of the third side face 164.

As shown in FIG. 7W, in step 16 of the wrapping operation, the integration material 302 extends from the second top corner 164T2 of the third side face 164, which is also the first top corner 166T1 of the fourth side face 166, to the second bottom corner 166B2 of the fourth side face 166.

At the end of step 16, each side face has been wrapped in integration material 302 horizontally at the top, horizontally at the bottom, at an angle from the first bottom corner to the second top corner, and at an angle from the first top corner to the second bottom corner. Since the integration material 302 is applied under tension, the angled portions of the integration material 302 provide vertical compressive forces that hold the cargo assemblage 132 together vertically. The angled portions of the integration material 302 also provide horizontal compressive forces that resist lateral movement of the top layer 134 T of the load 136 relative to the bottom layer 134Bot, which allows for a more stable cargo assemblage 132. The angled portions thereby act as cross bracing for the integration material 302 and provide all the structural benefits thereof to the cargo assemblage 132.

In these figures, the integration material 302 is shown wrapping not only the load 136, but also wrapping the support layer 200 and the optional pallet 138. Wrapping in this way reduces and/or prevents relative movement between the load 136, the support layer 200, and the optional pallet 138. This, in turn, further improves the overall stability of the cargo assemblage 132.

In addition, any or all of the above steps may be repeated so that multiple bands of integration material 302 are applied. Moreover, when multiple bands are applied, they may be applied in an overlapping manner so that the bands collectively cover more area than an individual band itself would cover. For example, there may be multiple bands of integration material 302 applied horizontally across the bottom of the cargo assemblage 132 to secure the load 136 to the support layer 200 and/or to the pallet 138. Similarly, there may be multiple bands of integration material 302 applied horizontally across the top of the cargo assemblage 132 and/or around the cargo assemblage 132 between the top and the bottom of the cargo assemblage 132.

Figure 7X:
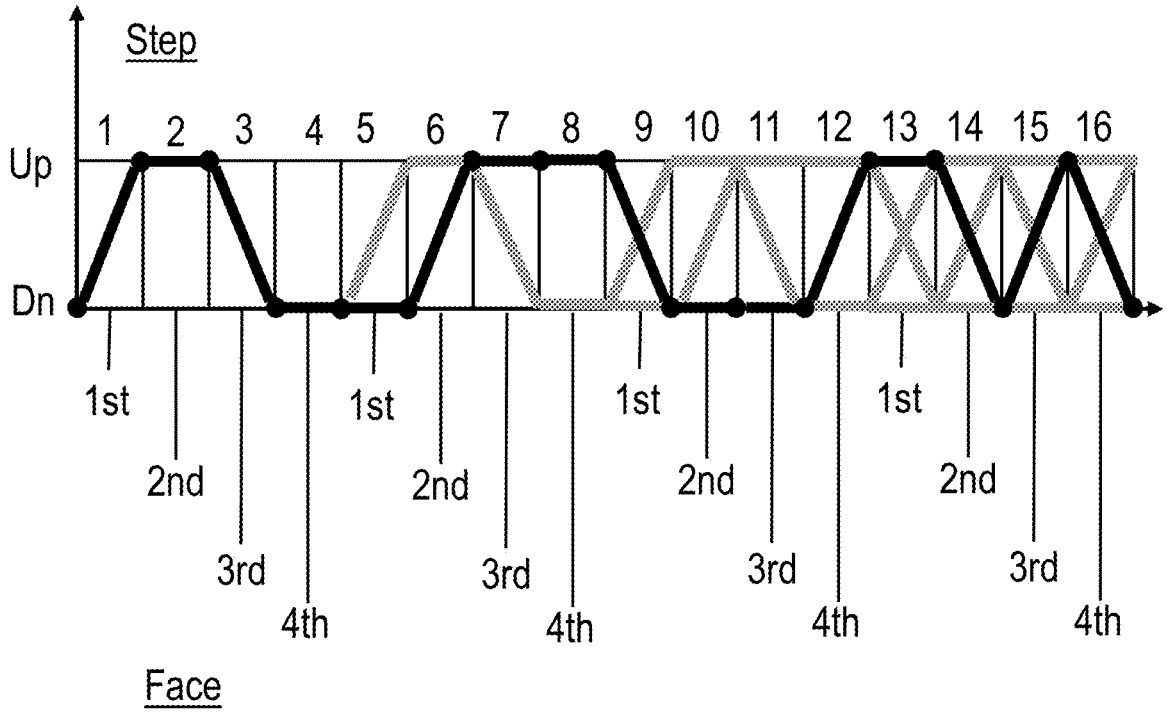
FIG. 7X is an example according to various embodiments, schematically illustrating the wrapping pattern used to wrap the cargo assemblage 132 as shown in FIG. 7H to FIG. 7W.

FIG. 7X is an example according to various embodiments, schematically illustrating the wrapping pattern used to wrap the cargo assemblage 132 as shown in FIG. 7H to FIG. 7W. The vertical axis indicates an "Up" or down "Dn" location of the integration material 302. The horizontal axis indicates the perimeter the cargo assemblage 132. Numbers 1-16 represent the steps taken to apply the integration material as shown in FIG. 7H to FIG. 7W on the respective $1^{st}$, $2^{nd}$, $3^{rd}$, and $4^{th}$ side faces 160, 162, 164, 166. The large dots indicate corners of the cargo assemblage 132 and the lines therebetween indicate the path of the integration material 302 around the cargo assemblage 132 as shown in FIG. 7H to FIG. 7W. Step 1 of FIG. 7X represents the step shown in FIG. 7H. Step 2 of FIG. 7X represents the step shown in FIG. 7I etc. This application pattern is indicated by the solid black line and requires four complete rotations of the cargo assemblage 132. Integration material already applied to the faces in prior rotations is indicated with a lighter line. As can be seen at the right end of the figure, the last four steps complete the application such that each side has horizontal integration material across the bottom, across the top, and angled integration material forming a cross brace.

Figure 7Y:
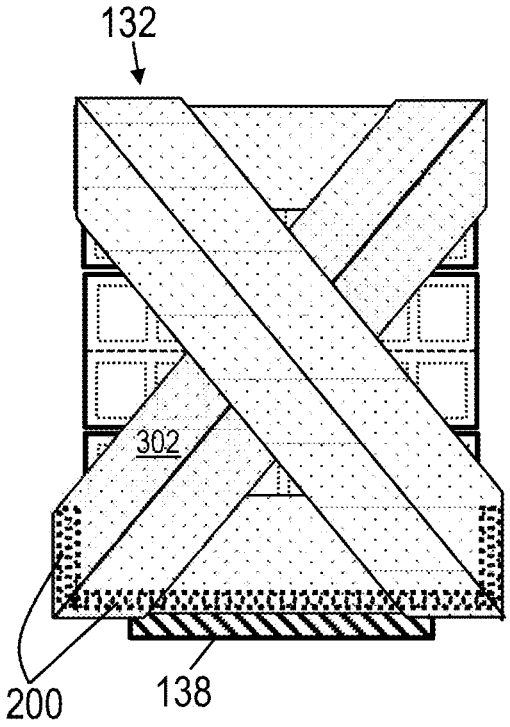
FIG. 7Y is an example according to various embodiments, illustrating a side view of a cargo assemblage 132, where the support layer folds around the load and the support layer and the load are wrapped together by the integration material.

FIG. 7Y is an example according to various embodiments, illustrating a side view of a cargo assemblage 132, where the support layer 200 folds around the load 136 and the support layer 200 and the load 136 are wrapped together by the integration material 302.

Figure 7Z:
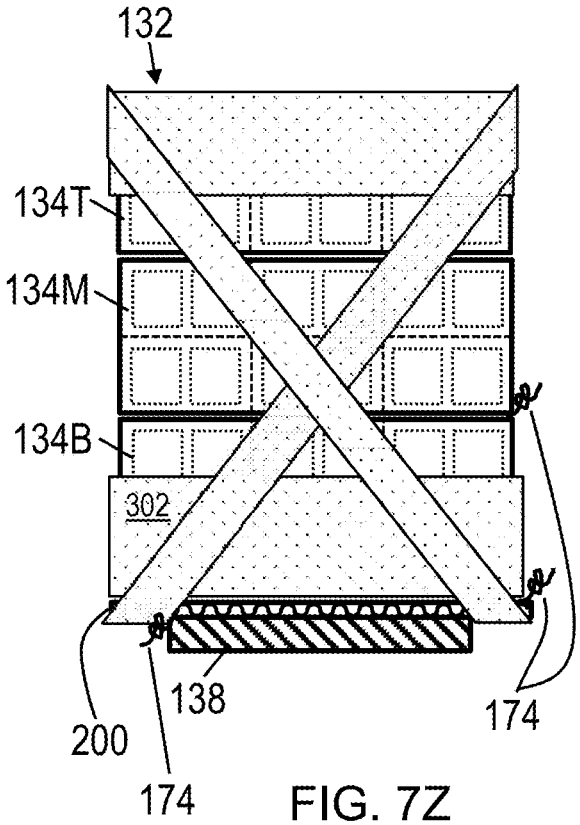
FIG. 7Z is an example according to various embodiments, illustrating a side view of a cargo assemblage, where the integration material passes under the support layer and the support layer and the load are wrapped together by the integration material.

FIG. 7Z is an example according to various embodiments, illustrating a side view of a cargo assemblage 132, wherein the integration material 302 passes under the support layer 200 and the support layer 200 and the load 136 are wrapped together by the integration material 302. In addition, ends of the integration material 302 are shown twisted into rope like sections 174 that can be tucked between parts of the cargo assemblage 132. For example, the rope like sections 174 can be tucked between the support layer 200 and the load 136, between sections of the load of the load 136 (e.g., between the bottom layer 134Bot and the middle layer 134M and/or between the middle layer 134M and the top layer 134T), and/or between the support layer 200 and the pallet 138. This roping can be implemented during or after application of the integration material 302.

Any of the wrapping techniques discloses herein may be used together with any combination of the techniques disclosed in U.S. Patent Publication No. US2022/0355958A1, which is incorporated by reference herein in its entirety, U.S. Patent Publication No. US2022/0169407A1, which is incorporated by reference herein in its entirety, and U.S. Patent Publication No. US2021/0107692A1, which is incorporated by reference herein in its entirety.

Stacking Cargo Assemblages

Figure 8A:
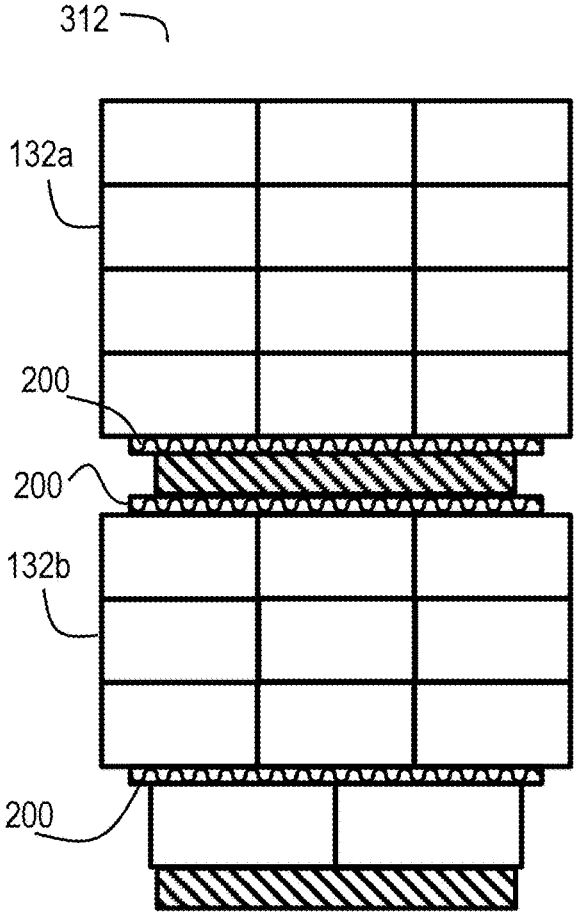
FIG. 8A is an example according to various embodiments, illustrating a cargo stack comprising a first cargo assemblage as shown in FIG. 6A stacked on top of a second cargo assemblage as shown in FIG. 6B with a support layer positioned therebetween.
Figure 8B:
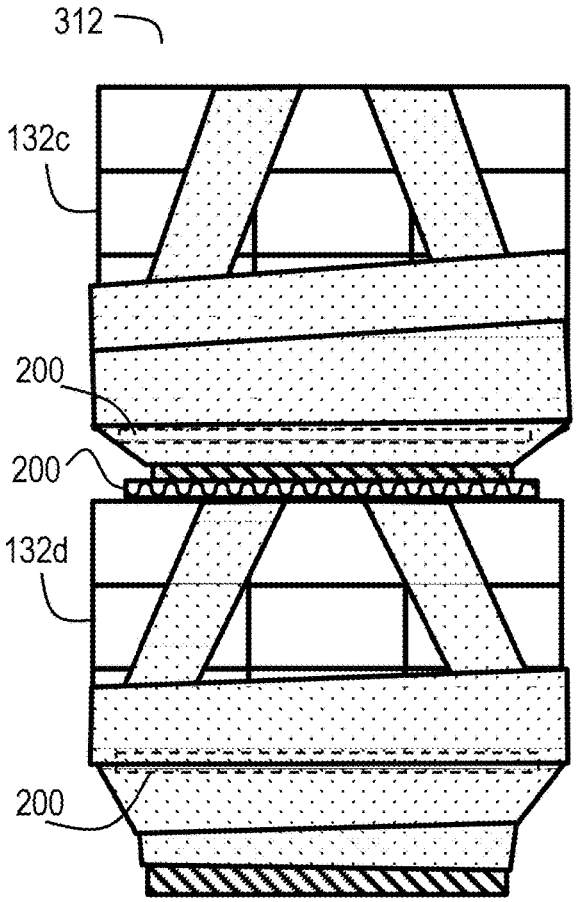
FIG. 8B is an example according to various embodiments, illustrating a cargo stack comprising a first cargo assemblage as shown in FIG. 7D stacked on top of a second cargo assemblage as shown in FIG. 7E with a support layer positioned therebetween.
Figure 8C:
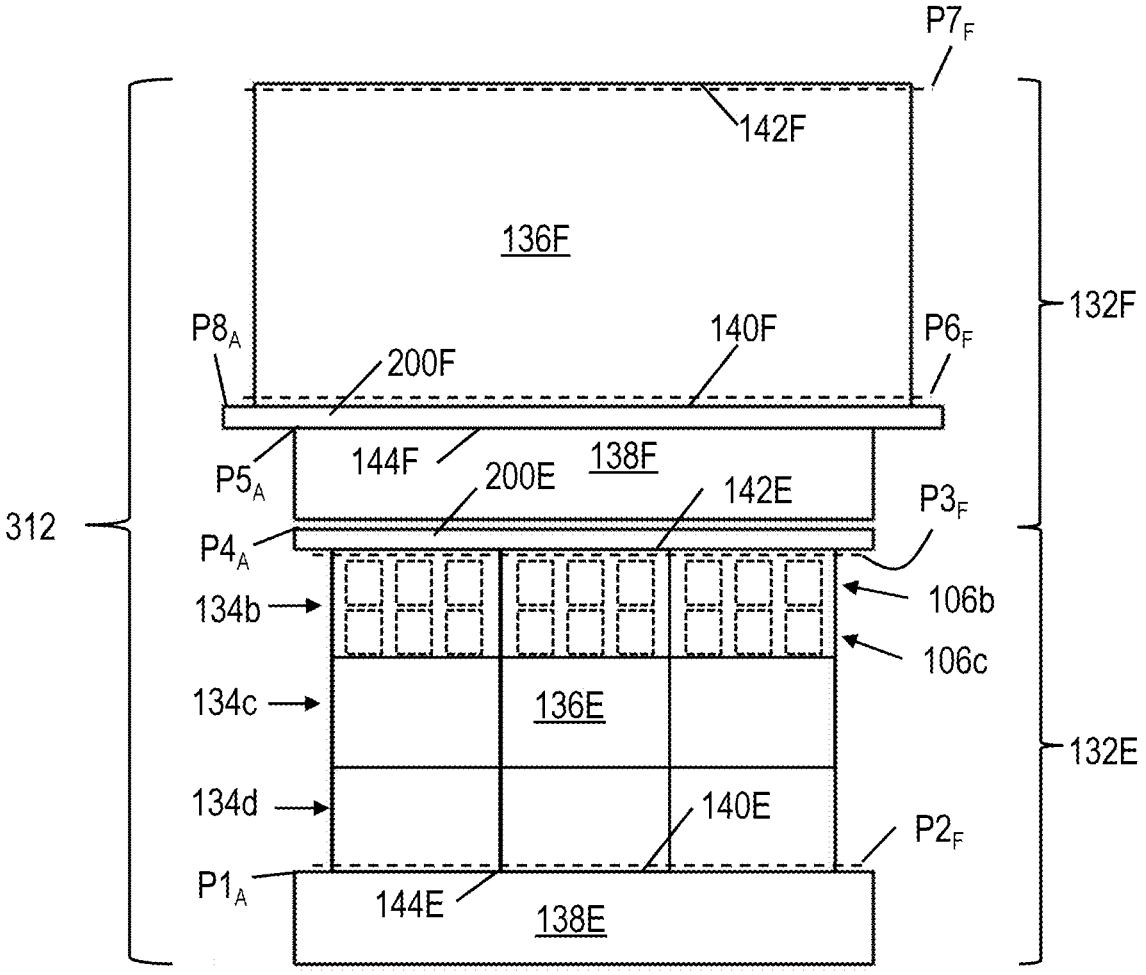
FIG. 8C is an example according to various embodiments, illustrating a cargo stack comprising a first cargo assemblage having a first support layer and a second cargo assemblage stacked on the first support layer of the first cargo assemblage.

It may be desirable to use a support layer on a top surface of a load of a first cargo assemblage to enable the placement of a second cargo assemblage onto the first cargo assemblage as illustrated in FIGS. 8A-8C. There are particular situations where a support layer becomes especially desirable on a top surface of a load. For instance, when the layer of the first cargo assemblage that the pallet of the second cargo assemblage will rest on is compromised, a support layer is desirable. Such a layer of the first cargo assemblage may be compromised by the use of larger diameter rolls (e.g., greater than about 7, 7.5, 8, 8.5, 9, 9.5, 10 inches and greater) in a sanitary tissue product layer that may result in less cores (less than 42, 40, 35, 30 cores/layer) being in the sanitary tissue product layer (e.g., 106*b*) of the first cargo assemblage that will be immediately supporting the pallet of the second cargo assemblage—less cores may result in less stability and potential failure of the sanitary tissue product layer of the first cargo assemblage that is immediately supporting a pallet of a second cargo assemblage. Another situation that may compromise the layer of the first cargo assemblage that the pallet of the second cargo assemblage will rest on is when the layer of the first cargo assemblage has a functional perimeter smaller (2, 3, 4, 5, 10, 15, or 20% smaller) than the actual perimeter of the pallet of first and/or second cargo assemblages because the smaller functional perimeter of the layer of the first cargo assemblage may not have a large enough footprint to adequately support the pallet of the second cargo assemblage. In some instances, the layer of the first cargo assemblage that will be supporting the pallet of the second cargo assemblage may have the combination of too few cores and too small of a perimeter to adequately support the pallet of the second cargo assemblage; here, use of a support layer as described herein may be used to ensure adequate stability to ensure the stacked cargo assemblage can withstand being transport and storage.

In some configurations, the layer of the first cargo assemblage upon which the second pallet rests, and more particularly, the sanitary tissue product layer upon which the second pallet rests, may have less than about 48 cores, or less than about 42 cores, or less than about 40 cores, or less than about 35 cores, or less than about 30 cores.

Any of the cargo assemblages described herein may be stacked one on top of another to form a cargo stack. In general, cargo stacks may include any number of cargo assemblages. It is to be appreciated, however, that the number of cargo assemblages that may be stacked will depend on the roll density of any rolled paper products included in the layers of the cargo assemblages. Support layers may be positioned between cargo assemblages in a cargo stack to provide additional stability and slip resistance. FIG. 8A is an example according to various embodiments, illustrating a cargo stack 312 comprising a first cargo assemblage 132*a* as shown in FIG. 6A stacked on top of a second cargo assemblage 132*b* as shown in FIG. 6B with a support layer 200 positioned therebetween. FIG. 8B is an example according to various embodiments, illustrating a cargo stack 312 comprising a first cargo assemblage 132*c* as shown in FIG. 7D stacked on top of a second cargo assemblage 132*d* as shown in FIG. 7E with a support layer 200 positioned therebetween. It is to be appreciated that additional layers of both vertically extending and horizontally extending an integration material, such as stretch wrap, may be wrapped around the stacks to provide additional stability.

FIG. 8C is an example according to various embodiments illustrating a cargo stack 312 comprising a first cargo assemblage 132E having a first support layer 200E and a second cargo assemblage 132F stacked on the first support layer 200E of the first cargo assemblage 132E.

The first cargo assemblage 132E includes a first pallet 138E having a first support deck 144E defining a first actual perimeter $P1_A$, a first load 136E comprising a first plurality of packages of first rolled sanitary tissue products, the first load 136E having a first bottom surface 140E defining a second functional perimeter $P2_F$, the load 136E having a first top surface 142E defining a third functional perimeter $P3_F$, and a first support layer 200E defining a fourth actual perimeter $P4_A$. The first support layer 200E is disposed on the first top surface 142E.

The second cargo assemblage 132F comprises a second pallet 138F having a second support deck 144F defining a fifth actual perimeter $P5_A$, a second load 136F comprising a second plurality of packages of second rolled products, the second load 136F having a second bottom surface 140F defining a sixth functional perimeter $P6_F$, the second load 136F having a second top surface 142F defining a seventh functional perimeter $P7_F$.

Figure 9:
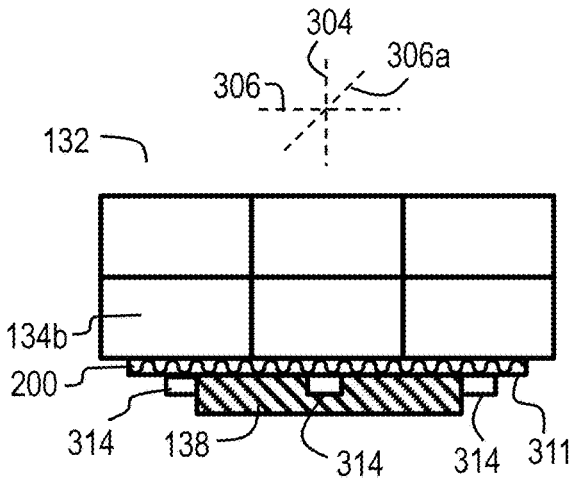
FIG. 9 is an example according to various embodiments, illustrating a cargo assemblage comprise a support layer having bumpers.

A second support layer 200F defines an eighth actual perimeter $P8_A$, wherein the second support layer 200F is disposed between the first top surface 142E and the second bottom surface 140F, and wherein the eighth actual perimeter $P8_A$ of the second support layer 200F is greater than at least one of the first actual perimeter $P1_A$ of the first pallet 138E and the fifth actual perimeter $P5_A$ of the second pallet 138F. Securing a Support Layer to a Pallet or an Underlying Layer Any of the support layers described herein may optionally be secured to a pallet or to an underlying layer. FIG. 9 is an example according to various embodiments, illustrating a cargo assemblage 132 comprising a support layer 200 between the bottom layer 134*a* and the pallet 138. The support layer 200 includes having a plurality of bumpers 314 attached to its bottom surface 311. The bumpers 314 may be adapted to align the support layer 200 to the pallet 138 and/or to reduce or to eliminate any tendency for the support layer 200 to slide on the surface of the pallet along either a first lateral axis 306 or a second lateral axis 306*a*. The bumpers 314 may be pre-installed on the support layer 200, in which case the support layer 200 may be lowered along a vertical axis 304 into position on the pallet 138. Alternatively, the bumpers 314 may be affixed to the bottom surface 311 after the support layer 200 is placed on the pallet. It is to be appreciated that bumpers 314 may also be employed on support layers that are positioned on top of or between layers 134.

Figure 10:
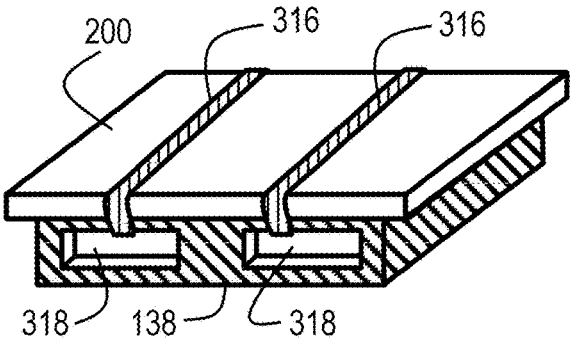
FIG. 10 is an example according to various embodiments, illustrating a support layer strapped to a pallet with a plurality of straps.

FIG. 10 is an example according to various embodiments, illustrating a support layer 200 strapped to a pallet 138 with a plurality of straps 316. One or more straps 316 may be employed. The straps 316 may extend over the support layer 200 and pass-through gaps 318 in the structure of the pallet 138. The gaps 318 may the standard holes through which the tines of a forklift pass or may be installed specifically to accommodate the straps 316.

Figure 11A:
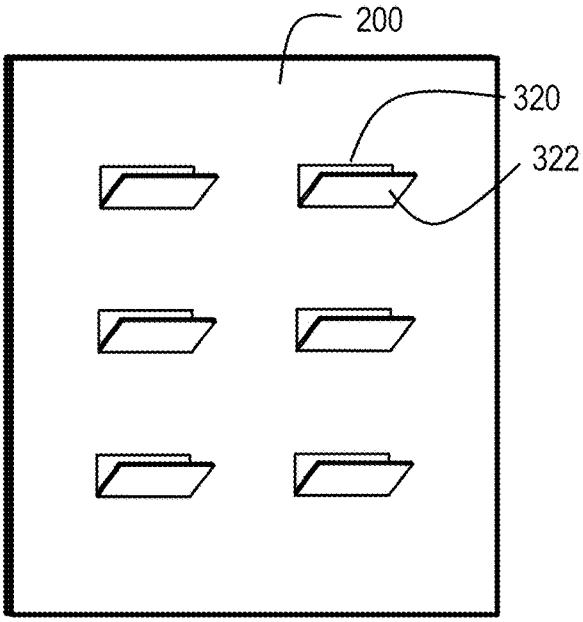
FIG. 11A is an example according to various embodiments, illustrating a support layer comprising a plurality of partial cutouts, folded to produce flaps.

FIG. 11A is an example according to various embodiments, illustrating a support layer 200 comprising a plurality of partial cutouts 320, folded to produce flaps 322. The cutouts 320 and flaps 322 may be positioned on the surface of the support layer 200 to correspond with gaps in the support deck 144 of a pallet 138 to provide a similar function as the bumpers 314 described with respect to FIG. 9, in that the flaps 322 may resist slippage in either lateral direction across the surface of the pallet 138. The flaps 322 may also help to align the support layer 200 to the pallet 138. Additionally or alternatively, one or more of the flaps 322 may be folded in the opposite direction and may be positioned to guide placement of packages 100 to ensure an efficiently tessellation on the surface of the support layer 200. The partial cutouts 320 and flaps 322 are illustrated as having rectangular shapes, but it is to be appreciated that any shape may be employed.

Figure 11B:
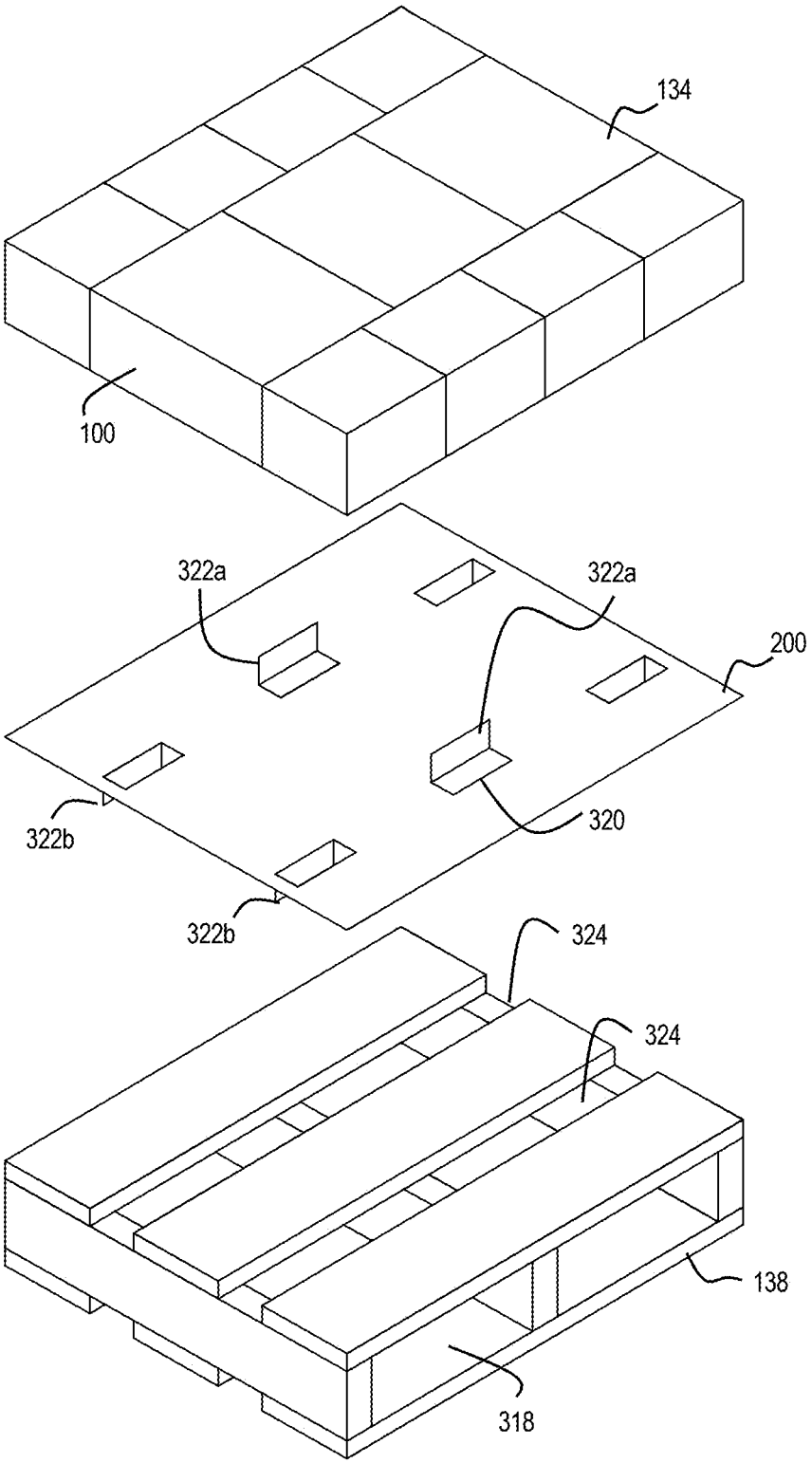
FIG. 11B is an example according to various embodiments, illustrating an exploded view of a support layer as shown in FIG. 11A in association with a pallet and a plurality of packages

FIG. 11B is an example according to various embodiments, illustrating an exploded view of a support layer 200 as shown in FIG. 11A in association with a pallet 138 and a layer 134 of packages 100. As shown, the support layer 200 includes both upwardly extending flaps 322*a* and downwardly extending flaps 322*b*. The upwardly extending flaps 322*a* may guide placement of packages 100 to ensure an efficiently tessellation on the surface of the support layer 200. The downwardly extending flaps 322*b* may align with the gaps 324 in the support deck 144 of the pallet 138 to resist slippage in either lateral direction across the surface of the pallet 138.

According to various embodiments, an integration material may be used to combine the pallet, product, and support layer into an integrated unit load. The integration material may prevent movement of the product relative to the pallet thus reducing damage to the product and instability during shipment. Integration materials can be adhesives, stretch wrap, tape, banding, and additives to increase coefficient of friction. The support layer allows for more consumer product per layer (thus a larger perimeter) on a given pallet size while reducing or eliminating damage to the product.

Vertical Structures Within a Cargo Assemblage

Figure 12A:
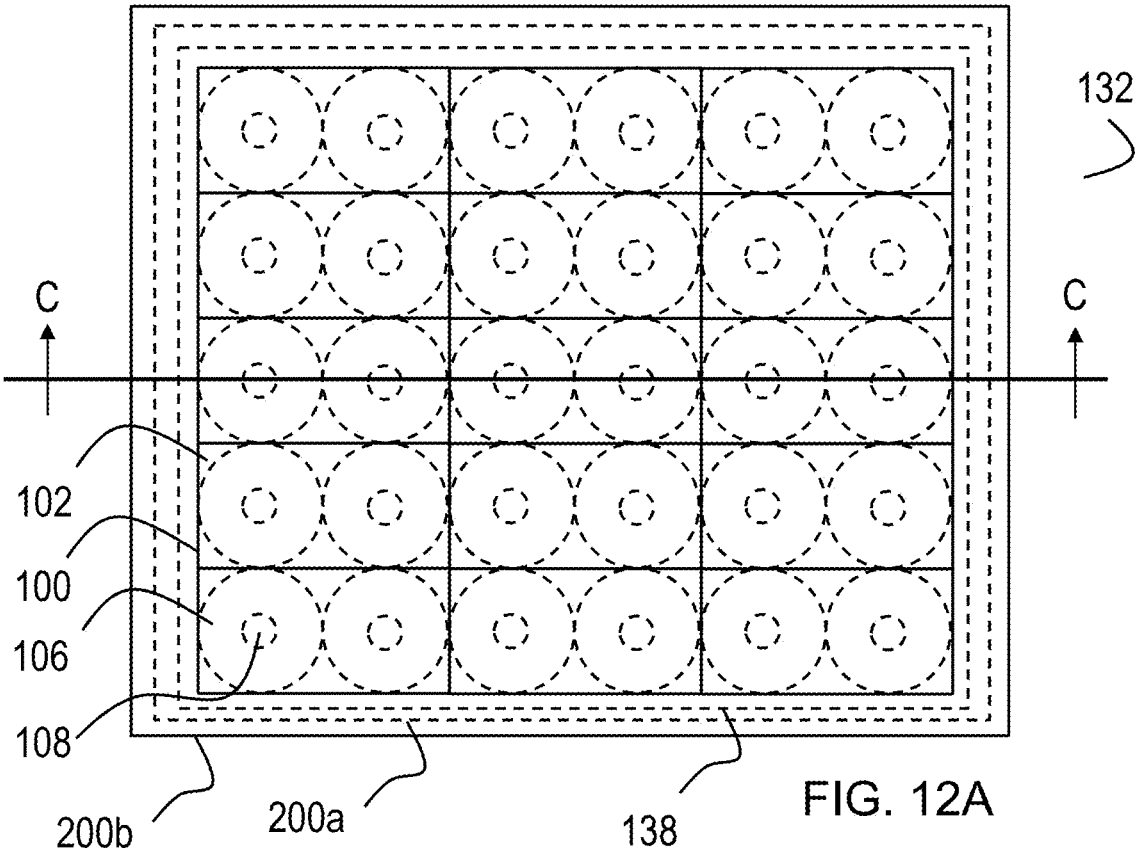
FIG. 12A is an example according to various embodiments, illustrating a top view of a cargo assembly showing the position of a plurality of cores.
Figure 12B:
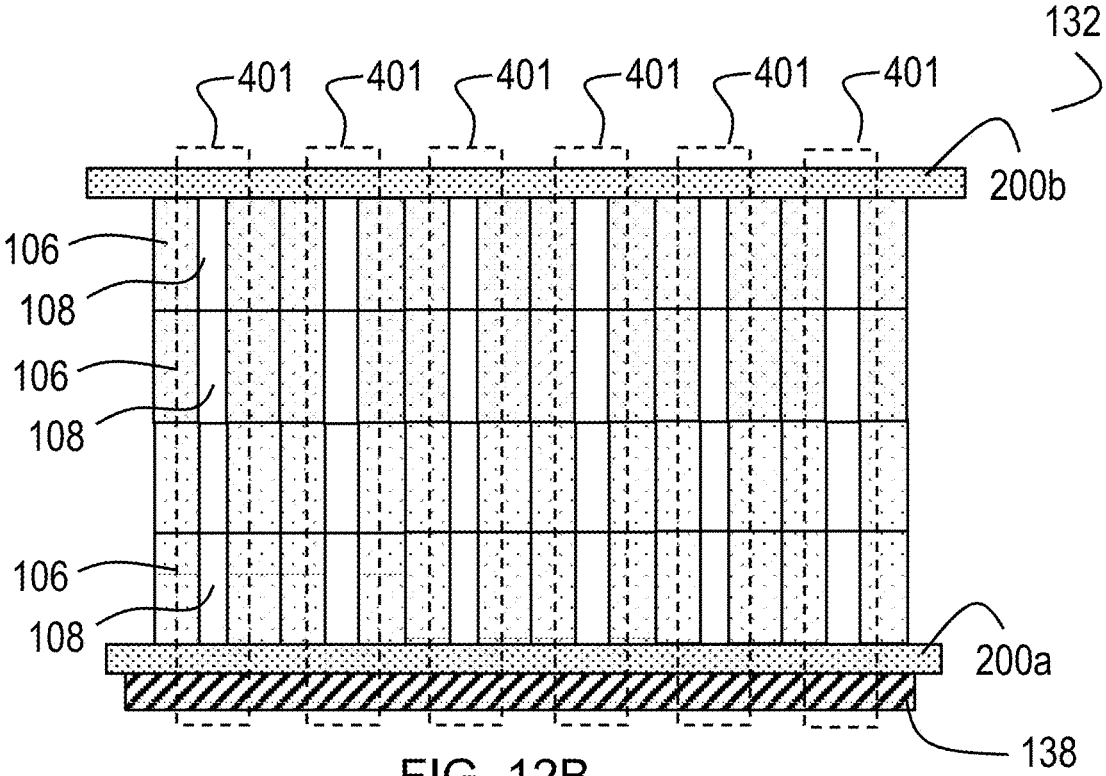
FIG. 12B is an example according to various embodiments, illustrating a section view along line C-C in FIG. 12A, illustrating vertical structures formed by cores and support layers.

FIG. 12A is an example according to various embodiments, illustrating a top view of a cargo assemblage 132 showing the position of a plurality of packages 100, comprising containers 102 holding rolled paper products 106 having cores 108. FIG. 12B is an example according to various embodiments, illustrating a section view along line C-C in FIG. 12A, illustrating vertical structures 401. The vertical structures 401 are formed via interaction of a plurality of components, including a plurality of vertically stacked cores 108, and at least one of a first support layer 200*a*, a second support layer 200*b*, and a pallet 138. The vertical structures 401 may add stability to the cargo assembly.

Some of the vertical structures 401 may be interrupted when cores 108 don't align vertically. When this happens, the stability of the cargo assembly may be supported by the percentage of cores 108 that do align continually from a top surface of the load or from a support layer disposed at a top surface to a pallet or to a support layer disposed at a lower portion of the load. Such non-alignment (wherein a central axis of a core is shifted at least one diameter away, such that there is no overlap of the cores) of cores 108 may be due to non-uniform packages (e.g., packages having different numbers of rolls, packages of different diameter rolls, different types of product packages, etc.) of rolls being placed on a pallet together. Often, such packages are flexible such as film (and exclude cardboard), which offers little support. In some cases, less than about 80%, about 70%, about 60%, about 50%, about 40%, or about 30% and may be greater than about 5%, specifically reciting all 0.5% increments within the above-recited ranges and all ranges formed therein or thereby, (these percentages at a particular cross-section or the load as a whole) of the cores continually align from a top surface of the load or from a support layer disposed at a top surface to the pallet or to a support layer disposed at a lower portion of the load, which may make the effect of a support layer more important.

In some embodiments, a portion of a support layer that overhangs a pallet may directly support one or more cores or one or more cores that form the vertical structures 401. The portion of the support layer that overhangs the pallet should be rigid enough to adequately support that portion of the load—particularly, the core and/or vertical structure 401 that terminates at a portion of a support layer overhanging the pallet.

Figure 13A:
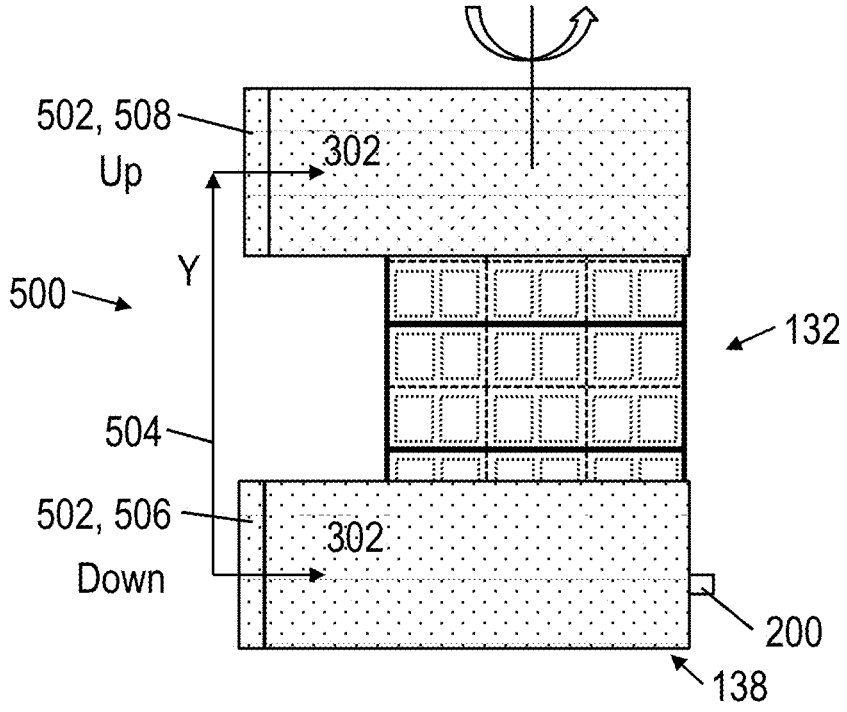
FIG. 13A is an example according to various embodiments, illustrating a wrapping machine selectively applying integration material at a down location and at an up location.

FIG. 13A is an example according to various embodiments, illustrating a wrapping machine 500 selectively applying integration material 302 to a cargo assemblage 132 at a down location and at an up location. In this configuration, the wrapping machine 500 rotates relative to the cargo assemblage 132 in a counterclockwise direction as viewed from above. This equates to a clockwise application of the integration material 302 around the cargo assemblage 132 when viewed from above. The wrapping machine 500 includes a single integration material holder 502 that can be moved parallel to a vertical axis 504 between the down "Dn" position 506 and the "up" position 508. The integration material holder 502 unwinds a spool of the integration material 302 onto the cargo assemblage 132. In another configuration, the material holder 502 rotates around the cargo assemblage 302 while the cargo assemblage 302 remains stationary. In yet another configuration, the material holder 502 rotates around the cargo assemblage 302 and the cargo assemblage 302 rotates in an opposite direction.

The integration material 302 is applied horizontally when the integration material holder 502 is held in a same position along the vertical axis 504 while the integration material 302 is being applied to the cargo assemblage 132.

Figure 13B:
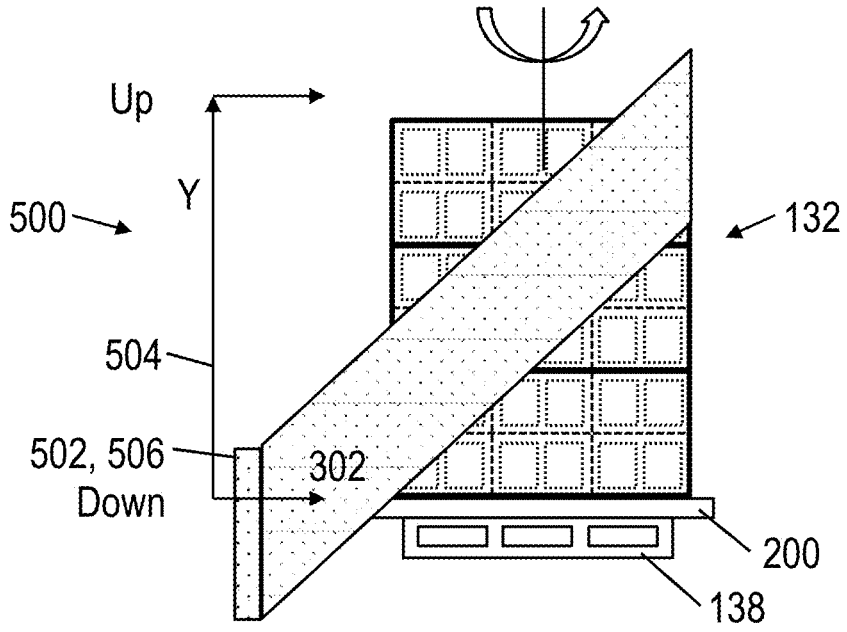
FIG. 13B is an example according to various embodiments, illustrating a wrapping machine applying integration material at an angle starting from an up location and leading to a down location.

FIG. 13B is an example according to various embodiments, illustrating a wrapping machine applying integration material at an angle starting from an up location and leading to a down location. As can be seen in this figure, the integration material 302 is applied at a downward angle when the integration material holder 502 is moved downward along the vertical axis 504 while being applied to the cargo assemblage 132. This technique is used to form a first part of the cross bracing disclosed herein.

Figure 13C:
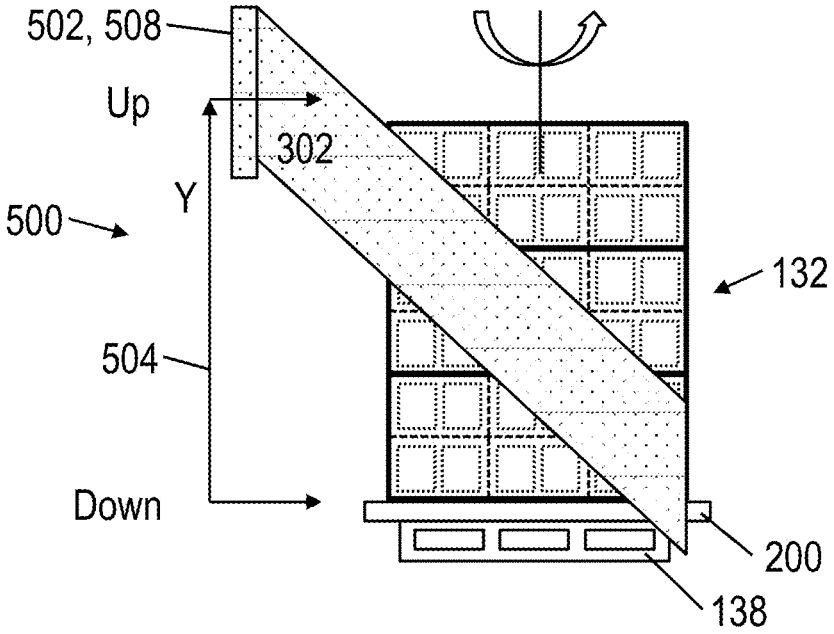
FIG. 13C is an example according to various embodiments, illustrating a wrapping machine applying integration material at an angle starting from a down location and leading to an up location.

FIG. 13C is an example according to various embodiments, illustrating a wrapping machine applying integration material at an angle starting from a down location and leading to an up location. As can be seen in this figure, the integration material 302 is applied at an upward angle when the integration material holder 502 is moved upward along the vertical axis 504 while being applied to the cargo assemblage 132. This technique is used to form a second part of the cross bracing disclosed herein.

The various embodiments shown in FIGS. 14A to 14D. The operation shown in these figures utilizes a pattern that provides four bands of integration material 302. Each band provides vertical and horizontal compressive force on the cargo assemblage 132. Each band experiences pure tension throughout its entire length and therefore takes full advantage of the tensile strength of the integration material 302. The bands are disposed at ninety (90) degrees from each other. Collectively, the horizontal forces of the bands resist movement of the top of the cargo assemblage 132 relative to the bottom in all four horizontal directions, thereby providing maximum lateral stability of the top of the cargo assemblage 132.

Figure 14A:
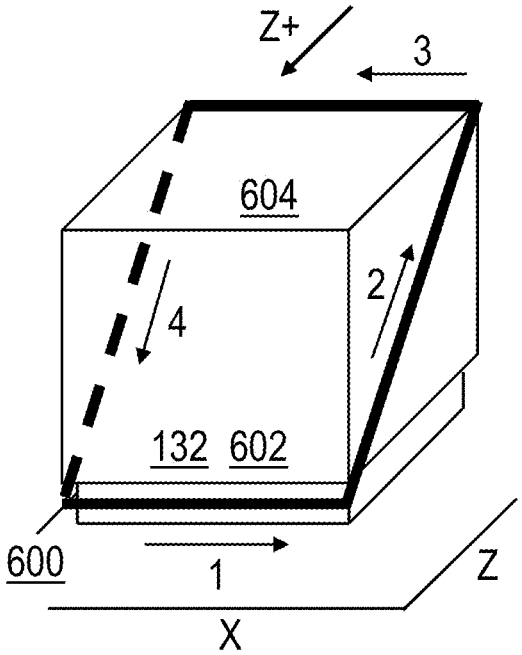
FIG. 14A is an example according to various embodiments, illustrating an isometric view of a cargo assemblage during steps one to four of a wrapping operation.

FIG. 14A is an example according to various embodiments, illustrating an isometric view of a cargo assemblage 132 during steps one to four of a wrapping operation. Steps one to four result in a first band 600 that is in tension and that thereby provides a vertical compressive force and a horizontal compressive force along the Z axis. Since the first band 600 is anchored to a bottom 602 of the cargo assemblage 132 as shown (e.g., in the front), the first band 600 resists movement of a top 604 of the cargo assemblage 132 in the Z− direction (rearward into the page) relative to the bottom 604 of the cargo assemblage 132.

Figure 14B:
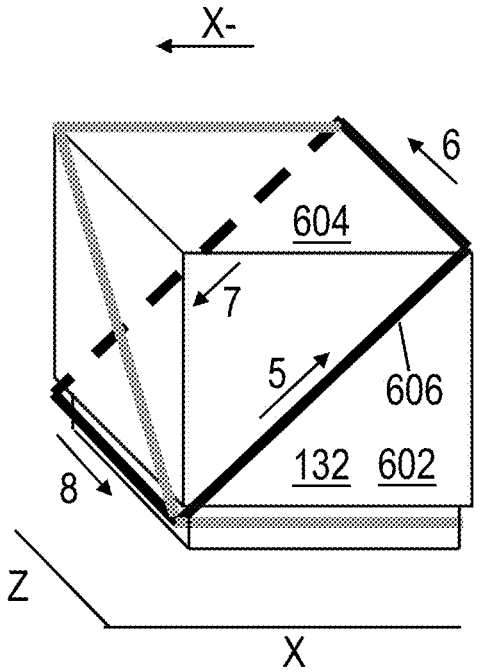
FIG. 14B is an example according to various embodiments, illustrating an isometric view of a cargo assemblage during steps five to eight of a wrapping operation.

FIG. 14B is an example according to various embodiments, illustrating an isometric view of a cargo assemblage 132 during steps five to eight of a wrapping operation. Steps five to eight result in a second band 606 that is in tension and that thereby provides a vertical compressive force and a horizontal compressive force along the X axis. Since the second band 606 is anchored to the bottom 602 of the cargo assemblage 132 as shown (e.g., on the left side), the second band 606 resists movement of the top 604 of the cargo assemblage 132 in the X+ direction (to the right) relative to the bottom 604 of the cargo assemblage 132.

Figure 14C:
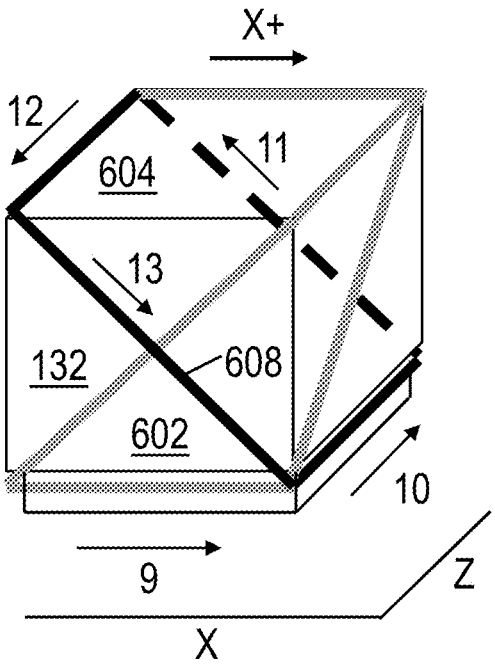
FIG. 14C is an example according to various embodiments, illustrating an isometric view of a cargo assemblage during steps nine to thirteen of a wrapping operation.

FIG. 14C is an example according to various embodiments, illustrating an isometric view of a cargo assemblage 132 during steps nine to thirteen of a wrapping operation. Steps nine to thirteen result in a third band 608 that is in tension and that thereby provides a vertical compressive force and a horizontal compressive force along the X axis. Since the third band 606 is anchored to the bottom 602 of the cargo assemblage 132 as shown (e.g., on the right side), the third band 606 resists movement of the top 604 of the cargo assemblage 132 in the X− direction (to the left) relative to the bottom 604 of the cargo assemblage 132. The third band 608 also acts opposite to the second band 606 so that the top of the cargo assemblage 132 is centered by the second band 606 and the third band 608 while the second band 606 and the third band 608 are in equilibrium with each other.

Figure 14D:
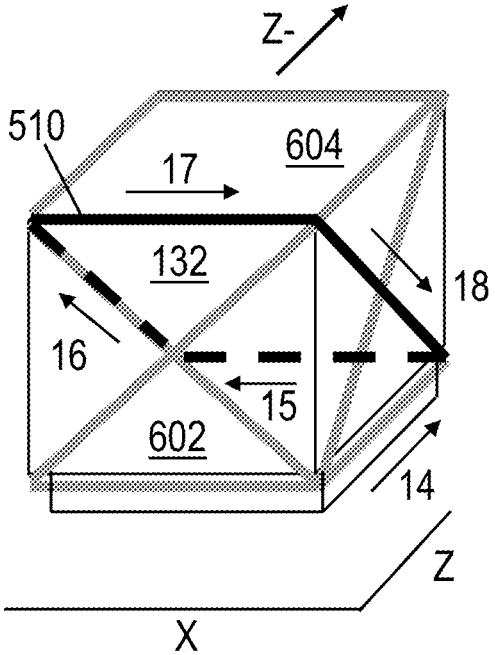
FIG. 14D is an example according to various embodiments, illustrating an isometric view of a cargo assemblage during steps fourteen to eighteen of a wrapping operation.

FIG. 14D is an example according to various embodiments, illustrating an isometric view of a cargo assemblage 132 during steps fourteen to eighteen of a wrapping operation. Steps fourteen to eighteen result in a fourth band 610 that is in tension and that thereby provides a vertical compressive force and a horizontal compressive force along the Z axis. Since the fourth band 610 is anchored to the bottom 602 of the cargo assemblage 132 as shown (e.g., on the rear side), the fourth band 610 resists movement of the top 604 of the cargo assemblage 132 in the Z+ direction (out of the page) relative to the bottom 604 of the cargo assemblage 132. The fourth band 610 also acts opposite to the first band 600 so that the top of the cargo assemblage 132 is centered by the first band 600 and the fourth band 610 while the first band 600 and the fourth band 610 are in equilibrium with each other.

The bands are positioned at ninety (90) degrees to each other and operate in almost pure tension. They collectively resist movement of the top 604 of the cargo assemblage 132 relative to the bottom 602 of the cargo assemblage 132 in all four horizontal directions. This provides maximum stability and maximum strength. A horizontal band at the top 604 or the bottom 602 can be applied as desired to further increase stability of the cargo assemblage 132.

Aspects of the Invention

A cargo assemblage including: a pallet, having a support deck defining a first actual perimeter; a load including a plurality of packages of rolled sanitary tissue products arranged in one or more layers, including at least one layer comprising optionally a bottom layer, optionally a middle layer and optionally a top layer, the load having a bottom surface defining a second functional perimeter, the load also having a top surface defining a third functional perimeter; a support layer defining a fourth actual perimeter, wherein the support layer is sized and positioned within the cargo assemblage to allow at least one of the second functional perimeter and the third functional perimeter to be about 105% to about 150% of the first actual perimeter; and an integration material in communication with at least the pallet and the load.

A cargo assemblage including: a pallet, having a support deck defining a first actual perimeter; a load including a plurality of packages of rolled sanitary tissue products arranged in one or more layers, including at least one layer comprising optionally a bottom layer, optionally a middle layer, and optionally a top layer, the load having a bottom surface defining a second functional perimeter, the load having a top surface defining a third functional perimeter; a support layer defining a fourth actual perimeter, wherein the support layer is disposed on the top surface and has a rigidity and coefficient of friction adequate to support a second cargo assemblage; and an integration material in communication with at least the pallet and the load.

A cargo assemblage including: a pallet, having a support deck defining a first actual perimeter; a load including a plurality of packages of rolled products sanitary tissue arranged in one or more layers, including at least a bottom layer and optionally a top layer, the bottom layer having a bottom surface defining a second functional perimeter, the optional top layer having a top surface defining a third functional perimeter; and a band of integration material generally vertically oriented and in communication with at least one of a top surface of the optional top layer and a support layer, and also in communication with at least one of the pallet, a bottom surface of the bottom layer, and a second support layer.

A cargo assemblage including: a pallet having a support deck defining a first actual perimeter; a load including a plurality of packages of rolled sanitary tissue products arranged in one or more layers, including at least one layer comprising an optional top layer, an optional middle layer, and an optional bottom layer, the load having a bottom surface defining a second functional perimeter, the load having a top surface defining a third functional perimeter; and a band of integration material oriented at a 15 degree angle or greater and in communication with at least one of the pallet, the bottom surface, the top surface, and the support layer.

A cargo assemblage including: a load including a plurality of packages of rolled products arranged in a plurality of layers, the load including a bottom section, a top section, and a middle section; wherein the load further comprises a first side face, a second side face, a third side face, and a fourth side face; a support layer and optionally a pallet; wherein the load overhangs at least a portion of the at least one of the support layer and pallet; and wherein integration material is disposed at an angle across at least one of the top, bottom, and middle sections on at least one of the first, second, third, and fourth side faces.

A process of making a cargo assemblage, including the steps of: wrapping a load and a support layer and optionally a pallet with an integration material; wherein the load comprises a plurality of packages of rolled products arranged in a plurality of layers, including at least a bottom section, a top section, and a middle section; wherein the load further comprises a first side face, a second side face, a third side face, and a fourth side face; and wherein the integration material is disposed at an angle across at least one of the top, bottom, and middle sections on at least one of the first, second, third, and fourth side faces.

A cargo assemblage including: a load including a plurality of packages of rolled products arranged in a plurality of layers, the load including a bottom section, a top section, and a middle section; wherein the load further comprises a first side face, a second side face, a third side face, and a fourth side face; and at least one of a support layer and a pallet; wherein the load overhangs at least a portion of the at least one of the support layer and pallet; and wherein an integration material is disposed at an angle of greater than 10 degrees across at least one of the top, bottom, and middle sections on at least one of the first, second, third, and fourth side faces.

A stacked cargo assemblage comprising: a first cargo assemblage comprising a first pallet having a first support deck defining a first actual perimeter; a first load comprising a first plurality of packages of first rolled sanitary tissue products, the first load having a first bottom surface defining a second functional perimeter, the load having a first top surface defining a third functional perimeter; a first support layer defining a fourth actual perimeter, wherein the first support layer is disposed on the first top surface; a second cargo assemblage comprising a second pallet having a second support deck defining a fifth actual perimeter, a second load comprising a second plurality of packages of second rolled products, the second load having a second bottom surface defining a sixth functional perimeter, the second load having a second top surface defining a seventh functional perimeter; and a second support layer defining an eighth actual perimeter, wherein the second support layer is disposed between the second top surface and the first bottom surface, and wherein the eighth actual perimeter of the second support layer is greater than at least one of the first actual perimeter of the first pallet and the fifth actual perimeter of the second pallet.

The cargo assemblage, the process of making a cargo assemblage, or the stacked cargo assemblage according to any of the preceding and proceeding paragraphs of this Aspects of the Invention Section, as applicable, wherein the at least one layer comprises rolled sanitary tissue products having an average diameter of about 7 inches or greater.

The cargo assemblage, the process of making a cargo assemblage, or the stacked cargo assemblage according to any of the preceding and proceeding paragraphs of this Aspects of the Invention Section, as applicable, wherein the at least one layer comprises rolled sanitary tissue products having an average diameter of about 7.5 inches or greater.

The cargo assemblage, the process of making a cargo assemblage, or the stacked cargo assemblage according to any of the preceding and proceeding paragraphs of this Aspects of the Invention Section, as applicable, wherein the at least one layer comprises rolled sanitary tissue products having an average diameter of about 8 inches or greater.

The cargo assemblage, the process of making a cargo assemblage, or the stacked cargo assemblage according to any of the preceding and proceeding paragraphs of this Aspects of the Invention Section, as applicable, wherein the at least one sanitary tissue product layer comprises rolled sanitary tissue products having less than about 48 cores.

The cargo assemblage, the process of making a cargo assemblage, or the stacked cargo assemblage according to any of the preceding and proceeding paragraphs of this Aspects of the Invention Section, as applicable, wherein the at least one sanitary tissue product layer comprises rolled sanitary tissue products having less than about 42 cores.

The cargo assemblage, the process of making a cargo assemblage, or the stacked cargo assemblage according to any of the preceding and proceeding paragraphs of this Aspects of the Invention Section, as applicable, wherein the at least one sanitary tissue product layer comprises rolled sanitary tissue products having less than about 40 cores.

The cargo assemblage, the process of making a cargo assemblage, or the stacked cargo assemblage according to any of the preceding and proceeding paragraphs of this Aspects of the Invention Section, as applicable, wherein the at least one sanitary tissue product layer comprises rolled sanitary tissue products having less than about 35 cores.

The cargo assemblage, the process of making a cargo assemblage, or the stacked cargo assemblage according to any of the preceding and proceeding paragraphs of this Aspects of the Invention Section, as applicable, wherein the at least one sanitary tissue product layer comprises rolled sanitary tissue products having less than about 30 cores.

The cargo assemblage, the process of making a cargo assemblage, or the stacked cargo assemblage according to any of the preceding and proceeding paragraphs of this Aspects of the Invention Section, as applicable, wherein the third functional perimeter is less than about 1.5% less than the first actual perimeter.

The cargo assemblage, the process of making a cargo assemblage, or the stacked cargo assemblage according to any of the preceding and proceeding paragraphs of this Aspects of the Invention Section, as applicable, wherein the third functional perimeter is less than about 2.0% less than the first actual perimeter.

The cargo assemblage, the process of making a cargo assemblage, or the stacked cargo assemblage according to any of the preceding and proceeding paragraphs of this Aspects of the Invention Section, as applicable, wherein the third functional perimeter is less than about 2.5% less than the first actual perimeter.

The cargo assemblage, the process of making a cargo assemblage, or the stacked cargo assemblage according to any of the preceding and proceeding paragraphs of this Aspects of the Invention Section, as applicable, wherein the support layer allows for a more efficient tessellation of the plurality of packages resulting in an improvement in pallet efficiency of greater than about 25% compared to a cargo assemblage lacking a support layer.

The cargo assemblage, the process of making a cargo assemblage, or the stacked cargo assemblage according to any of the preceding and proceeding paragraphs of this Aspects of the Invention Section, as applicable, wherein the support layer allows for a more efficient tessellation of the plurality of packages resulting in an improvement in shipping efficiency of greater than about 25% compared to a cargo assemblage lacking a support layer.

The cargo assemblage, the process of making a cargo assemblage, or the stacked cargo assemblage according to any of the preceding and proceeding paragraphs of this Aspects of the Invention Section, as applicable, wherein the load is supported directly by each of the pallet and the support layer.

The cargo assemblage, the process of making a cargo assemblage, or the stacked cargo assemblage according to any of the preceding and proceeding paragraphs of this Aspects of the Invention Section, as applicable, wherein the support layer is disposed between the bottom surface of the load and the pallet.

The cargo assemblage, the process of making a cargo assemblage, or the stacked cargo assemblage according to any of the preceding and proceeding paragraphs of this Aspects of the Invention Section, as applicable, wherein the support layer is in contact with the pallet.

The cargo assemblage, the process of making a cargo assemblage, or the stacked cargo assemblage according to any of the preceding and proceeding paragraphs of this Aspects of the Invention Section, as applicable, wherein the load comprises a plurality of layers and wherein the support layer is disposed between layers of the load.

The cargo assemblage, the process of making a cargo assemblage, or the stacked cargo assemblage according to any of the preceding and proceeding paragraphs of this Aspects of the Invention Section, as applicable, wherein the load comprises a plurality of layers, including the top layer, and wherein the support layer is in contact with the top surface of the top layer.

The cargo assemblage, the process of making a cargo assemblage, or the stacked cargo assemblage according to any of the preceding and proceeding paragraphs of this Aspects of the Invention Section, as applicable, wherein only a portion of the support layer extends beyond the second and or third perimeters.

The cargo assemblage, the process of making a cargo assemblage, or the stacked cargo assemblage according to any of the preceding and proceeding paragraphs of this Aspects of the Invention Section, as applicable, wherein the support layer is planar such that portions extending beyond the load are not folded.

The cargo assemblage, the process of making a cargo assemblage, or the stacked cargo assemblage according to any of the preceding and proceeding paragraphs of this Aspects of the Invention Section, as applicable, wherein the support layer is compositionally uniform, such that it is not reinforced.

The cargo assemblage, the process of making a cargo assemblage, or the stacked cargo assemblage according to any of the preceding and proceeding paragraphs of this Aspects of the Invention Section, as applicable, wherein cargo rests directly on portions of the support layer extending beyond the pallet.

The cargo assemblage, the process of making a cargo assemblage, or the stacked cargo assemblage according to any of the preceding and proceeding paragraphs of this Aspects of the Invention Section, as applicable, wherein the support layer is a hexagon.

The cargo assemblage, the process of making a cargo assemblage, or the stacked cargo assemblage according to any of the preceding and proceeding paragraphs of this Aspects of the Invention Section, as applicable, wherein the support layer is a pentagon.

The cargo assemblage, the process of making a cargo assemblage, or the stacked cargo assemblage according to any of the preceding and proceeding paragraphs of this Aspects of the Invention Section, as applicable, wherein the support layer has a portion with a greater rigidity than another portion of the support layer.

The cargo assemblage, the process of making a cargo assemblage, or the stacked cargo assemblage according to any of the preceding and proceeding paragraphs of this Aspects of the Invention Section, as applicable, wherein the support layer has a portion having a coefficient of friction greater other portions of the support layer.

The cargo assemblage, the process of making a cargo assemblage, or the stacked cargo assemblage according to any of the preceding and proceeding paragraphs of this Aspects of the Invention Section, as applicable, wherein the support layer is corrugated.

The cargo assemblage, the process of making a cargo assemblage, or the stacked cargo assemblage according to any of the preceding and proceeding paragraphs of this Aspects of the Invention Section, as applicable, wherein the support layer comprises corrugated top and bottom surfaces.

The cargo assemblage, the process of making a cargo assemblage, or the stacked cargo assemblage according to any of the preceding and proceeding paragraphs of this Aspects of the Invention Section, as applicable, wherein the support layer has a functional area (A4MF/A1A) greater than about 105% and less than or equal to about 150% of a functional area (A1A).

The cargo assemblage, the process of making a cargo assemblage, or the stacked cargo assemblage according to any of the preceding and proceeding paragraphs of this Aspects of the Invention Section, as applicable, wherein a surface of the load is asymmetrically disposed on the support layer, such that a margin of space along a first side is greater than a margin of space along a second side of the support layer.

The cargo assemblage, the process of making a cargo assemblage, or the stacked cargo assemblage according to any of the preceding and proceeding paragraphs of this Aspects of the Invention Section, as applicable, wherein the support layer comprises tabs capable of at least partially interlocking with the pallet.

The cargo assemblage, the process of making a cargo assemblage, or the stacked cargo assemblage according to any of the preceding and proceeding paragraphs of this Aspects of the Invention Section, as applicable, wherein the support layer comprises feet.

The cargo assemblage, the process of making a cargo assemblage, or the stacked cargo assemblage according to any of the preceding and proceeding paragraphs of this Aspects of the Invention Section, as applicable, wherein the support layer comprises a plurality of panel components.

The cargo assemblage, the process of making a cargo assemblage, or the stacked cargo assemblage according to any of the preceding and proceeding paragraphs of this Aspects of the Invention Section, as applicable, wherein the support layer has a 3 point bending strength from about 4(N) to about 400(N).

The cargo assemblage, the process of making a cargo assemblage, or the stacked cargo assemblage according to any of the preceding and proceeding paragraphs of this Aspects of the Invention Section, as applicable, wherein the support layer extends beyond at least one of the side edges of the pallet.

The cargo assemblage, the process of making a cargo assemblage, or the stacked cargo assemblage according to any of the preceding and proceeding paragraphs of this Aspects of the Invention Section, as applicable, wherein the rolled products comprise cores and wherein the pallet, support layer, and cores form a vertical structure.

The cargo assemblage, the process of making a cargo assemblage, or the stacked cargo assemblage according to any of the preceding and proceeding paragraphs of this Aspects of the Invention Section, as applicable, wherein the cores have an axial rigidity and the support layer has a rigidity adequate to support the load.

The cargo assemblage, the process of making a cargo assemblage, or the stacked cargo assemblage according to any of the preceding and proceeding paragraphs of this Aspects of the Invention Section, as applicable, wherein the rolled products comprise a central axis and wherein the pallet, support layer, and central axis form a vertical structure.

The cargo assemblage, the process of making a cargo assemblage, or the stacked cargo assemblage according to any of the preceding and proceeding paragraphs of this Aspects of the Invention Section, as applicable, wherein the rolled products are housed within film packages.

The cargo assemblage, the process of making a cargo assemblage, or the stacked cargo assemblage according to any of the preceding and proceeding paragraphs of this Aspects of the Invention Section, as applicable, wherein the film packages are housed within boxes.

A stack, including a plurality of cargo assemblages according to any of the preceding paragraphs and proceeding, as applicable, resting one on top of the other, and further including an additional support layer therebetween.

The cargo assemblage, the process of making a cargo assemblage, or the stacked cargo assemblage according to any of the preceding and proceeding paragraphs of this Aspects of the Invention Section, as applicable, wherein at least one of the first, second, third, and fourth side faces are non-planar.

The cargo assemblage, the process of making a cargo assemblage, or the stacked cargo assemblage according to any of the preceding and proceeding paragraphs of this Aspects of the Invention Section, as applicable, wherein a footprint of the load on the support layer is non-square.

The cargo assemblage, the process of making a cargo assemblage, or the stacked cargo assemblage according to any of the preceding and proceeding paragraphs of this Aspects of the Invention Section, as applicable, wherein a footprint of the load on the support layer is non-rectangular.

The cargo assemblage, the process of making a cargo assemblage, or the stacked cargo assemblage according to any of the preceding and proceeding paragraphs of this Aspects of the Invention Section, as applicable, wherein the cargo assemblage comprises the pallet.

The cargo assemblage, the process of making a cargo assemblage, or the stacked cargo assemblage according to any of the preceding and proceeding paragraphs, as applicable, wherein the load is underhung on at least one side of the pallet.

The cargo assemblage, the process of making a cargo assemblage, or the stacked cargo assemblage according to any of the preceding and proceeding paragraphs of this Aspects of the Invention Section, as applicable, wherein the load is overhung by at least two inches on at least one side of the pallet.

The cargo assemblage, the process of making a cargo assemblage, or the stacked cargo assemblage according to any of the preceding and proceeding paragraphs of this Aspects of the Invention Section, as applicable, wherein the support layer overhangs the pallet greater than about 2 inches.

The cargo assemblage, the process of making a cargo assemblage, or the stacked cargo assemblage according to any of the preceding and proceeding paragraphs of this Aspects of the Invention Section, as applicable, wherein the support layer overhangs the pallet greater than about 3 inches.

The cargo assemblage, the process of making a cargo assemblage, or the stacked cargo assemblage according to any of the preceding and proceeding paragraphs of this Aspects of the Invention Section, as applicable, wherein the support layer overhangs at least two sides of the pallet by more than 2 inches and wherein the support layer overhangs at least two sides of the pallet layer by more than 3 inches.

The cargo assemblage, the process of making a cargo assemblage, or the stacked cargo assemblage according to any of the preceding and proceeding paragraphs of this Aspects of the Invention Section, as applicable, wherein the support layer overhangs at least two sides of the pallet by more than 3 inches and wherein the support layer overhangs at least two sides of the pallet layer by more than 4 inches.

The cargo assemblage, the process of making a cargo assemblage, or the stacked cargo assemblage according to any of the preceding and proceeding paragraphs of this Aspects of the Invention Section, as applicable, wherein the load extends beyond at least one of the side edges of the support layer.

The cargo assemblage, the process of making a cargo assemblage, or the stacked cargo assemblage according to any of the preceding and proceeding paragraphs of this Aspects of the Invention Section, as applicable, wherein the load overhangs multiple sides of the support layer.

The cargo assemblage, the process of making a cargo assemblage, or the stacked cargo assemblage according to any of the preceding and proceeding paragraphs of this Aspects of the Invention Section, as applicable, wherein the load overhangs multiple sides of the pallet.

The cargo assemblage, the process of making a cargo assemblage, or the stacked cargo assemblage according to any of the preceding and proceeding paragraphs of this Aspects of the Invention Section, as applicable, wherein the load overhangs each of the sides of the support layer.

The cargo assemblage, the process of making a cargo assemblage, or the stacked cargo assemblage according to any of the preceding and proceeding paragraphs of this Aspects of the Invention Section, as applicable, wherein the load overhangs each of the sides of the pallet.

The cargo assemblage, the process of making a cargo assemblage, or the stacked cargo assemblage according to any of the preceding and proceeding paragraphs of this Aspects of the Invention Section, as applicable, wherein at least one of the second functional perimeter and the optional third functional perimeter is larger than the fourth actual perimeter such that a portion of the load overhangs a portion of the support layer.

The cargo assemblage, the process of making a cargo assemblage, or the stacked cargo assemblage according to any of the preceding and proceeding paragraphs of this Aspects of the Invention Section, as applicable, wherein the band of integration material is in communications with at least two of the pallet, the bottom surface, the top surface, and the support layer.

The cargo assemblage, the process of making a cargo assemblage, or the stacked cargo assemblage according to any of the preceding and proceeding paragraphs of this Aspects of the Invention Section, as applicable, wherein the band of integration material is in communications with at least three of the pallet, the bottom surface, the top surface, and the support layer.

The cargo assemblage, the process of making a cargo assemblage, or the stacked cargo assemblage according to any of the preceding and proceeding paragraphs of this Aspects of the Invention Section, as applicable, wherein the band of integration material is in communications with each of the pallet, the bottom surface, the top surface, and the support layer.

The cargo assemblage, the process of making a cargo assemblage, or the stacked cargo assemblage according to any of the preceding and proceeding paragraphs of this Aspects of the Invention Section, as applicable, wherein the integration material is selected from the group consisting of film wrap, band, stretch wrap, tape, and combinations thereof.

The cargo assemblage, the process of making a cargo assemblage, or the stacked cargo assemblage according to any of the preceding and proceeding paragraphs of this Aspects of the Invention Section, as applicable, further including the integration material extending generally horizontally from a first side to a second side of the load.

The cargo assemblage, the process of making a cargo assemblage, or the stacked cargo assemblage according to any of the preceding and proceeding paragraphs of this Aspects of the Invention Section, as applicable, wherein the support layer punctures through a portion of the integration material.

The cargo assemblage, the process of making a cargo assemblage, or the stacked cargo assemblage according to any of the preceding and proceeding paragraphs of this Aspects of the Invention Section, as applicable, wherein portions of the support layer puncture through at least portions of the integration material.

The cargo assemblage, the process of making a cargo assemblage, or the stacked cargo assemblage according to any of the preceding and proceeding paragraphs of this Aspects of the Invention Section, as applicable, wherein the integration material is stretch wrapped more tightly at a top portion of the cargo assemblage than at a bottom portion of the cargo assemblage.

The cargo assemblage, the process of making a cargo assemblage, or the stacked cargo assemblage according to any of the preceding and proceeding paragraphs of this Aspects of the Invention Section, as applicable, wherein the integration material is disposed at an angle across at least two of the top, bottom, and middle sections.

The cargo assemblage, the process of making a cargo assemblage, or the stacked cargo assemblage according to any of the preceding and proceeding paragraphs of this Aspects of the Invention Section, as applicable, wherein the integration material is disposed at an angle across each of the top, bottom, and middle sections.

The cargo assemblage, the process of making a cargo assemblage, or the stacked cargo assemblage according to any of the preceding and proceeding paragraphs of this Aspects of the Invention Section, as applicable, wherein the integration material wraps the pallet.

The cargo assemblage, the process of making a cargo assemblage, or the stacked cargo assemblage according to any of the preceding and proceeding paragraphs of this Aspects of the Invention Section, as applicable, wherein the integration material wraps the support layer.

The cargo assemblage, the process of making a cargo assemblage, or the stacked cargo assemblage according to any of the preceding and proceeding paragraphs of this Aspects of the Invention Section, as applicable, wherein the integration material is a band of material.

The cargo assemblage, the process of making a cargo assemblage, or the stacked cargo assemblage according to any of the preceding and proceeding paragraphs of this Aspects of the Invention Section, as applicable, wherein the integration material is a plurality of bands of material.

The cargo assemblage, the process of making a cargo assemblage, or the stacked cargo assemblage according to any of the preceding and proceeding paragraphs of this Aspects of the Invention Section, as applicable, wherein the integration material is in multiple overlapping layers across the bottom section.

The cargo assemblage, the process of making a cargo assemblage, or the stacked cargo assemblage according to any of the preceding and proceeding paragraphs of this Aspects of the Invention Section, as applicable, wherein the integration material is disposed substantially horizontal.

The cargo assemblage, the process of making a cargo assemblage, or the stacked cargo assemblage according to any of the preceding and proceeding paragraphs of this Aspects of the Invention Section, as applicable, wherein the integration material is in multiple overlapping layers across the top section.

The cargo assemblage, the process of making a cargo assemblage, or the stacked cargo assemblage according to any of the preceding and proceeding paragraphs of this Aspects of the Invention Section, as applicable, wherein the integration material is in multiple overlapping layers across the middle section.

The cargo assemblage, the process of making a cargo assemblage, or the stacked cargo assemblage according to any of the preceding and proceeding paragraphs of this Aspects of the Invention Section, as applicable, wherein the integration material is disposed at an angle between about 30 and about 60 degrees.

The cargo assemblage, the process of making a cargo assemblage, or the stacked cargo assemblage according to any of the preceding and proceeding paragraphs of this Aspects of the Invention Section, as applicable, wherein the integration material is disposed at an angle between about 15 and about 60 degrees.

The cargo assemblage, the process of making a cargo assemblage, or the stacked cargo assemblage according to any of the preceding and proceeding paragraphs of this Aspects of the Invention Section, as applicable, wherein the integration material is disposed at an angle less than about 15 degrees and greater than zero.

The cargo assemblage, the process of making a cargo assemblage, or the stacked cargo assemblage according to any of the preceding and proceeding paragraphs of this Aspects of the Invention Section, as applicable, wherein each of the first, second, third, and fourth side faces each comprise first and second top corners and first and second bottom corners; wherein the integration material extends from the first bottom corner of the first side face to the second top corner of the first side face, from the second top corner of the first face to the second top corner of the second side face, from the second top corner of the second face to the second bottom corner of the third side face, from the second bottom corner of the third side face to the second top bottom of the fourth side face.

The cargo assemblage, the process of making a cargo assemblage, or the stacked cargo assemblage according to any of the preceding and proceeding paragraphs of this Aspects of the Invention Section, as applicable, wherein the integration material is in communication with a top surface of the load.

The cargo assemblage, the process of making a cargo assemblage, or the stacked cargo assemblage according to any of the preceding and proceeding paragraphs of this Aspects of the Invention Section, as applicable, wherein the integration material comprises stretch paper.

The cargo assemblage, the process of making a cargo assemblage, or the stacked cargo assemblage according to any of the preceding and proceeding paragraphs of this Aspects of the Invention Section, as applicable, wherein the integration material comprises plastic.

The cargo assemblage, the process of making a cargo assemblage, or the stacked cargo assemblage according to any of the preceding and proceeding paragraphs of this Aspects of the Invention Section, as applicable, further including integration material disposed across the bottom section and disposed across the top section at each of the first, second, third, and fourth side faces.

The cargo assemblage, the process of making a cargo assemblage, or the stacked cargo assemblage according to any of the preceding and proceeding paragraphs of this Aspects of the Invention Section, as applicable, wherein the integration material is disposed horizontally across the top section.

The cargo assemblage, the process of making a cargo assemblage, or the stacked cargo assemblage according to any of the preceding and proceeding paragraphs of this Aspects of the Invention Section, as applicable, wherein the integration material is disposed horizontally across the bottom section.

The cargo assemblage, the process of making a cargo assemblage, or the stacked cargo assemblage according to any of the preceding and proceeding paragraphs of this Aspects of the Invention Section, as applicable, wherein the integration material is at an angle of at least 10 degrees.

The cargo assemblage, the process of making a cargo assemblage, or the stacked cargo assemblage according to any of the preceding and proceeding paragraphs of this Aspects of the Invention Section, as applicable, wherein the support layer comprises notches.

The cargo assemblage, the process of making a cargo assemblage, or the stacked cargo assemblage according to any of the preceding and proceeding paragraphs of this Aspects of the Invention Section, as applicable, wherein multiple sides of the support layer comprises notches.

The cargo assemblage, the process of making a cargo assemblage, or the stacked cargo assemblage according to any of the preceding and proceeding paragraphs of this Aspects of the Invention Section, as applicable, wherein each of the sides of the support layer comprises notches.

The cargo assemblage, the process of making a cargo assemblage, or the stacked cargo assemblage according to any of the preceding and proceeding paragraphs of this Aspects of the Invention Section, as applicable, further including providing downward force on the load during the wrapping of the integration material around the load.

The cargo assemblage, the process of making a cargo assemblage, or the stacked cargo assemblage according to any of the preceding and proceeding paragraphs of this Aspects of the Invention Section, as applicable, further including wrapping the load from the bottom section to the top section of the load.

The cargo assemblage, the process of making a cargo assemblage, or the stacked cargo assemblage according to any of the preceding and proceeding paragraphs of this Aspects of the Invention Section, as applicable, further including wrapping the load at an angle from about 30 to about 60 degrees.

The cargo assemblage, the process of making a cargo assemblage, or the stacked cargo assemblage according to any of the preceding and proceeding paragraphs of this Aspects of the Invention Section, as applicable, further including wrapping the load at an angle less than about 15 degrees and greater than about zero degrees.

The cargo assemblage, the process of making a cargo assemblage, or the stacked cargo assemblage according to any of the preceding and proceeding paragraphs of this Aspects of the Invention Section, as applicable, further including wrapping the load at an angle less than about 30 degrees and greater than about zero degrees.

The cargo assemblage, the process of making a cargo assemblage, or the stacked cargo assemblage according to any of the preceding and proceeding paragraphs of this Aspects of the Invention Section, as applicable, further including wrapping the load at an angle less than about 30 degrees and greater than about zero degrees.

The cargo assemblage, the process of making a cargo assemblage, or the stacked cargo assemblage according to any of the preceding and proceeding paragraphs of this Aspects of the Invention Section, as applicable, wherein a unit holding the integration material moves around the load during the wrapping process.

The cargo assemblage, the process of making a cargo assemblage, or the stacked cargo assemblage according to any of the preceding and proceeding paragraphs of this Aspects of the Invention Section, as applicable, wherein the load rotates during the wrapping process.

The cargo assemblage, the process of making a cargo assemblage, or the stacked cargo assemblage according to any of the preceding and proceeding paragraphs of this Aspects of the Invention Section, as applicable, wherein each of the first, second, third, and fourth side faces each comprise first and second top corners and first and second bottom corners; wrapping the integration material such that it extends from the first bottom corner of the first side face to the second top corner of the first side face, from the second top corner of the first face to the second top corner of the second side face, from the second top corner of the second face to the second bottom corner of the third side face, from the second bottom corner of the third side face to the second top bottom of the fourth side face.

EXAMPLES

The following examples are put forth to provide those of ordinary skill in the art with a complete disclosure and description of how to perform the methods, how to make, and how to use the compositions and compounds disclosed and claimed herein. Efforts have been made to ensure accuracy with respect to numbers (e.g., amounts, temperature, etc.), but some errors and deviations should be accounted for. The purpose of the following examples is not to limit the scope of the various embodiments, but merely to provide examples illustrating specific embodiments. These examples provide the results of computer-aided simulations.

Example 1

Figure 15A:
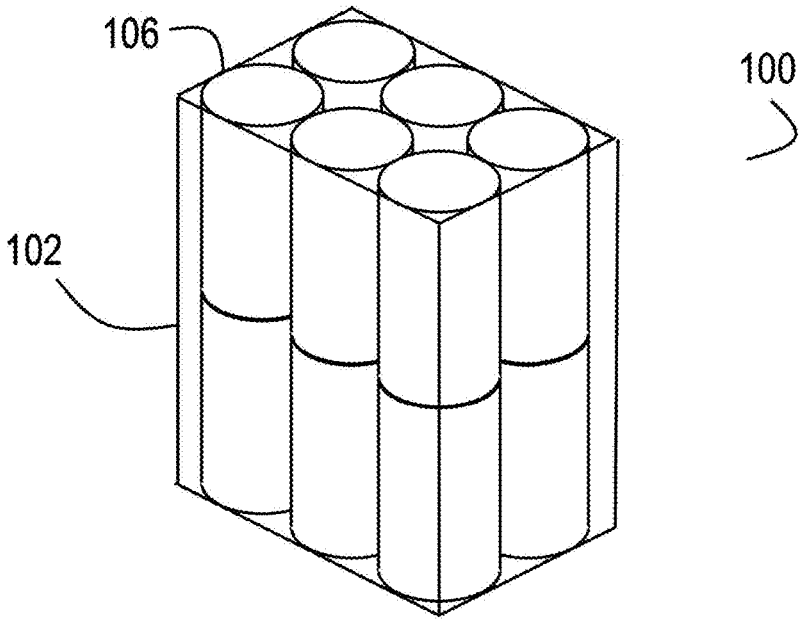
FIG. 15A is an example according to various embodiments, illustrating a package of rolled paper products as tested in Example 1.
Figure 15B:
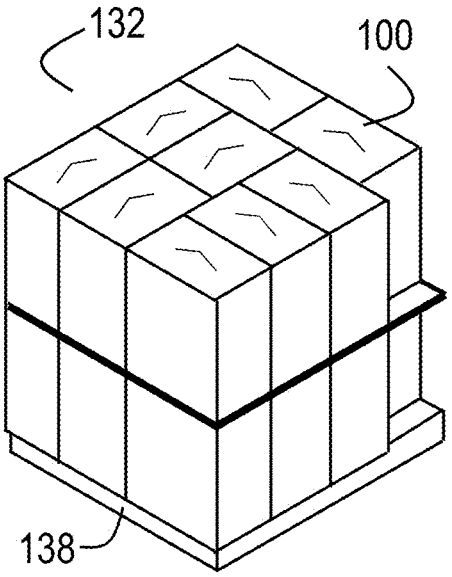
FIG. 15B is an example according to various embodiments, illustrating a cargo assemblage without a support layer as tested in Example 1.
Figure 15C:
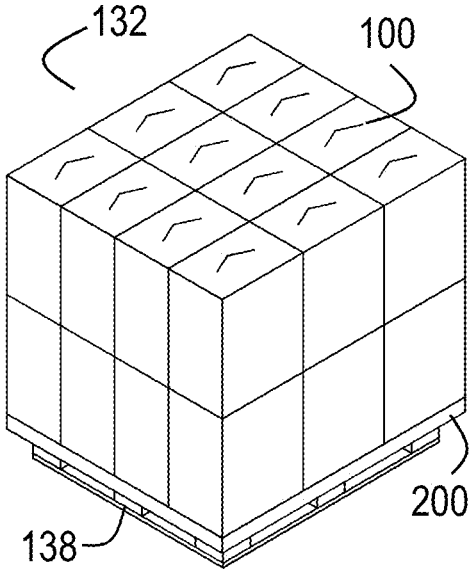
FIG. 15C is an example according to various embodiments, illustrating a cargo assemblage with a support layer as tested in Example 1.

A purpose of this example is to provide a comparison between a first cargo assemblage without a support layer, as illustrated in FIG. 15B, and a second cargo assemblage with a support layer, as illustrated in FIG. 15C, as simulated. Both cargo assemblages included a standard pallet, having dimensions of (length: 48"×width: 40"×height: 5.6"). Both cargo assemblages included stacked layers of packages 100 comprising containers 102 of rolled paper products 106. Each container contained 12 rolls of rolled paper as shown in FIG. 15A with a diameter of 6.45" before being packaged in the container. Each package had dimensions of (length: 18.3"× width: 12.28"×height: 22.0"). The second cargo assemblage also included a rectangular support layer comprising a single panel. The rectangular support layer was simulated as being formed of corrugated cardboard material. The rectangular support layer had dimensions of (length: 50.9"×width 45.2") and allowed for an overhang of about 2 inches per side, providing a functional perimeter having dimensions of (length: 54.9"×width 49.2"). The second cargo assemblage allowed for a more efficient tessellation of the packages. As shown in Table 2, the first cargo assemblage was only able to accommodate 9 packages per layer, while the second cargo assemblage was able to accommodate 12 packages per layer. Table 2 also tabulates the improvements in terms of packages per pallet (or per load), packages per truck, and cargo assemblages per truck. The truck included a cargo hold having dimensions of (length: 636"×width: 101"× height: 110"). Product that overhangs the pallets has been determined to be able to be compressed slightly as pallets are loaded onto the truck. Approximately 8" of compression has been determined to be reasonably expected along the length of the truck. As can be seen significant improvements were achieved by employing a support layer in the second cargo assemblage.

TABLE 2

| | First Cargo Assemblage | Second Cargo Assemblage |
|---|---|---|
| Packs/Layer | 9 | 12 |
| Roll Diameter before Packing (inches) | 6.45 | 6.45 |
| Roll Configuration in Pack (width × length × height in inches) | 2 × 3 × 2 | 2 × 3 × 2 |
| Pack Dimensions (width × diameter × height in inches) | 18.3 × 12.28 × 22.0 | 18.3 × 12.28 × 22.0 |
| Rolls (packs)/pallet | 216 (18) | 288 (24) |
| Product on Pallet Dimensions (width × length × height in inches) | 42.9 × 49.1 × 49.6 | 49.1 × 54.9 × 49.6 |
| Rolls (packs)/truck | 12960 (1080) | 12672 (1056) |
| Pallets/truck | 60 | 44 |

As shown in Table 2, the second cargo assemblage demonstrated a 33% improvement in pallet efficiency and only a 2% decrease in shipping efficiency.

Example 2

Figure 16A:
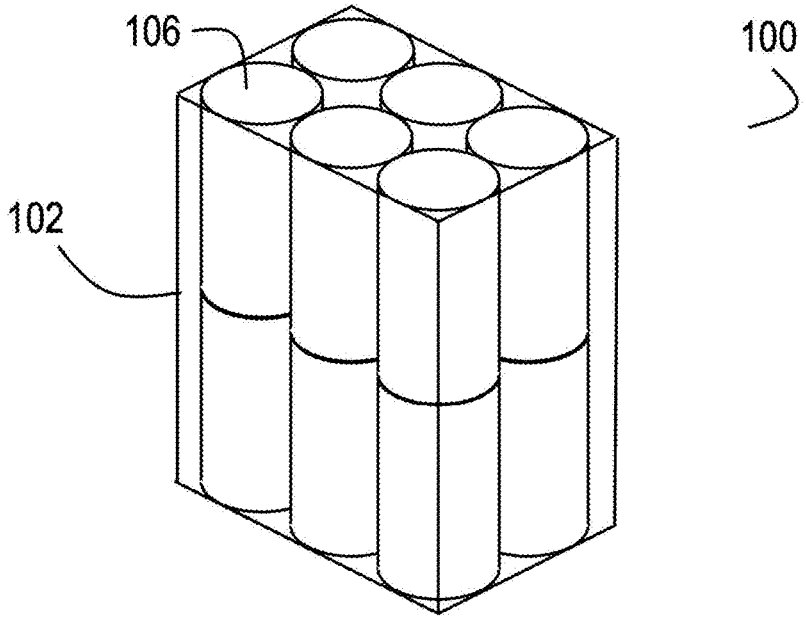
FIG. 16A is an example according to various embodiments, illustrating a package of rolled paper products as tested in Example 2.
Figure 16B:
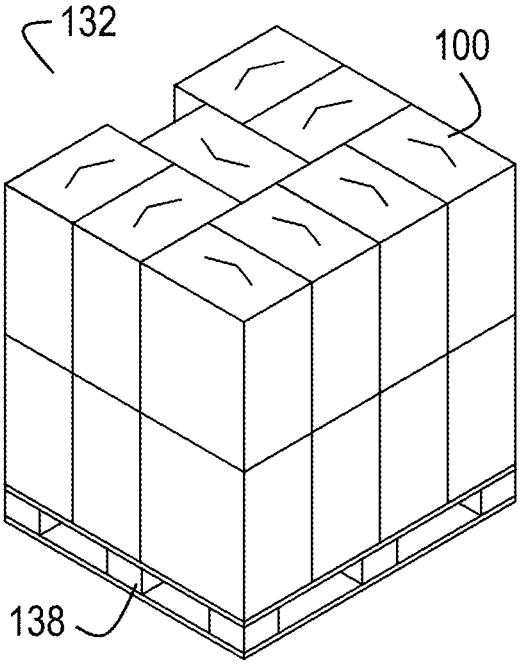
FIG. 16B is an example according to various embodiments, illustrating a cargo assemblage without a support layer as tested in Example 2.
Figure 16C:
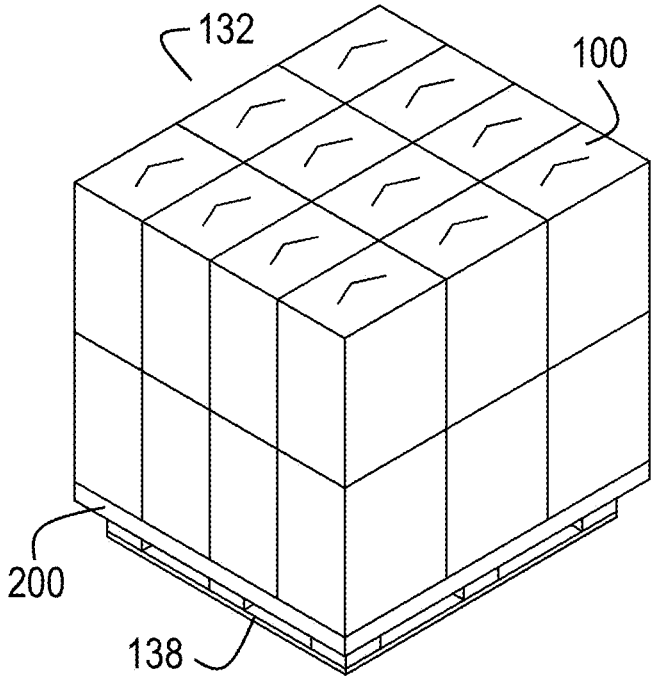
FIG. 16C is an example according to various embodiments, illustrating a cargo assemblage without a support layer as tested in Example 2.

A purpose of this example is to provide a comparison between a first cargo assemblage without a support layer, as illustrated in FIG. 16B, and a second cargo assemblage with a support layer, as illustrated in FIG. 16C, as simulated. Both cargo assemblages included a standard pallet, having dimensions of (length: 48"×width: 40"×height: 5.6"). Both cargo assemblages included stacked layers of packages 100 comprising containers 102 of rolled paper products 106. Each container contains 12 rolls of rolled paper as shown in FIG. 16A with a diameter of 6.20" before being packaged in the container. Each package had dimensions of (length: 17.6"× width: 11.8"×height: 22.0"). The second cargo assemblage also included a rectangular support layer comprising a single panel. The rectangular support layer was simulated as being formed of corrugated cardboard material. The rectangular support layer had dimensions of (length: 48.8"×width: 43.2") and allowed for up to 2 inches of overhang per side, providing a functional perimeter having dimensions of (length: 52.8"×width: 47.2"). The second cargo assemblage allowed for a more efficient tessellation of the packages. As shown in Table 3, the first cargo assemblage was only able to accommodate 9 packages per layer, while the second cargo assemblage was able to accommodate 12 packages per layer. Table 3 also tabulates the improvements in terms of packages per pallet (or per load), packages per truck, and cargo assemblages per truck. The truck included a cargo hold having dimensions of (length: 636"×width: 101"× height: 110"). Product that overhangs the pallets has been determined to be able to be compressed slightly as pallets are loaded onto the truck. Approximately 8" of compression has been determined to be reasonably expected along the length of the truck. As can be seen significant improvements were achieved by employing a support layer in the second cargo assemblage.

TABLE 3

| | First Cargo Assemblage | Second Cargo Assemblage |
|---|---|---|
| Packs/Layer | 9 | 12 |
| Roll Diameter before Packing (inches) | 6.20 | 6.20 |
| Roll Configuration in Pack (width × length × height in inches) | 2 × 3 × 2 | 2 × 3 × 2 |
| Pack Dimensions (width × diameter × height in inches) | 17.55 × 11.78 × 22.0 | 17.55 × 11.78 × 22.0 |
| Rolls (packs)/pallet | 216 (18) | 288 (24) |
| Product on Pallet Dimensions (width × length × height in inches) | 41.1 × 47.1 × 49.6 | 46.6 × 53.0 × 49.6 |
| Rolls (packs)/truck | 12960 (1080) | 14400 (1200) |
| Pallets/truck | 60 | 50 |

As shown in Table 3, the second cargo assemblage demonstrated 33% improvement in pallet efficiency and an increase of 11% in shipping efficiency.

Example 3

Figure 17A:
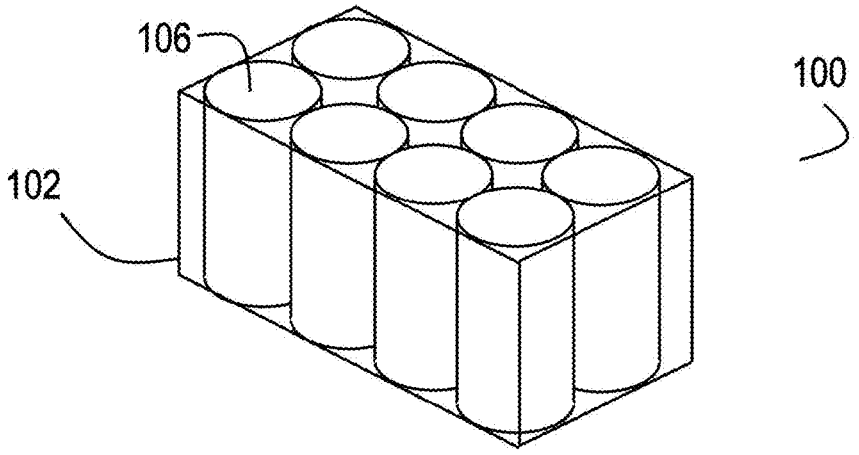
FIG. 17A is an example according to various embodiments, illustrating a package of rolled paper products as tested in Example 3.
Figure 17B:
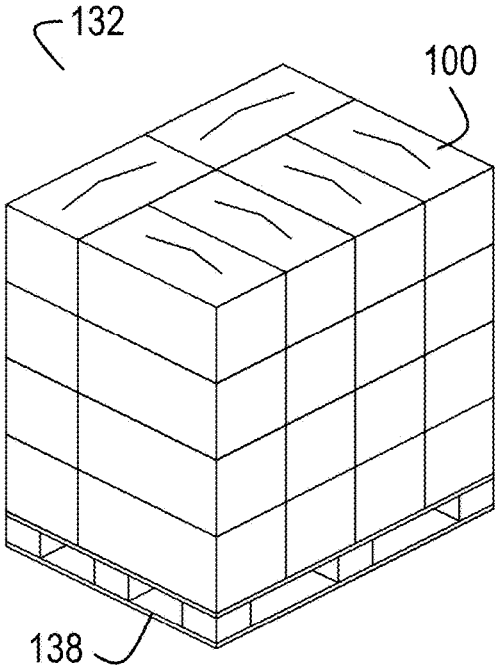
FIG. 17B is an example according to various embodiments, illustrating a truck packed with a plurality of stacked cargo assemblages without support layers as tested in Example 3.
Figure 17C:
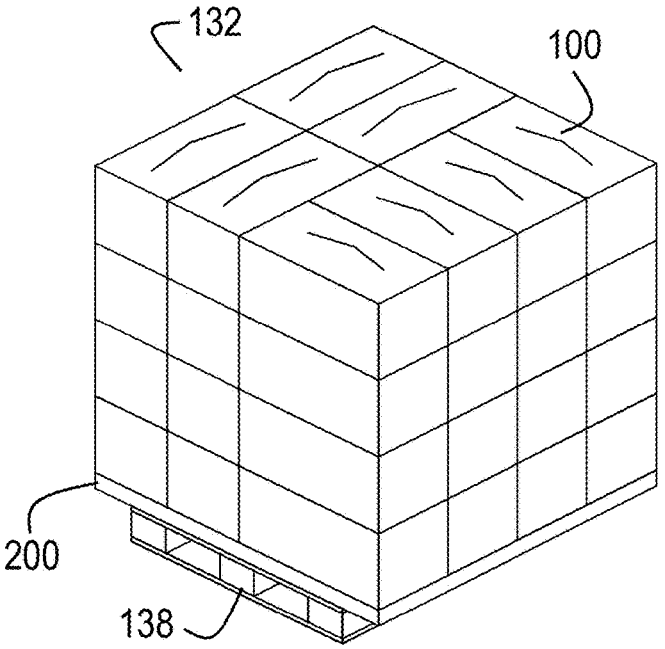
FIG. 17C is an example according to various embodiments, illustrating a truck packed with a plurality of stacked cargo assemblages with support layers as tested in Example 3.

A purpose of this example is to provide a comparison between a first cargo assemblage without a support layer, as illustrated in FIG. 17B, and a second cargo assemblage with a support layer, as illustrated in FIG. 17C, as simulated. Both cargo assemblages included a standard pallet, having dimensions of (length: 48"×width: 40"×height: 5.6"). Both cargo assemblages included stacked layers of packages 100 comprising containers 102 of rolled paper products 106. Each container contains 8 rolls of rolled paper as shown in FIG. 17A with a diameter of 6.45" before being packaged in the container. Each package had dimensions of (length: 12.28"× width: 24.44"×height: 11.0"). The second cargo assemblage also included a rectangular support layer comprising a single panel. The rectangular support layer was simulated as being formed of corrugated cardboard material. The rectangular support layer had dimensions of (length: 45.04×width: 44.9) and allowed up to 2 inches of overhang per side, providing a functional perimeter having dimensions of (length: 49.04× width: 48.9). The second cargo assemblage allowed for a more efficient tessellation of the packages. As shown in Table 4, the first cargo assemblage was only able to accommodate 6 packages per layer, while the second cargo assemblage was able to accommodate 8 packages per layer. Table 4 also tabulates the improvements in terms of packages per pallet (or per load), packages per truck, and cargo assemblages per truck. The truck included a cargo hold having dimensions of (length: 636"×width: 101"×height: 110"). As can be seen significant improvements were achieved by employing a support layer in the second cargo assemblage.

TABLE 4

| | First Cargo Assemblage | Second Cargo Assemblage |
|---|---|---|
| Packs/Layer | 6 | 8 |
| Roll Diameter before Packing (inches) | 6.45 | 6.45 |
| Roll Configuration in Pack (width × length × height in inches) | 2 × 4 × 1 | 2 × 4 × 1 |
| Pack Dimensions (width × diameter × height in inches) | 24.44 × 12.28 × 11.0 | 24.44 × 12.28 × 11.0 |

TABLE 4-continued

| | First Cargo Assemblage | Second Cargo Assemblage |
|---|---|---|
| Rolls (packs)/pallet | 192 (24) | 256 (32) |
| Product on Pallet Dimensions (width × length × height in inches) | 40.0 × 49.5 × 49.6 | 49.3 × 49.5 × 49.6 |
| Rolls (packs)/truck | 11520 (1440) | 13312 (1664) |
| Pallets per truck | 60 | 52 |

As shown in Table 4, the second cargo assemblage demonstrated 33% improvement in pallet efficiency and a 13% increase in shipping efficiency.

Example 4

Figure 18A:
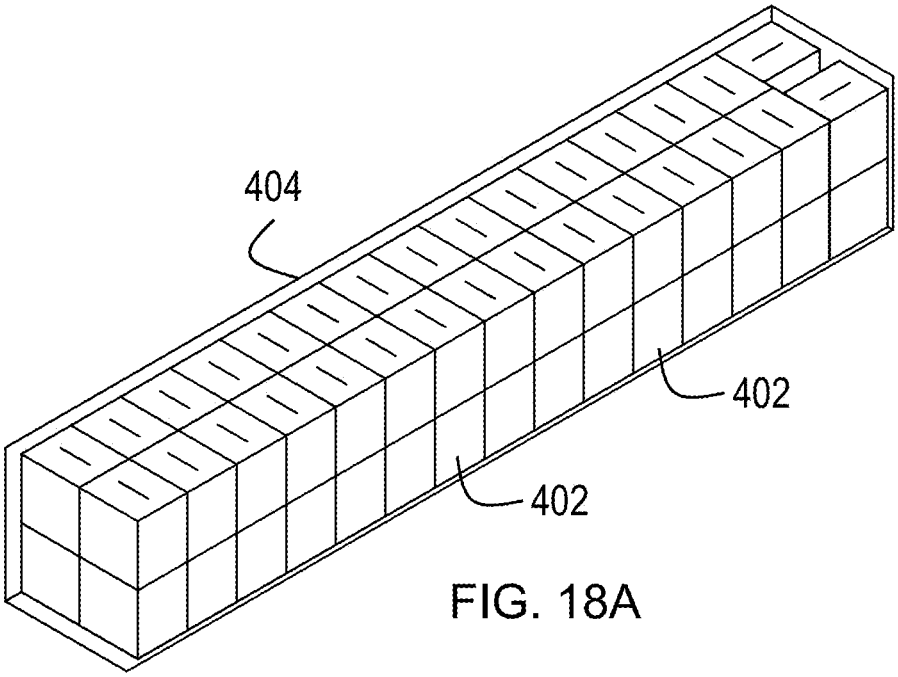
FIG. 18A is an example according to various embodiments, illustrating a first plurality of cargo assemblages according to FIG. 14B packed into the cargo hold of a truck.
Figure 18B:
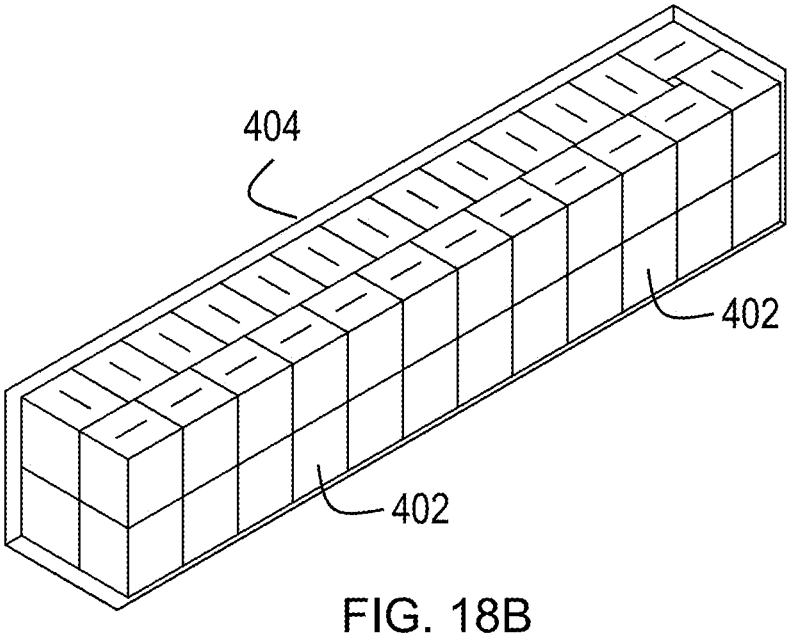
FIG. 18B is an example according to various embodiments, illustrating a second plurality of cargo assemblages according to FIG. 14C packed into the cargo hold of a truck.

A purpose of this example is to simulate and to compare a first plurality of cargo assemblages 402 according to FIG. 16B (and detailed in Example 2) packed into the cargo hold 404 of a truck as illustrated in FIG. 18A with a second plurality of cargo assemblages according to FIG. 16C (and detailed in Example 2) packed into the truck as illustrated in FIG. 18B.

The simulated truck included a cargo hold having dimensions of (length: 636"×width: 101"×height: 110"). Product that overhangs the pallets has been determined to be able to be compressed slightly as pallets are loaded onto the truck. Approximately 8" of compression has been determined to be reasonably expected along the length of the truck. As described in Example 2, all of the cargo assemblages included a standard pallet, having dimensions of (length: 48"×width: 40"×height: 5.6"), and included stacked layers of packages comprising containers of rolled paper products. Each package had dimensions of (length: 17.6"×width: 11.8"×height: 22.0"), as detailed in Example 2, and as shown in FIG. 16A.

In each case, the cargo assemblages were arranged in stacks. Each stack comprised two cargo assemblages, positioned one on top of the other. As shown in Table 5, when packed with the first plurality of cargo assemblages, the truck was able to accommodate 30 stacks and when packed with the second plurality of cargo assemblages, the truck was able to accommodate 25 stacks. Even though the truck packed with the second plurality of cargo assemblages held fewer stacks, it held more packages. This means that using the support layer not only allows more packages to be shipped, but also reduces the number of stacks that need to be loaded and unloaded from the truck, further improving shipping efficiency.

TABLE 5

| | Plurality of First Cargo Assemblages | Plurality of Second Cargo Assemblages |
|---|---|---|
| Stacks/Truck | 30 | 25 |
| Packages/Truck | 1080 | 1200 |

Example 5

Figure 19A:
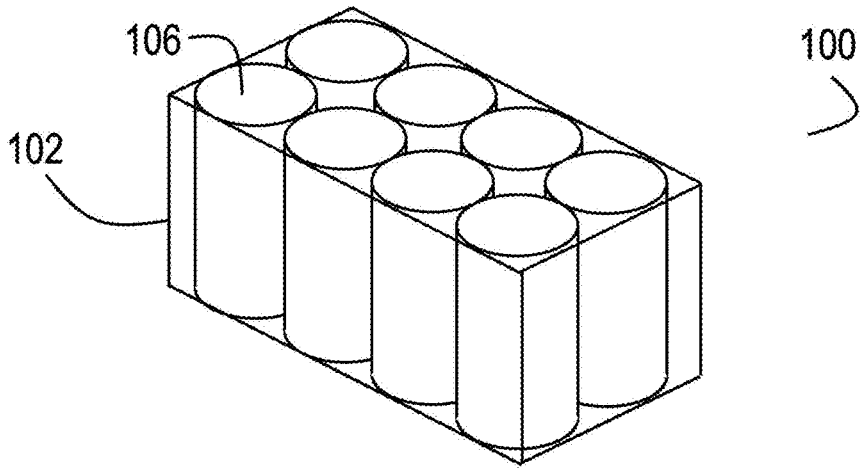
FIG. 19A is an example according to various embodiments, illustrating a package of rolled paper products as tested in Example 5.
Figure 19B:
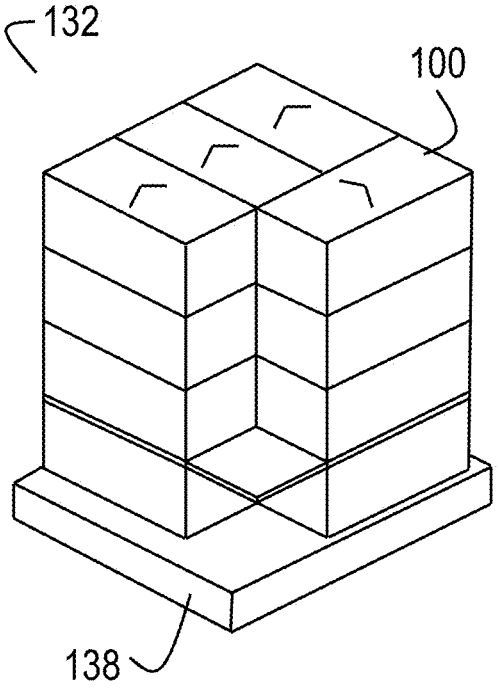
FIG. 19B is an example according to various embodiments, illustrating a truck packed with a plurality of stacked cargo assemblages without support layers as tested in Example 5.
Figure 19C:
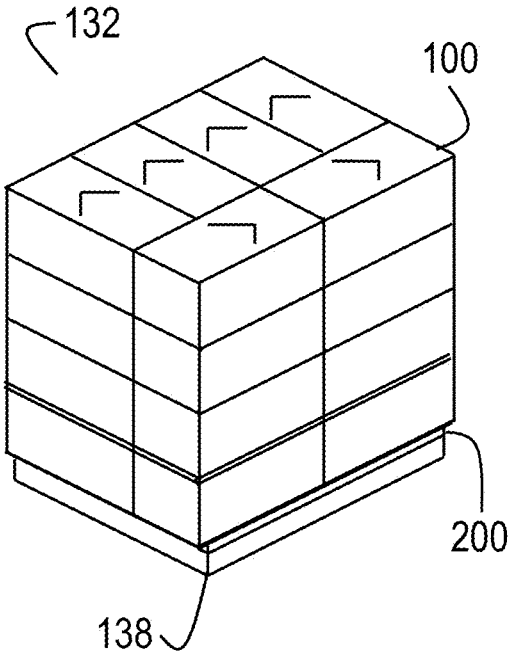
FIG. 19C is an example according to various embodiments, illustrating a truck packed with a plurality of stacked cargo assemblages with support layers as tested in Example 5.
Figure 20:
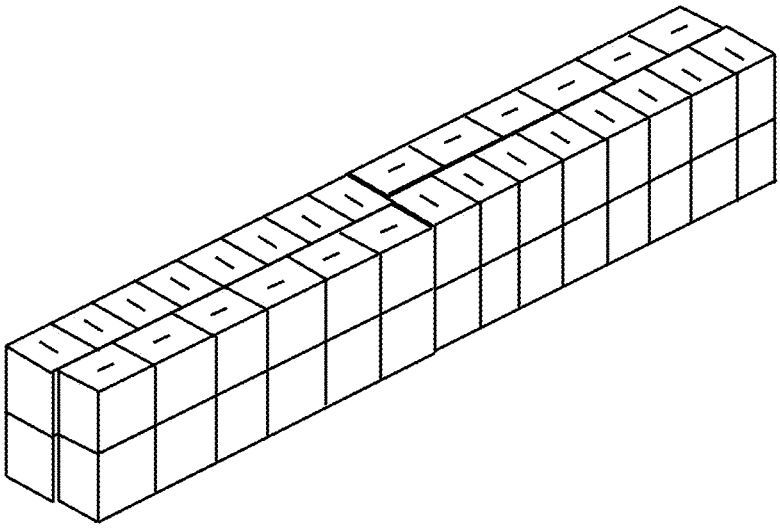
FIG. 20 is an example according to various embodiments, illustrating a second plurality of cargo assemblages according to FIG. 19C packed into the cargo hold of a truck.

A purpose of this example is to provide a comparison between a first cargo assemblage without a support layer, as illustrated in FIG. 19B, and a second cargo assemblage with a support layer, as illustrated in FIG. 19C, as simulated. Both cargo assemblages included a standard pallet, having dimensions of (length: 48"×width: 40"×height: 5.6"). Both cargo assemblages included stacked layers of packages 100 comprising containers 102 of rolled paper products 106. Each container contains 8 rolls of rolled paper as shown in FIG. 19A with a diameter of 6.45" before being packaged in the container. Each package had dimensions of (length: 13.2"× width: 26.3"×height: 11.0"). The second cargo assemblage also included a rectangular support layer 200 comprising a single panel. The rectangular support layer was simulated as being formed of corrugated cardboard material. The rectangular support layer had dimensions of (length: 48.7×width: 35.4) and allowed up to 2 inches of overhang per side, providing a functional perimeter having dimensions of (length: 52.7×width: 39.4). The second cargo assemblage allowed for a more efficient tessellation of the packages. As shown in Table 6, the first cargo assemblage was only able to accommodate 4 packages per layer, while the second cargo assemblage was able to accommodate 6 packages per layer. Table 6 also tabulates the improvements in terms of packages per pallet (or per load), packages per truck, and cargo assemblages per truck. The truck included a cargo hold having dimensions of (length: 636"×width: 101"× height: 110") and the truck can be loaded with the second cargo assemblages as seen in FIG. 20. As can be seen significant improvements were achieved by employing a support layer in the second cargo assemblage.

TABLE 6

| | First Cargo Assemblage | Second Cargo Assemblage |
|---|---|---|
| Packs/Layer | 4 | 6 |
| Roll Diameter before Packing (inches) | 6.45 | 6.45 |
| Roll Configuration in Pack (width × length × height in inches) | 2 × 4 × 1 | 2 × 4 × 1 |
| Pack Dimensions (width × diameter × height in inches) | 26.3 × 13.2 × 11.0 | 26.3 × 13.2 × 11.0 |
| Rolls (packs)/pallet | 128 (16) | 192 (24) |
| Product on Pallet Dimensions (width × length × height in inches) | 39.4 × 39.5 × 49.6 | 39.4 × 52.7 × 49.6 |
| Rolls (packs)/truck | 7680 (960) | 10752 (1344) |
| Pallets per truck | 60 | 56 |

Support layers and/or configurations of integration material of the present disclosure, beyond being used with cargo assemblages of sanitary tissue products, may be used with cargo assemblages of other relatively light and bulky goods (e.g., potato chips, cotton balls, etc.), such as many consumer goods, such as absorbent articles (e.g., such as diapers, adult incontinence articles, feminine hygiene pads, etc.). For example, in the same way support layers of the present disclosure may be used to create layer(s) of sanitary tissue products having a larger functional perimeter than an actual perimeter of a pallet, support layers as described herein may be used to create layer(s) of absorbent articles having a larger functional perimeter than an actual perimeter of a pallet. Likewise, as another example, in the same way support layers of the present disclosure may be used to create a more stable top surface of a sanitary tissue product load so that a second cargo assemblage of sanitary tissue products may be stacked on top of it, support layers as described herein may be used to create a more stable top surface of an absorbent article product load so that a second cargo assemblage of absorbent articles may be stacked on top of it.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cargo assemblage including: a load including a plurality of packages of rolled products arranged in a plurality of layers, the load including a bottom section, a top section, and a middle section; wherein the load further comprises a first side face, a second side face, a third side face, and a fourth side face; and at least one of a support layer and a pallet; wherein the load overhangs at least a portion of the at least one of the support layer and pallet; and wherein an integration material is disposed at an angle of greater than 10 degrees across at least one of the top, bottom, and middle sections on at least one of the first, second, third, and fourth side faces.

2. The cargo assemblage according to claim 1, wherein the load is underhung on at least one side of the pallet.

3. The cargo assemblage according to claim 1, wherein the load is supported directly by each of the pallet and the support layer.

4. The cargo assemblage according to claim 1, wherein the integration material is disposed at an angle between about 30 and about 60 degrees.

5. The cargo assemblage according to claim 1, wherein the integration material is disposed at an angle between about 15 and about 60 degrees.

6. The cargo assemblage according to claim 1, wherein the integration material is disposed at an angle less than about 15 degrees and greater than zero.

7. The cargo assemblage of claim 1, wherein the support layer has a Support Layer 3Point Bend Peak Force value greater than about 5 (N).

8. The cargo assemblage according to claim 1, wherein the load is underhung on multiple sides of the pallet.

9. The cargo assemblage according to claim 1, wherein the load is overhung on multiple sides of the pallet.

10. The cargo assemblage according to claim 1, wherein the at least one layer comprises rolled sanitary tissue products having an average diameter of about 7.5 inches or greater.

11. The cargo assemblage according to claim 10, wherein the at least one layer comprises a layer of rolled sanitary tissue products disposed immediately below the support layer, the layer of rolled sanitary tissue products having less than about 42 cores.

12. The cargo assemblage according to claim 1, comprising at least two support layers.

13. The cargo assemblage of claim 1, wherein the integration material is disposed at an angle across at least two of the top, bottom, and the middle sections.

14. The cargo assemblage of claim 1, wherein the integration material is disposed at an angle across at least three of the top, bottom, and the middle sections.

15. The cargo assemblage of claim 1, wherein the integration material wraps the pallet.

16. The cargo assemblage of claim 1, wherein the integration material wraps the support layer.

17. The cargo assemblage of claim 1, wherein the support layer overhangs the pallet greater than about 2 inches.

18. The cargo assemblage of claim 1, wherein the integration material is a band of material.

19. The cargo assemblage of claim 1, wherein the support layer is disposed between the bottom and middle sections.

20. The cargo assemblage of claim 1, wherein the support layer is disposed between the middle and top sections.

21. The cargo assemblage of claim 1, wherein the support layer is disposed on a top surface of the top section.

* * * * *